United States Patent [19]

Mozer et al.

[11] 4,214,125

[45] Jul. 22, 1980

[54] METHOD AND APPARATUS FOR SPEECH SYNTHESIZING

[75] Inventors: Forrest S. Mozer, 38 Somerset Pl., Berkeley, Calif. 94707; Richard P. Stauduhar, Berkeley, Calif.

[73] Assignee: Forrest S. Mozer, Berkeley, Calif.

[21] Appl. No.: 761,210

[22] Filed: Jan. 21, 1977

Related U.S. Application Data

[63] Continuation of Ser. No. 632,140, Nov. 14, 1975, abandoned, which is a continuation-in-part of Ser. No. 525,388, Nov. 20, 1974, abandoned, which is a continuation-in-part of Ser. No. 432,859, Jan. 14, 1974, abandoned.

[51] Int. Cl.[2] ..... G10L 1/00

[52] U.S. Cl. ..... 179/1 SM

[58] Field of Search ..... 179/1 SM, 1 SA, 15 A, 179/15 AC, 15 PC, 15.55 T

[56] References Cited

U.S. PATENT DOCUMENTS

| | | | |
|---|---|---|---|
| 3,102,165 | 8/1963 | Clapper | 179/1 SG |
| 3,165,741 | 1/1965 | Thor | 179/15 AC |
| 3,369,077 | 2/1968 | French | 179/1 SM |
| 3,416,080 | 12/1968 | Wright et al. | 179/1 SD |
| 3,588,353 | 6/1971 | Martin | 179/1 SA |
| 3,588,353 | 6/1971 | Martin | 179/1.5 SA |
| 3,641,496 | 2/1972 | Slavin | 179/1 SM |
| 3,750,024 | 7/1973 | Dunn | 179/1 SA |
| 3,789,144 | 1/1974 | Doyle | 179/15.55 T |
| 3,811,016 | 5/1974 | Takasaki et al. | 179/170 R |
| 3,892,919 | 7/1975 | Ichikawa | 179/1 SM |
| 3,942,126 | 3/1976 | Muraoka | 179/15 A |

OTHER PUBLICATIONS

W. Bucholz, "Computer Controlled Audio Output", IBM Tech. Bull., vol. 3, No. 5, Oct. 1960, p. 60.

J. L. Flanagan, "Speech Analysis, Synthesis and Perception", Springer-Verlag, 1972, pp. 395,396,401-404.

G. Hellwarth, G. Jones, "Automatic Conditioning of Speech Signals," IEEE Trans. on Audio and EA, Jun. 1968 pp. 169-179.

*Primary Examiner*—Malcolm A. Morrison
*Assistant Examiner*—E. S. Kemeny
*Attorney, Agent, or Firm*—Townsend and Townsend

[57] ABSTRACT

A method and apparatus for analyzing and synthesizing speech information in which a predetermined vocabulary is spoken into a microphone, the resulting electrical signals are differentiated with respect to time, digitized, and the digitized waveform is appropriately expanded or contracted by linear interpolation so that the pitch periods of all such waveforms have a uniform number of digitizations and the amplitudes are normalized with respect to a reference signal. These "standardized" speech information digital signals are then compressed in the computer by subjectively removing and discarding redundant speech information such as redundant pitch periods, portions of pitch periods, redundant phonemes and portions of phonemes, redundant amplitude information (delta modulation) and phase informaton (Fourier transformation). The compression techniques are selectively applied to certain of the speech information signals by listening to the reproduced, compressed information. The resulting compressed digital information and associated compression instruction signals produced in the computer are thereafter injected into the digital memories of a digital speech synthesizer where they can be selectively retrieved and audibly reproduced to recreate the original vocabulary words and sentences from them.

100 Claims, 29 Drawing Figures

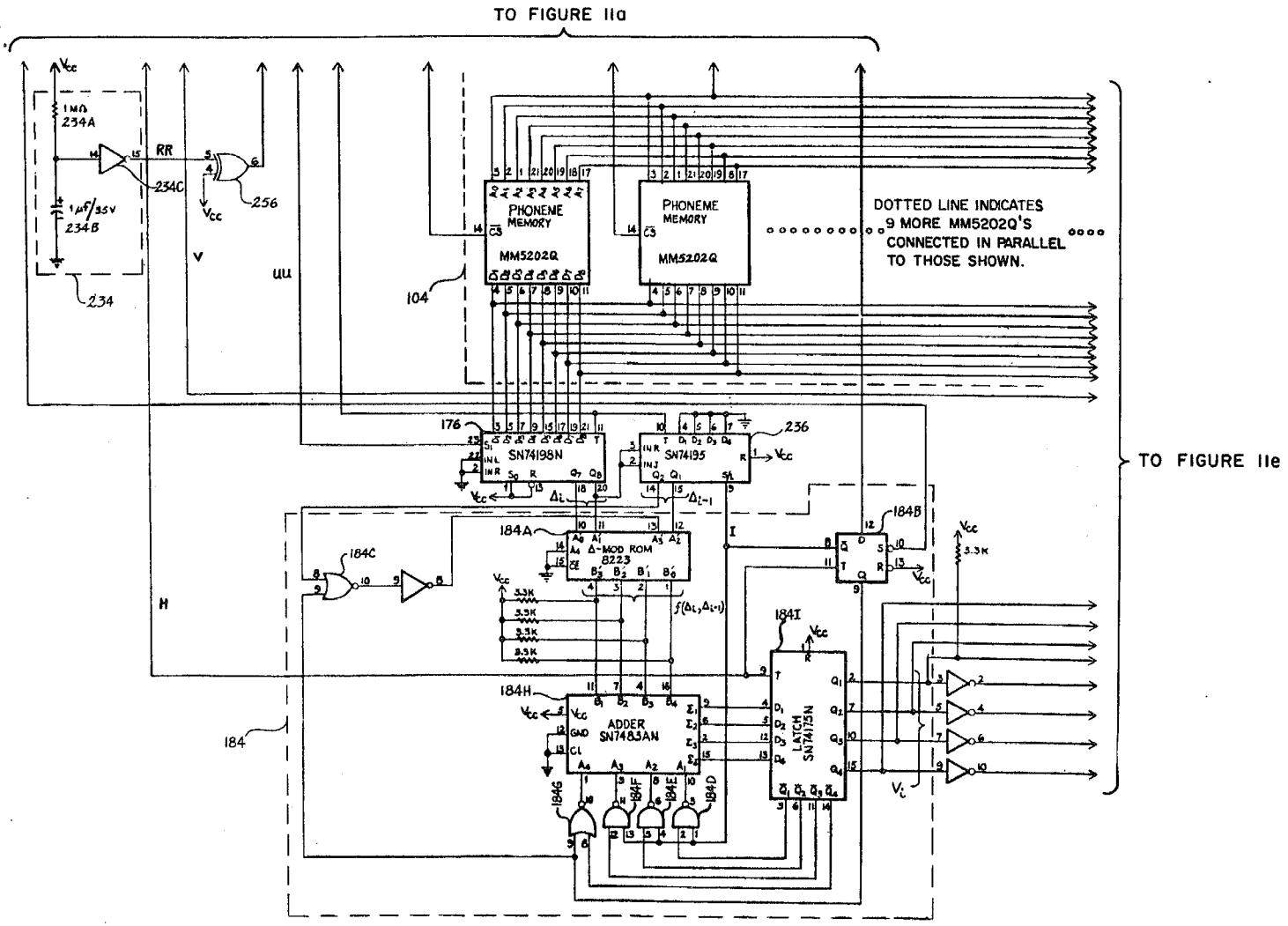
FIG. IId

METHOD AND APPARATUS FOR SPEECH SYNTHESIZING

CROSS-REFERENCE TO RELATED APPLICATION

This application is a continuation of my prior co-pending application Ser. No. 632,140, filed Nov. 14, 1975 entitled "METHOD AND APPARATUS FOR SPEECH SYNTHESIZING", now abandoned, which was a continuation-in-part of my prior co-pending application Ser. No. 525,388, filed Nov. 20, 1974, entitled "METHOD AND APPARATUS FOR SPEECH SYNTHESIZING", now abandoned, which, in turn, is a continuation-in-part of my prior application Ser. No. 432,859, filed Jan. 14, 1974, entitled "METHOD FOR SYNTHESIZING SPEECH AND OTHER COMPLEX WAVEFORMS", which was abandoned in favor of application Ser. No. 525,388.

FIELD OF THE INVENTION

The present invention relates to speech synthesis and more particularly to a method for analyzing and synthesizing speech and other complex waveforms using basically digital techniques.

BACKGROUND OF THE INVENTION

Devices that synthesize speech must be capable of producing all the sounds of the language of interest. There are 34 such sounds or phonemes in the General American Dialect, exclusive of diphthongs, affricates and minor variants. Examples of two such phonemes, the sounds /n/ and /s/, are given in FIGS. 1 and 2, in which the amplitude of the speech signal is presented as a function of time. These two waveforms differ in that the phoneme /n/ has a quasi-periodic structure with a period of about 10 milliseconds, while the phoneme /s/ has no such structure. This is because the phoneme /n/ is produced through excitation of the vocal chords while /s/ is generated by passage of air through the larynx without excitation of the vocal chords. Thus, phonemes may be either voiced (i.e., produced by excitation of the vocal chords) or unvoiced (no such excitation) and the waveform of voiced phonemes is quasi-periodic. This period, called the pitch period, is such that male voices generally have a long pitch period (low pitch frequency) while females voices generally have higher pitch frequencies.

In addition to the above voiced-unvoiced distinction, phonemes may be classified in other ways, as summarized in Table 1, for the phonemes of the General American Dialect. The vowels, voiced fricatives, voiced stops, nasal consonants, glides, and semivowels are all voiced while the unvoiced fricatives and unvoiced stop consonants are not voiced. The fricatives are produced by an incoherent noise excitation of the vocal tract by causing turbulent air to flow past a point of constriction. To produce stop consonants a complete closure of the vocal tract is formed at some point and the lungs build up pressure which is suddenly released by opening the vocal tract.

TABLE 1

| Phonemes Of The General American Dialect | | |
|---|---|---|
| Vowels | | |
| /i/ | as in | "three" |
| /I/ | as in | "it" |
| /e/ | as in | "hate" |

TABLE 1-continued

| Phonemes Of The General American Dialect | | |
|---|---|---|
| /ae/ | as in | "at" |
| /a/ | as in | "father" |
| /ɔ/ | as in | "all" |
| /o/ | as in | "obey" |
| /v/ | as in | "foot" |
| /u/ | as in | "boot" |
| /ʌ/ | as in | "up" |
| /ɝ/ | as in | "bird" |
| Unvoiced Fricative Consonants | | |
| /f/ | as in | "for" |
| /θ/ | as in | "thin" |
| /s/ | as in | "see" |
| /S/ | as in | "she" |
| /h/ | as in | "he" |
| Voiced Fricative Consonants | | |
| /v/ | as in | "vote" |
| /δ/ | as in | "then" |
| /z/ | as in | "zoo" |
| /ʒ/ | as in | "azure" |
| Unvoiced Stop Consonants | | |
| /p/ | as in | "play" |
| /t/ | as in | "to" |
| /k/ | as in | "key" |
| Voiced Stop Consonants | | |
| /b/ | as in | "be" |
| /d/ | as in | "day" |
| /g/ | as in | "go" |
| Nasal Consonants | | |
| /m/ | as in | "me" |
| /n/ | as in | "no" |
| /ŋ/ | as in | "sing" |
| Glides and Semivowels | | |
| /w/ | as in | "we" |
| /j/ | as in | "you" |
| /r/ | as in | "read" |
| /l/ | as in | "let" |

Phonemes may be characterized in other ways than by plots of their time history as was done in FIGS. 1 and 2. For example, a segment of the time history may be Fourier analyzed to produce a power spectrum, that is, a plot of signal amplitude versus frequency. Such a power spectrum for the phoneme /u/ as in "to" is presented in FIG. 3. The meaning of such a graph is that the waveform produced by superimposing many sine waves of different frequencies, each of which has the amplitude denoted in FIG. 3 at its frequency, would have the temporal structure of the initial waveform.

From the power spectrum of FIG. 3 it is seen that certain frequencies or frequency bands have larger amplitudes than do others. The lowest such band, near a frequency of 100 Hertz, is associated with the pitch of the male voice that produced this sound. The higher frequency peaks, near 300, 1000, and 2300 Hertz, provide the information that distinguishes this phoneme from all others. These frequencies, called the first, second, and third format frequencies, are therefore the variables that change with the orientation of the lips, tongue, nasal passage, etc., to produce a string of connected phonemes representing human speech.

The previous state of the art in speech synthesis is well described in a recent book (Flanagan, *Speech Analysis, Synthesis, and Preception,* Springer-Verlag, 1972). Two of the major goals of this work have been the understanding of speech generation and recognition processes, and the development of synthesizers having extremely large vocabularies. Through this work it has been learned that the single most important requirement of an intelligible speech synthesizer is that it produce the proper formant frequencies of the phonemes being generated. Thus, current and recent synthesizers operate by generating the formant frequencies in the following way. Depending on the phoneme of interest, either voiced or unvoiced excitation is produced by electronic means. The voiced excitation is characterized by a power spectrum having a low frequency cutoff at the pitch frequency and a power that decreases with increasing frequency above the pitch frequency. Unvoiced excitation is characterized by a broad-band white noise spectrum. One or the other of these waveforms is then passed through a series of filters or other electronic circuitry that causes certain selected frequencies (the formant frequencies of interest) to be amplified. The resulting power spectrum of voiced phonemes is like that of FIG. 3 and, when played into a speaker, produces the audible representation of the phoneme of interest. Such devices are generally called vocoders, many varieties of which may be purchased commercially. Other vocoders are disclosed in U.S. Pat. Nos. 3,102,165 and 3,318,002.

In such devices the formant frequency information required to generate a string of phonemes in order to produce connected speech is generally stored in a full-sized computer that also controls the volume, the duration, voiced and unvoiced distinctions, etc. Thus, while existing vocoders are able to generate very large vocabularies, they require a full sized computer and are not capable of being miniaturized to dimensions less than 0.25 inches, as is the synthesizer described in the present invention.

One of the important results of speech research in connection with vocoders has been the realization that phonemes cannot generally be strung together like beads on a string to produce intelligible speech (Flanagan, 1972). This is because the speech producing organs (mouth, tongue, throat, etc.) change their configurations relatively slowly, in the time range of tens to hundreds of milliseconds, during the transition from one phoneme to the next. Thus, the formant frequencies of ordinary speech change continuously during transitions and synthetic speech that does not have this property is poor in intelligibility. Many techniques for blending one phoneme into another have been developed, examples of which are disclosed in recent U.S. Pat. Nos. 3,575,555 and 3,588,353. Computer controlled vocoders are able to excel in producing large vocabularies because of the quality of their control of such blending processes.

SUMMARY OF THE INVENTION

The above disadvantages of the prior art are overcome by the present invention of a method and the apparatus for carrying out the method for synthesizing speech or other complex waveforms by time differentiating electrical signals representative of the complex speech waveforms, time quantizing the amplitude of the electrical signals into digital form, and selectively compressing the time quantized signals by one or more predetermined techniques using a human operator and a digital computer which discard portions of the time quantized signals while generating instruction signals as to which of the techniques have been employed, storing both the compressed, time quantized signals and the compression instruction signals in the memory of a solid state speech synthesizer and selectively retrieving both the stored, compressed, time quantized signals and the compression instruction signals in the speech synthesizer circuit to reconstruct selected portions of the original complex wveform.

In the preferred embodiments the compression techniques used by a computer operator in generating the compressed speech information and instruction signals to be loaded into the memories of the speech synthesizer circuit from the computer memory take several forms which will be discussed in greater detail hereinafter. Briefly summarized, these compression techniques are as follows. The technique termed "X period zeroing" comprises the steps of deleting preselected relatively low power fractional portions of the input information signals and generating instruction signals specifying those portions of the signals so deleted which are to be later replaced during synthesis by a constant amplitude signal of predetermined value, the term "X" corresponding to a fractional portion (e.g., ½) of the signal thus compressed. The term "phase adjusting"—also designated "Mozer phase adjusting"—comprises the steps of Fourier transforming a periodic time signal to derive frequency components whose phases are adjusted such that the resulting inverse Fourier transform is a time-symmetric pitch period waveform whereby one-half of the original pitch period waveform is made redundant.

The technique termed "phoneme blending" comprises the step of storing portions of input signals corresponding to selected phonemes and phoneme groups according to their ability to blend naturally with any other phoneme. The technique termed "pitch period repetition" comprises the steps of selecting signals representative of certain phonemes and phoneme groups from information input signals and storing only portions of these selected signals corresponding to every nth pitch period of the wave form while storing instruction signals specifying which phonemes and phoneme groups have been so selected and the value of n. The technique termed "multiple use of syllables" comprises the step of separating signals representative of spoken words into two or more parts, with such parts of later words that are identical to parts of earlier words being deleted from storage in a memory while instruction signals specifying which parts are deleted are also stored. The technique termed "floating zero, two-bit delta modulation" comprises the steps of delta modulating digital signals corresponding to information input signals prior to storage in a first memory by setting the value of the ith digitization of the sampled signal equal to the value of the $(i-1)$th digitization of the sampled signals plus $f(\Delta_{i-1}, \Delta_i)$ where $f(\Delta_{i-1}, \Delta_i)$ is an arbitrary function having the property that changes of wave form of less than two levels from one digitization to the next are reproduced exactly while greater changes in either direction are accomodated by slewing in either direction by three levels per digitization. Preferably, the phase adjusting technique includes the step of selecting the representative symmetric wave form which has a minimum amount of power in one-half of the period being analyzed and which possesses the property that the difference between amplitudes of successive digitizations during the other half period of the selected wave form are consistent with possible values obtainable from the delta modulation step.

The techniques, in addition to taking the time derivative and time quantizing the signal information, involve discarding portions of the complex waveform within each period of the waveform, e.g. a portion of the pitch period where the waveform represents speech and multiple repetitions of selected waveform periods while discarding other periods. In the case of speech waveforms, the presence of certain phonemes are detected and/or generated and are multiply repeated as are syllables formed of certain phonemes. Furthermore, certain of the speech information is selectively delta modulated according to an arbitrary function, to be described, which allows a compression factor of approximately two while preserving a large amount of speech intelligibility.

As mentioned above, the speech information used by the synthesizer circuit is subjectively generated by an operator using a digital computer. Digital encoding of speech information into digital bits stored in a computer memory is of course, well known. See for example, the Martin U.S. Pat. No. 3,588,353, the Ichikawa U.S. Pat. No. 3,892,919. Similarly, the removal of redundant speech information in a computer memory is also state-of-the-art, see for example, the Martin U.S. Pat. No. 3,588,353. It is of particular choice of which part of the speech information which is to be removed which the applicant claims as novel. The method for carrying this out within the computer is not part of the applicant's invention and is not being claimed. It is the concept of removing certain portions of speech which have not, heretofore, been done which the applicant claims as his invention.

As an example, consider the computer techniques that are involved in discarding two periods of every three that are present in the original speech waveform as the phoneme of interest is being compressed by three period repetition. Suppose that the binary information of the original waveform is stored in region A of the computer memory. The first period of the speech waveform is removed from region A and placed in another region of the computer memory, which will be called region B. The fourth region of the waveform is next removed from region A and placed in region B contiguous to the first period. Similarly, the seventh, tenth, etc. periods are removed from region A and located in region B, such that region B eventually contains every third period of the speech waveform and therefore contains one-third of the information that is stored in region A. From this point forward, region B contains the compressed information of interest and the data in region A may be neglected.

Region A of the computer memory may be used for storing new data by simply writing that data on top of the original speech waveform, since computer memories have the property of allowing new data to be written directly over previous data without zeroing, initializing, or otherwise treating the memory before writing the new data. For this reason, region B of the above description does not have to be a different physical region of the computer memory from region A. Thus, the fourth period of the waveform could be written over the second period, the seventh over the third, the tenth over the fourth, etc. until the first, fourth, seventh, tenth, . . . periods of the waveform occupy the region formerly occupied by the first, second, third, fourth, . . . periods of the original waveform. This is the most likely method of discarding unused data because it minimizes the total requirement for memory space in the computer.

In contrast to the goals of earlier speech synthesis research to reproduce an unlimited vocabulary, the present invention has resulted from the desire to develop a speech synthesizer having a limited vocabulary on the order of one hundred words but with a physical size of less than about 0.25 inches square. This extremely small physical size is achieved by utilizing only digital techniques in the synthesis and by building the resulting circuit on a single LSI (large scale integration) electronic chip of a type that is well known in the fabrication of electronic calculators or digital watches. These goals have precluded the use of vocoder technology and resulted in the development of a synthesizer from wholly new concepts. By uniquely combining the above mentioned, newly developed compression techniques with known compression techniques, the method of the present invention is able to compress information sufficient for such multi-word vocabulary onto a single LSI chip without significantly compromising the intelligibility of the original information.

The uses for compact synthesizers produced in accordance with the invention are legion. For instance, such a device can serve in an electronic calculator as a means for providing audible results to the operator without requiring that he shift his eyes from his work. Or it can be used to provide numbers in other situations where it is difficult to read a meter. For example, upon demand it could tell a driver the speed of his car, it could tell an electronic technician the voltage at some point in his circuit, it could tell a precision machine operator the information he needs to continue his work, etc. It can also be used in place of a visual readout for an electronic timepiece. Or it could be used to give verbal messages under certain conditions. For example, it could tell an automobile driver that his emergency brake is on, or that his seatbelt should be fastened, etc. Or it could be used for communication between a computer and man, or as an interface between the operator and any mechanism, such as a pushbutton telephone, elevator, dishwasher, etc. Or it could be used in novelty devices or in toys such as talking dolls.

The above, of course, are just a few examples of the demand for compact units. The prior art has not been able to fill this demand, because presently available, unlimited vocabulary speech synthesizers are too large, complex and costly. The invention, hereinafter to be described in greater detail, provides a method and apparatus for relatively simple and inexpensive speech synthesis which, in the preferred embodiment, uses basically digital techniques.

It is therefore an object of the present invention to provide a method for synthesizing speech from which a compact speech synthesizer can be fabricated.

It is another object of the present invention to provide a method for synthesizing speech using only one or a few LSI or equivalent electronic chips each having linear dimensions of approximately ¼ inch on a side.

It is still another object of the invention to provide a method for synthesizing speech using basically digital rather than analog techniques.

It is a further object of the present invention to provide a method for synthesizing speech in which the information content of the phoneme waveform is compressed by storing only selected portions of that waveform.

It is still a further object of the present invention to provide a method for synthesizing speech in which syllables can be accented and other pitch period variations of the speech sound, such as inflections, can be generated.

It is yet another object of the present invention to provide a method for synthesizing speech in which amplitude changes at the beginning and end of each word and silent intervals within and between words can be simulated.

Yet a further object of the present invention is to provide a method for synthesizing speech which allows a speech synthesizer to be manufactured at low cost.

The foregoing and other objectives, features and advantages of the invention will be more readily understood upon consideration of the following detailed description of certain preferred embodiments of the invention, taken in conjunction with the accompanying drawings.

FIGS. *7a–7c* represent, respectively, digitized periods of speech before phase adjusting, after phase adjusting, and after half period zeroing and delta-modulation, while FIG. *7d* is a composite curve resulting from the superimposition of the curves of FIGS. *7b* and *7c;*

Figure 9:
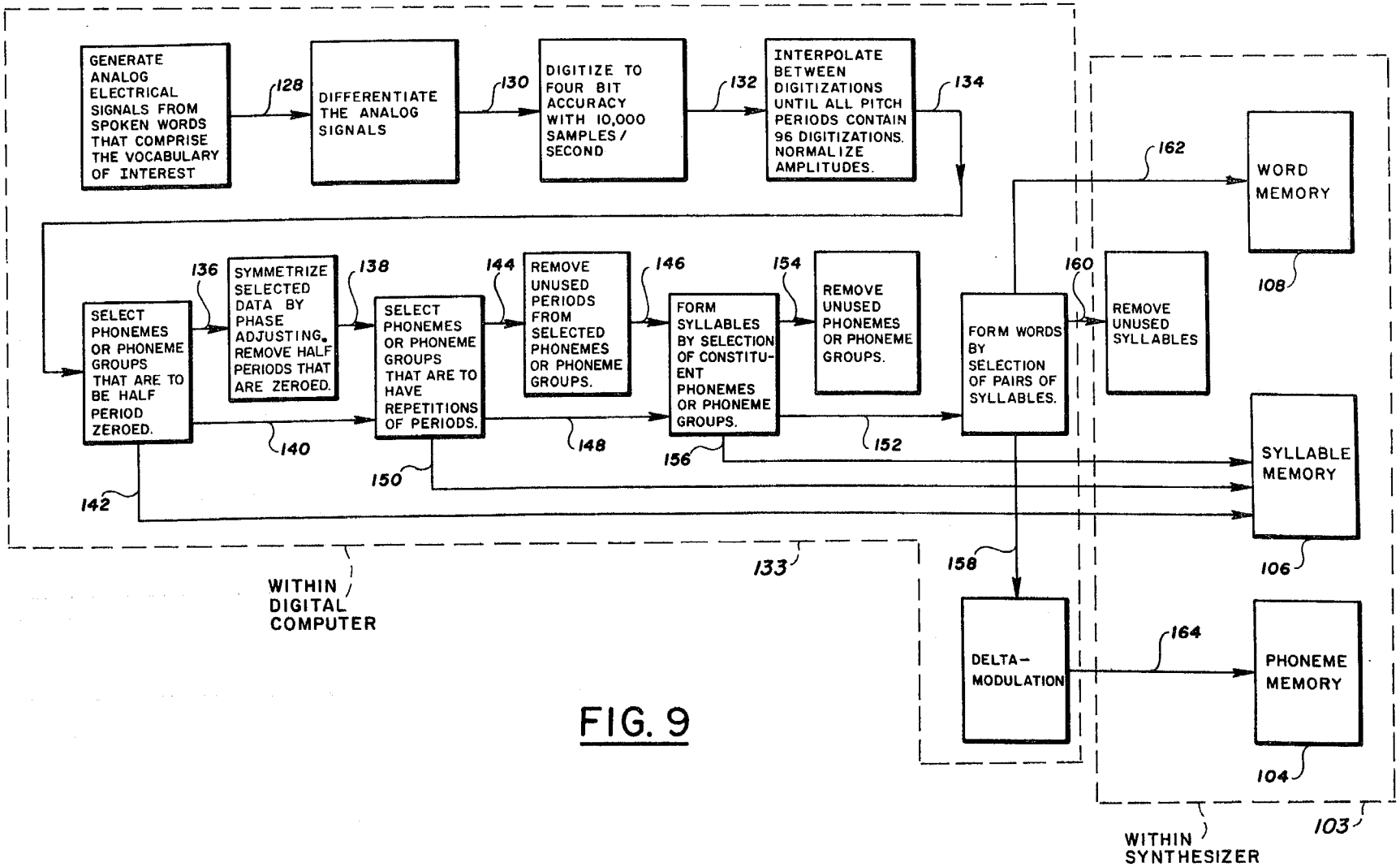
Figure 10:
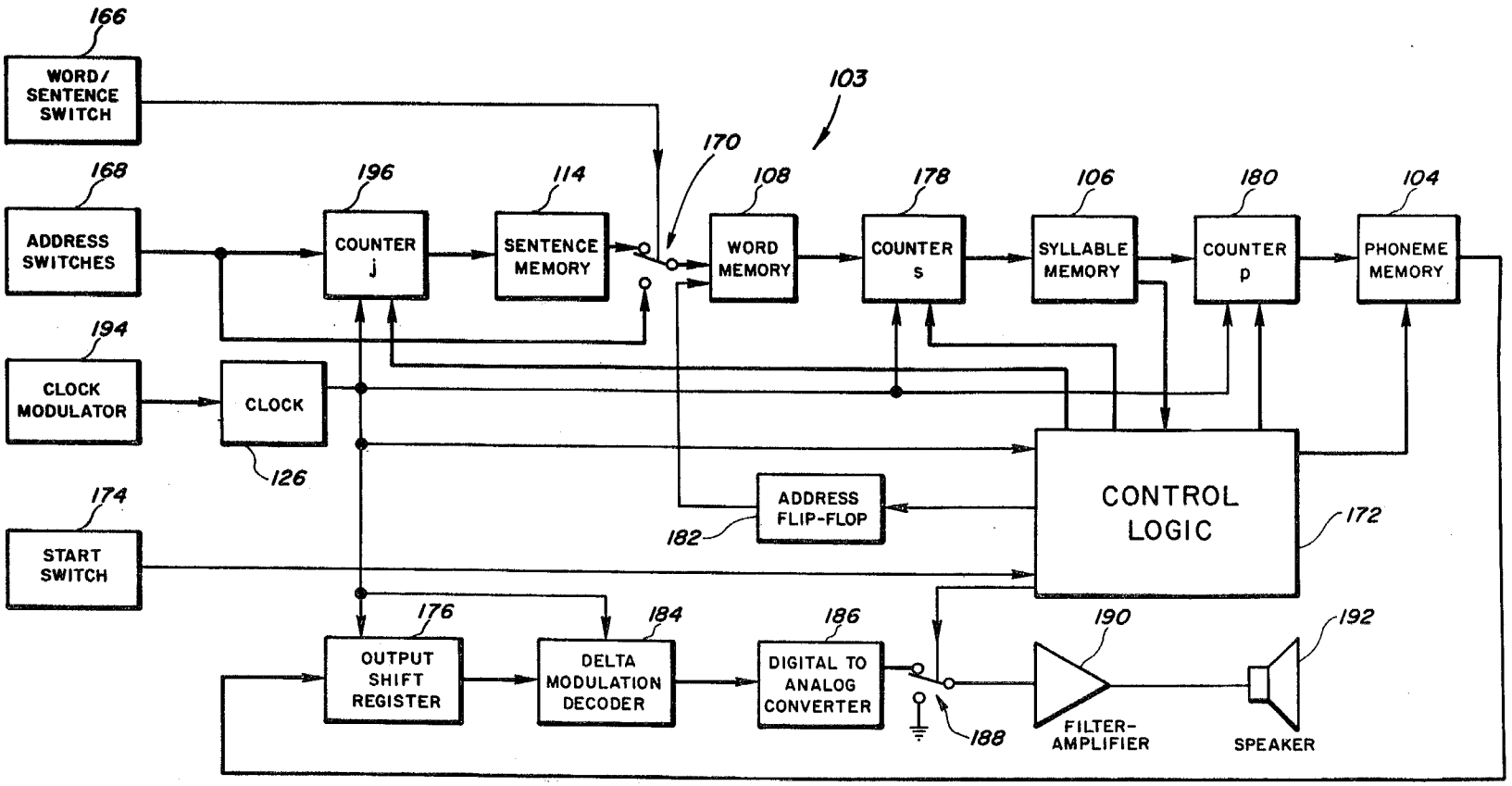
Figure 11A:
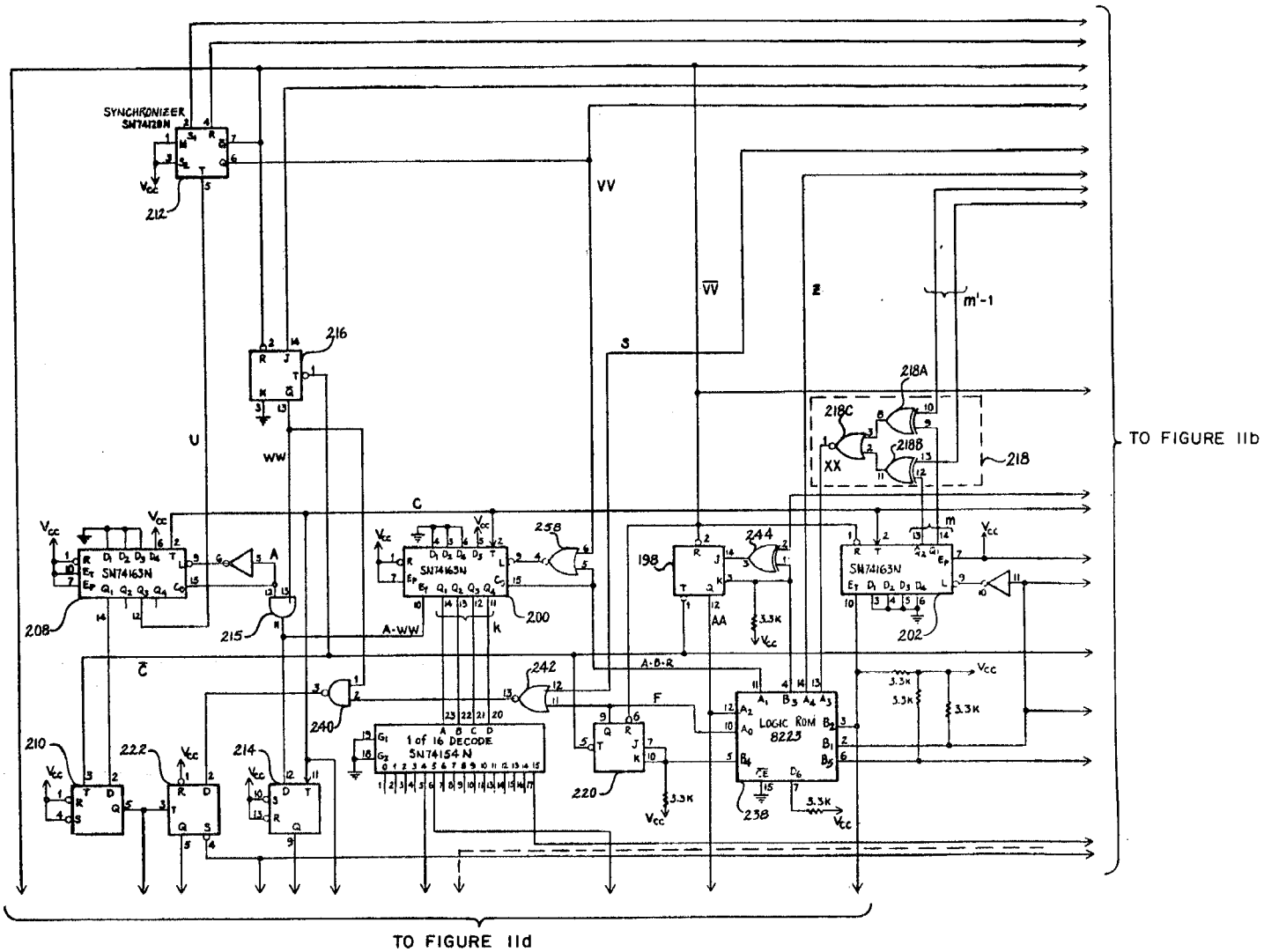
Figure 12:
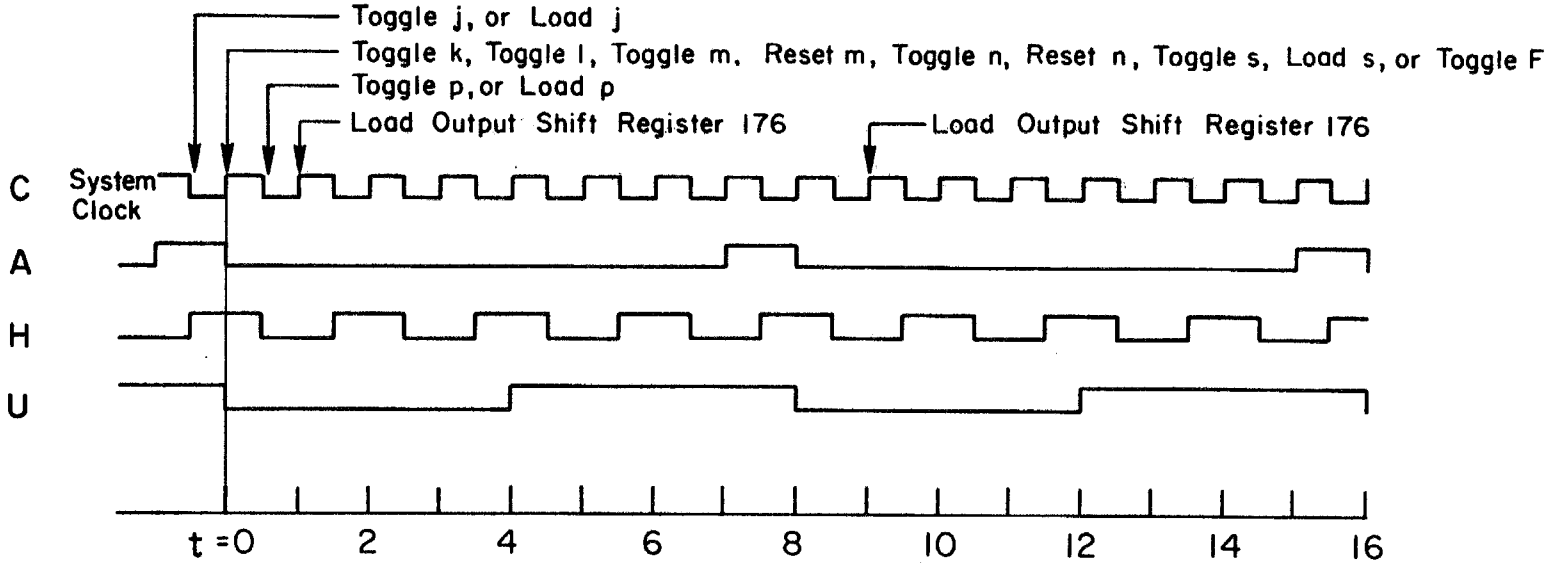
Figure 13:
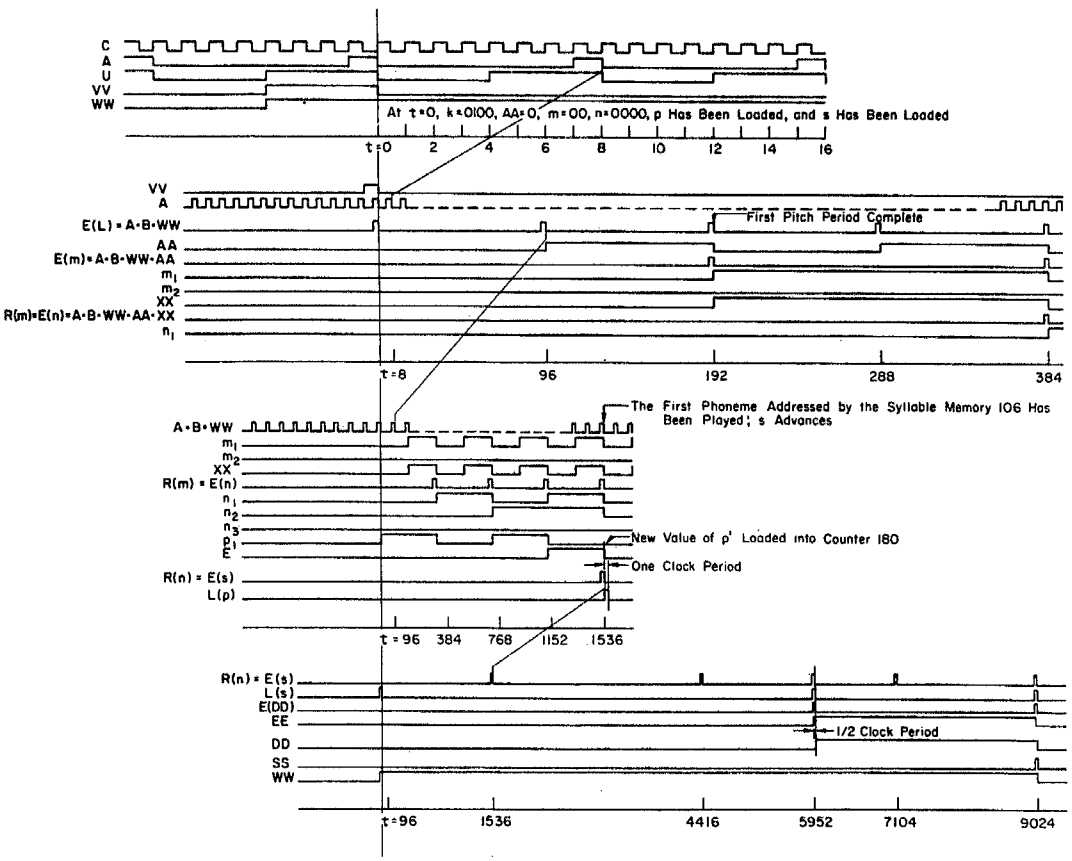
Figure 14:
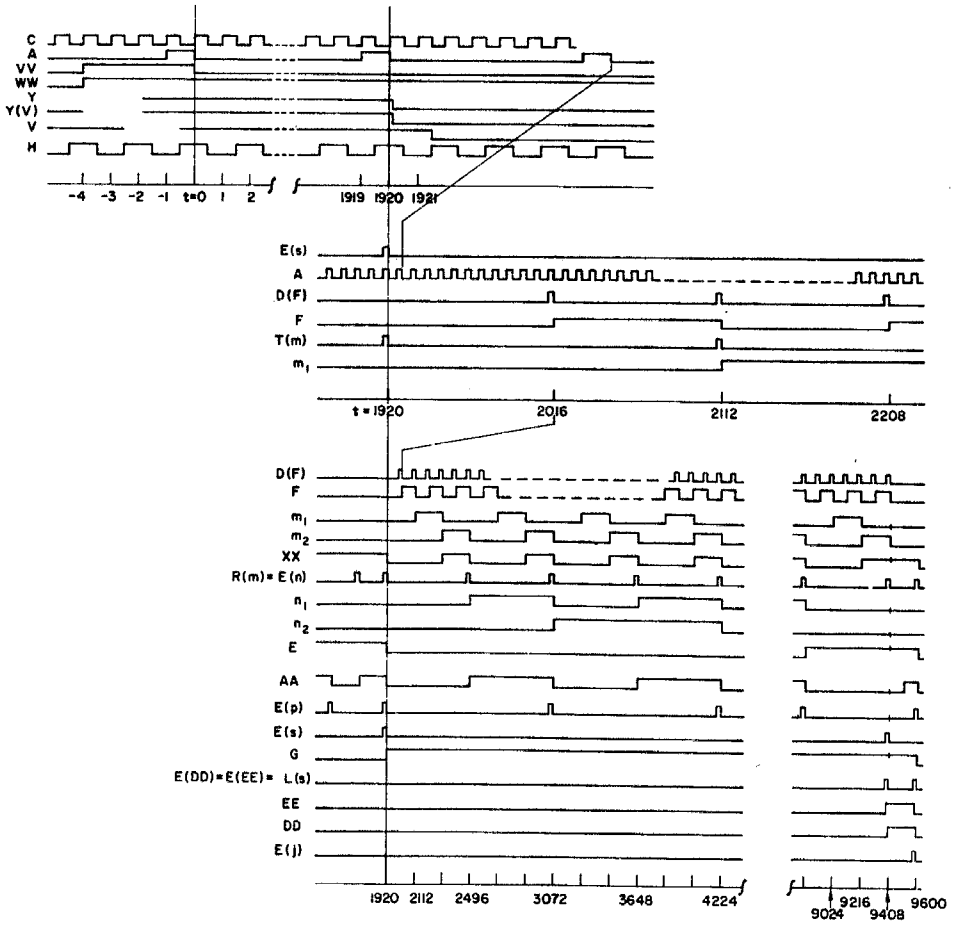
Figure 15:
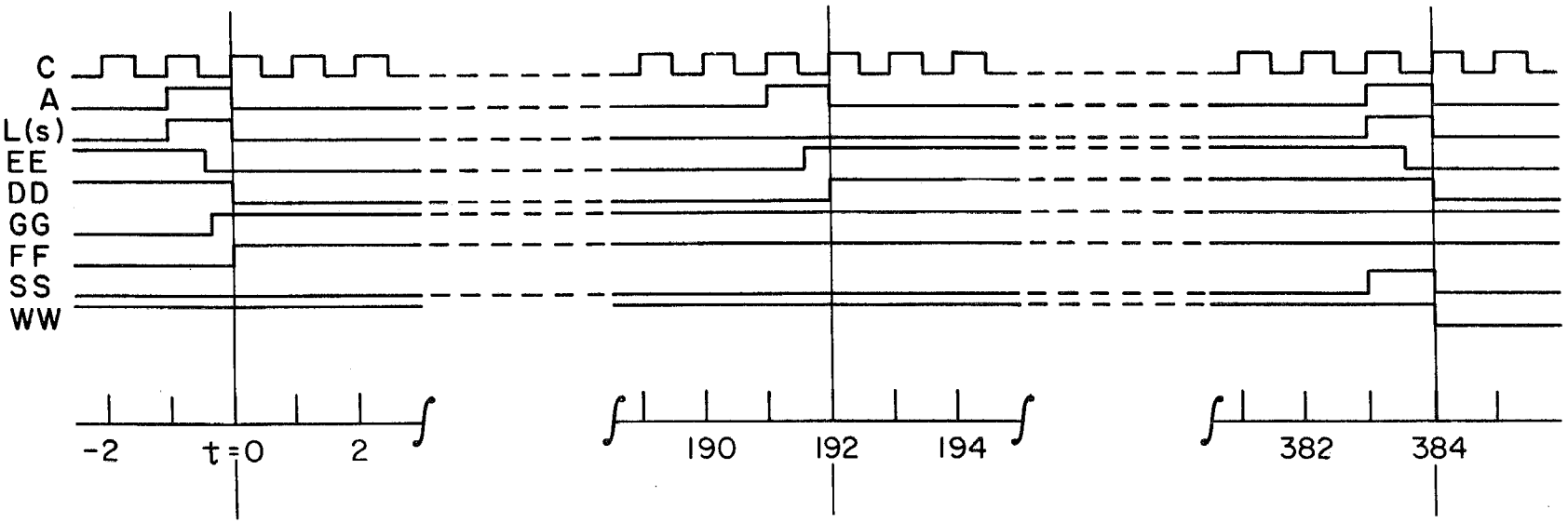
Figure 16:
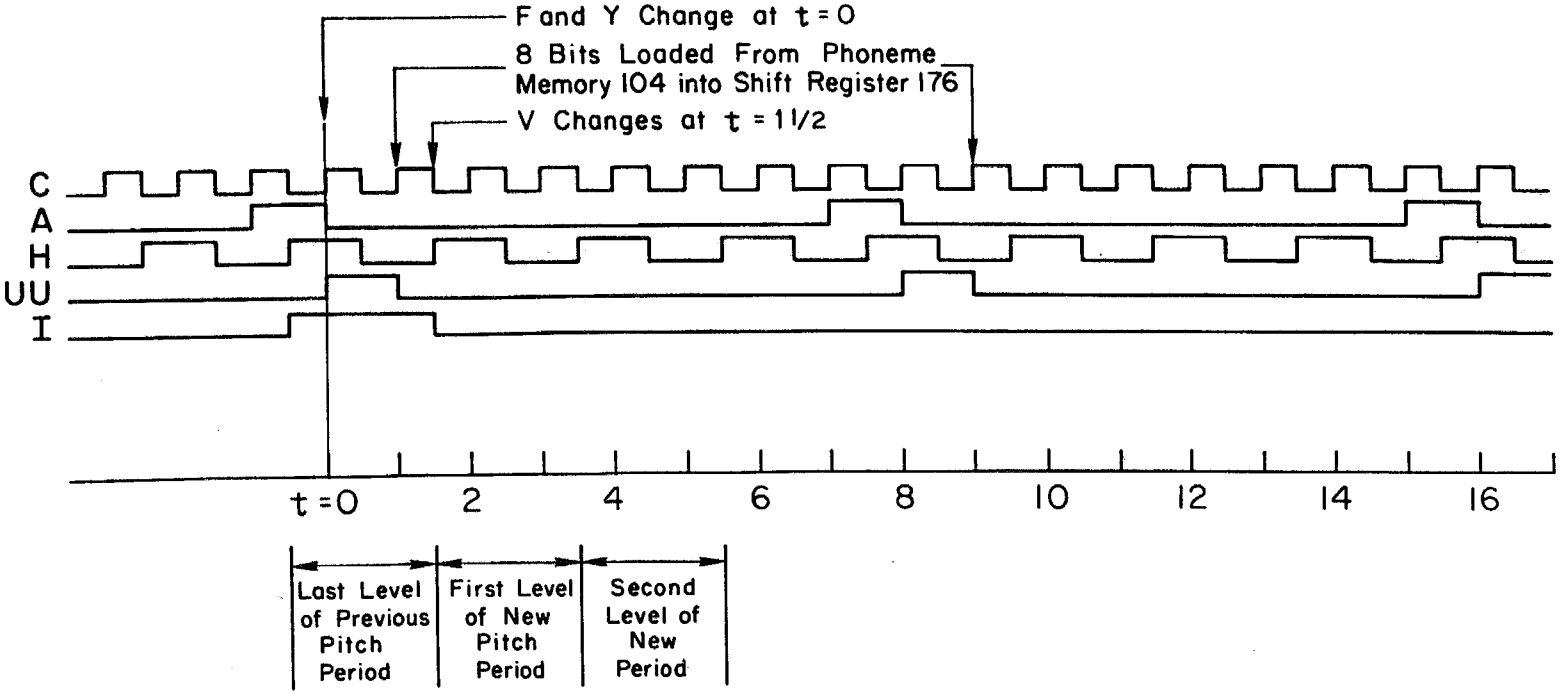

FIGS. *8a–8f* are graphs of a series of symmetrized cosine waves of increasing frequency and positive and negative unit amplitudes;

FIG. 9 is a block diagram illustrating the methods of analysis for generating the information in the phoneme, syllable, an word memories of the speech synthesizer according to the invention;

FIG. 10 is a block diagram of the synthesizer electronics of the preferred embodiment of the invention;

FIGS. 11*a–*11*f* are schematic circuit diagrams of the electronics depicted in block form in FIG. 10;

FIG. 12 is a logic timing diagram which illustrates the four clock waveforms used in the synthesizer electronics, along with the times at which various counters and flip-flops are allowed to change state;

FIG. 13 is a logic timing diagram which illustrates waveforms produced in the electronics of the synthesizer of the invention when an imaginary word which has no half period zeroing is produced;

FIG. 14 is a logic timing diagram which illustrates the waveforms produced in the synthesizer electronics of the invention when a word which has half-period zeroing is produced;

FIG. 15 is a timing diagram that illustrates the synthesizer stop operation for the case of producing sentences;

FIG. 16 is a logic timing diagram which illustrates the operation of the delta-modulation circuit in the synthesizer electronics.

DETAILED DESCRIPTION OF CERTAIN PREFERRED EMBODIMENTS

Figure 1:
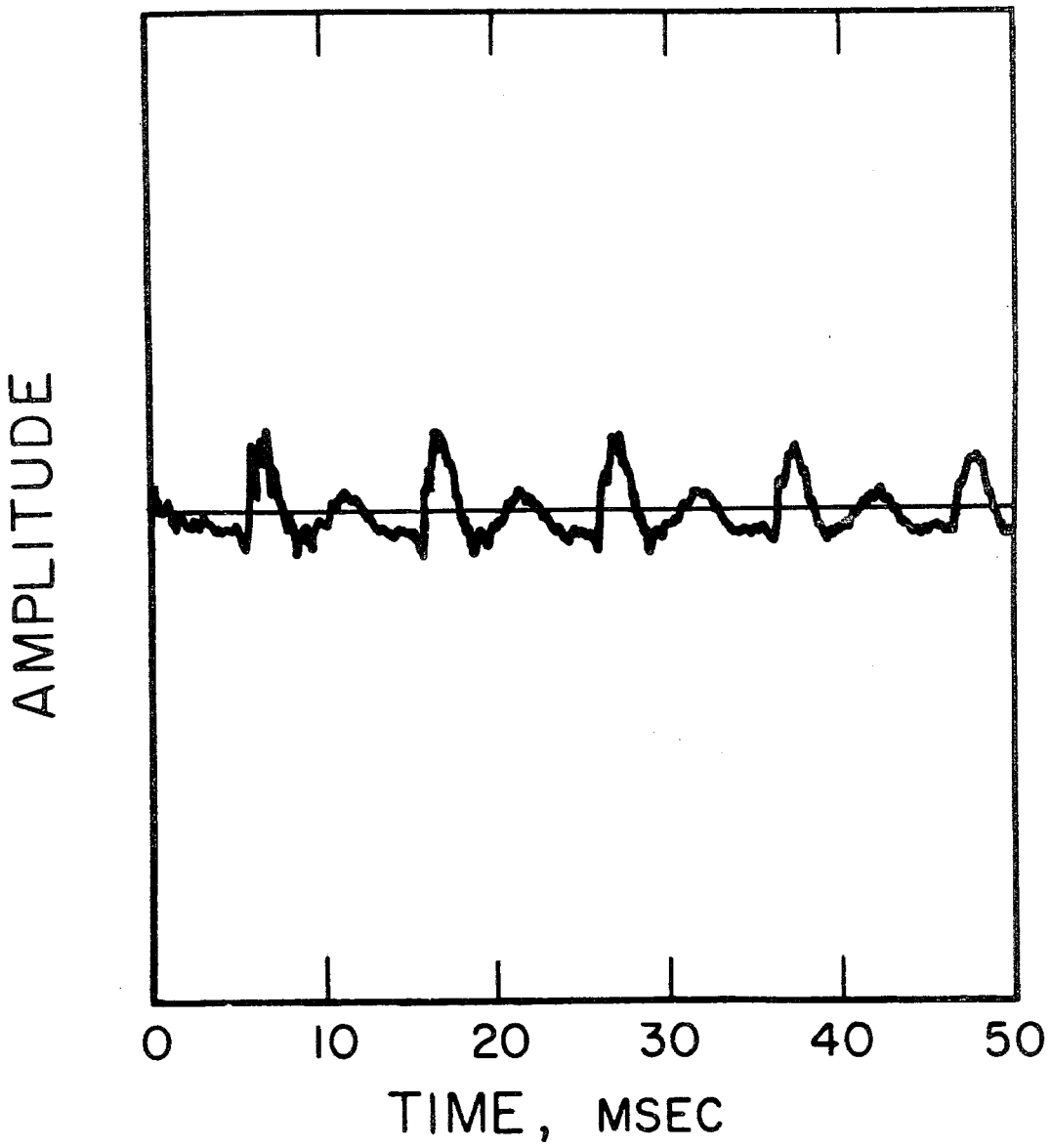
FIG. 1 is a waveform graph of the amplitude of an analog electrical signal representing the phoneme /n/ plotted as a function of time.
Figure 2:
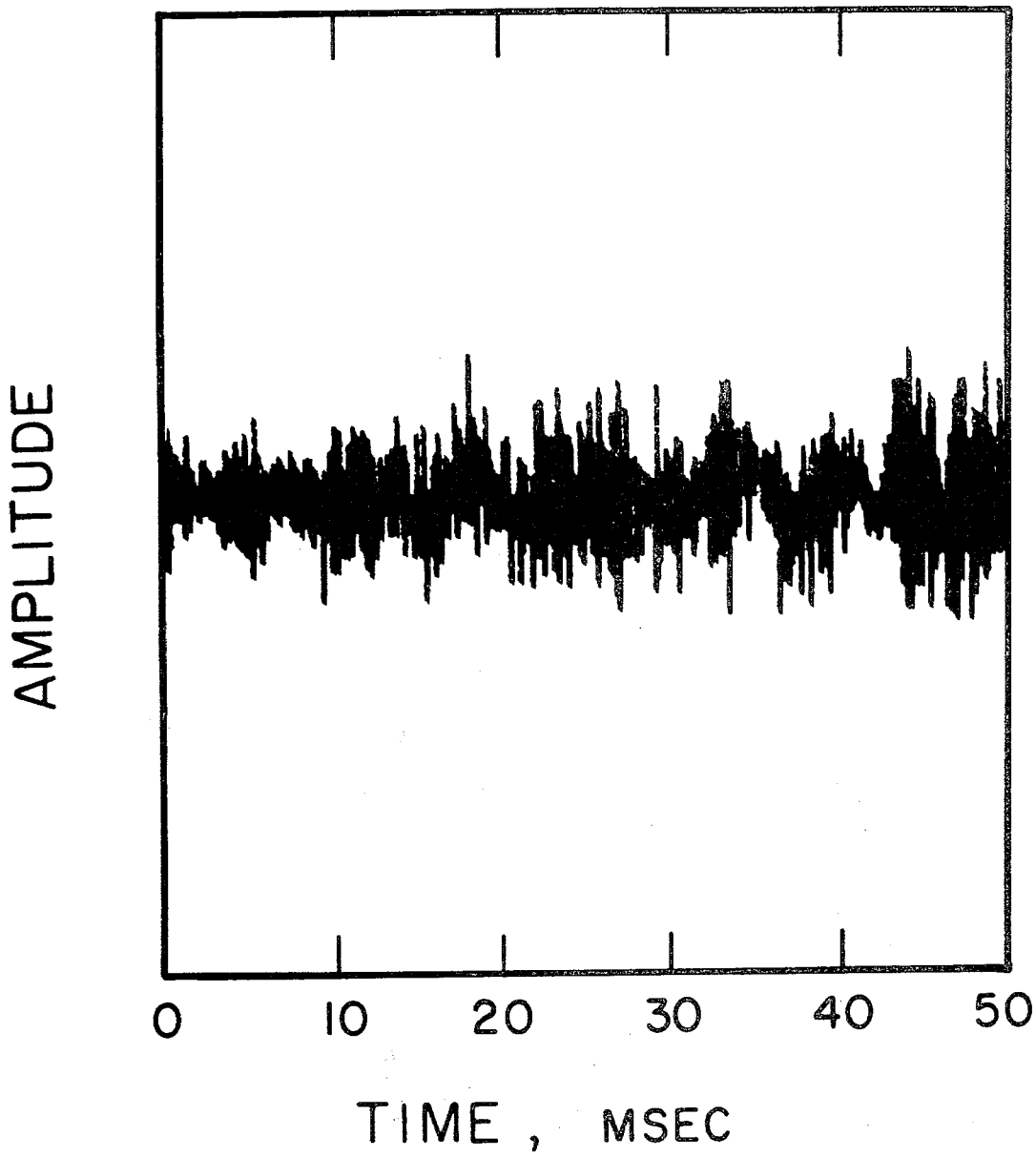
FIG. 2 is a waveform graph of the amplitude of an analog electrical signal representing the phoneme /s/ plotted as a function of time.

The underlying concepts of the present invention can be understood through considering the design of an electronic tape recorder. Ordinary audio tape recorders store wavetrains such as those of FIGS. 1 and 2 on magnetic tape in an analog format. Such devices are not capable of miniaturization to the extent desired because they require motors, tape drives, magnetic tape, etc. However, the speech might be recorded in an electronic memory rather than on tape and some of the above components could be eliminated. The desired vocabulary could then be produced by selectively playing the contents of the memory into a speaker. Since electronic memories are binary (only a "one" or "zero" can be recorded in a given cell) waveforms such as those of FIGS. 1 and 2 must be reduced to binary digital information by the process called digitization before they can be stored in an electronic memory.

As is well known, storing information in digital form involves encoding that information such that it can be represented as a train of binary bits. To digitize or encode speech, which is a complex waveform having significant information at frequencies to about 8,000 Hertz, the electrical signal representing the speech waveform must be sampled at regular intervals and assigned a predetermined number of bits to represent the waveform's amplitude at each sampling. The process of sampling a time varying waveform is called digitization. It has been shown that the digitization frequency, that is, the rate of sampling, must be twice the highest frequency of interest in order to prevent spurious beat frequencies. It has also been shown that to represent a speech waveform with reasonable accuracy a six-bit digitization of each sampling may be required, thus providing for $2^6$ (or 64) distinct amplitudes.

Figure 4:
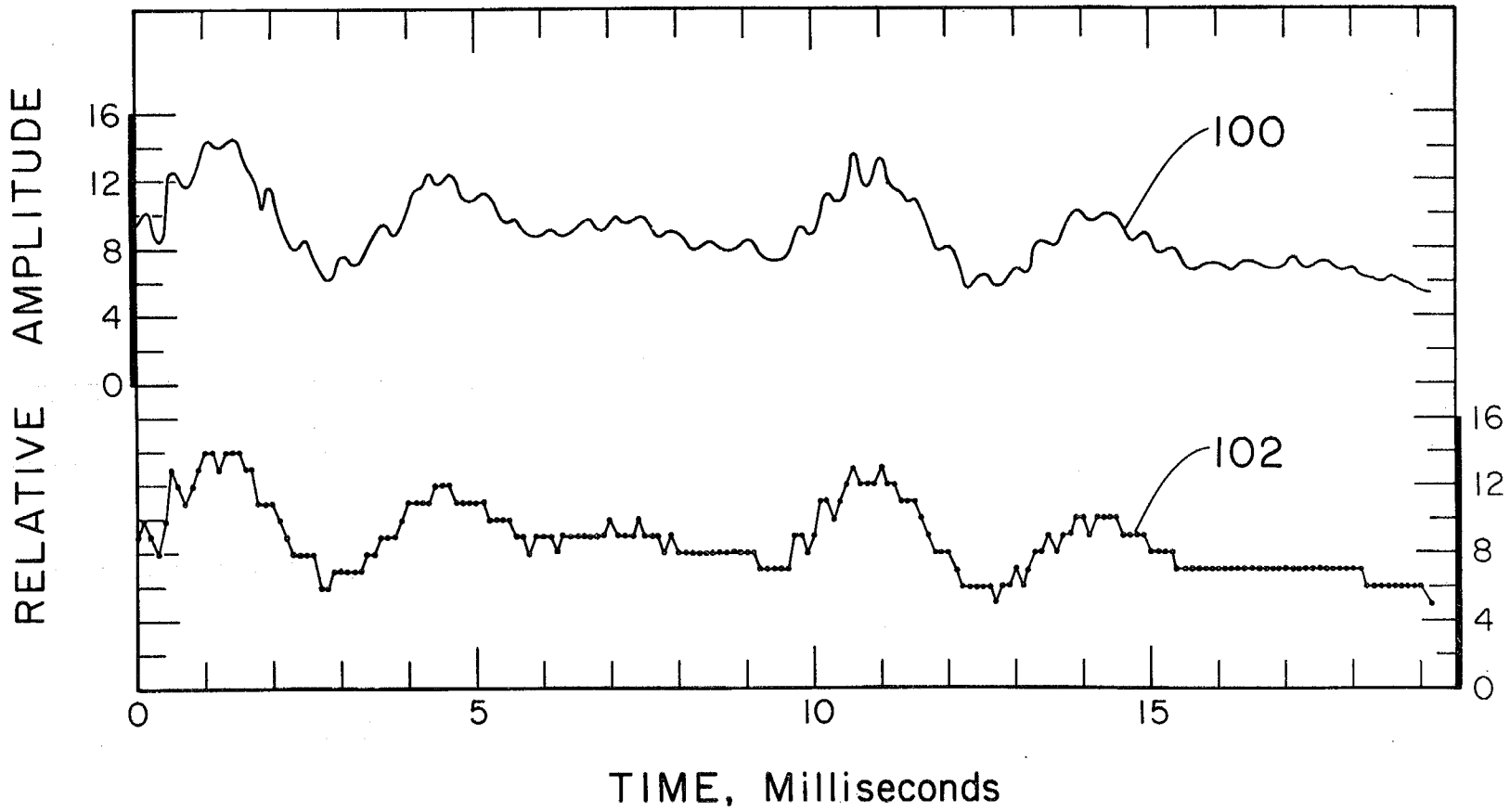
FIG. 4 is a graph which illustrates the process of digitization of speech waveforms by presenting two pitch periods of the phoneme /i/ as in "three" plotted as a function of time before and after digitization.

An example of the digitization of a speech waveform is given in FIG. 4 in which two pitch periods of the phoneme /u/ as in "to" are plotted twice as a function of time. The upper plot 100 is the original waveform and the lower plot 102 is its digitized representation obtained by fixing the amplitude at one of sixteen discreet levels at regular intervals of time. Since sixteen levels are used to represent the amplitude of the waveform, any amplitude can be represented by four binary digits. Since there is one such digitization every $10^{-4}$ seconds, each second of the original wavetrain may be represented by a string of 40,000 binary numbers.

Storage of digitized speech and other complex waveforms in electronic memories is a common procedure used in computers, data transmission systems, etc. As an example, an electronic circuit containing memories in which the numbers from zero through nine are stored may be purchased commercially.

Straight-forward storage of digitized speech waveforms in an electronic memory cannot be used to produce a vocabulary of 128 words on a single LSI chip because the information content in 128 words is far too great, as the following example illustrates. In order to record frequencies as high as 7500 Hertz, the waveform digitization should occur 15,000 times per second. Each digitization should contain at least six bits of amplitude information for reasonable intelligibility. Thus, a typical word of ½ second duration produces 15,000×½×6=45,000 bits of binary information that must be stored in the electronic memory. Since the size of an economical LSI read-only memory (ROM) is less than 45,000 bits, the information content of ordinary speech must be compressed by a factor in excess of 100 in order to store a 128-word vocabulary on a single LSI chip.

In the preferred embodiment of the present invention, a compression factor of about 450 has been realized to allow storage of 128 words in a 16,320 bit memory. This compression factor has been achieved through studies of information compression on a computer, and a speech synthesizer with the one-hundred and twenty-eight word vocabulary given in Table 2 below has been constructed from integrated, logic circuits and memories. In this application this vocabulary should be considered merely a prototype of more detailed speech synthesizers constructed according to the invention:

TABLE 2

Vocabulary of the Speech Synthesizer

The numbers "0"–"99", inclusive;

| | | |
|---|---|---|
| "plus", | "minus", | "times", |
| "over", | "equals", | "point", |
| "overflow", | "volts", | "ohms", |
| "amps", | "dc", | "ac", |
| "and", | "seconds", | "down", |
| "up", | "left", | "pounds", |
| "ounces", | "dollars", | "cents", |
| "centimeters", | "meters", | "miles", |
| "miles per hour", | a short period of silence, and | a long period of silence |

Figure 5:
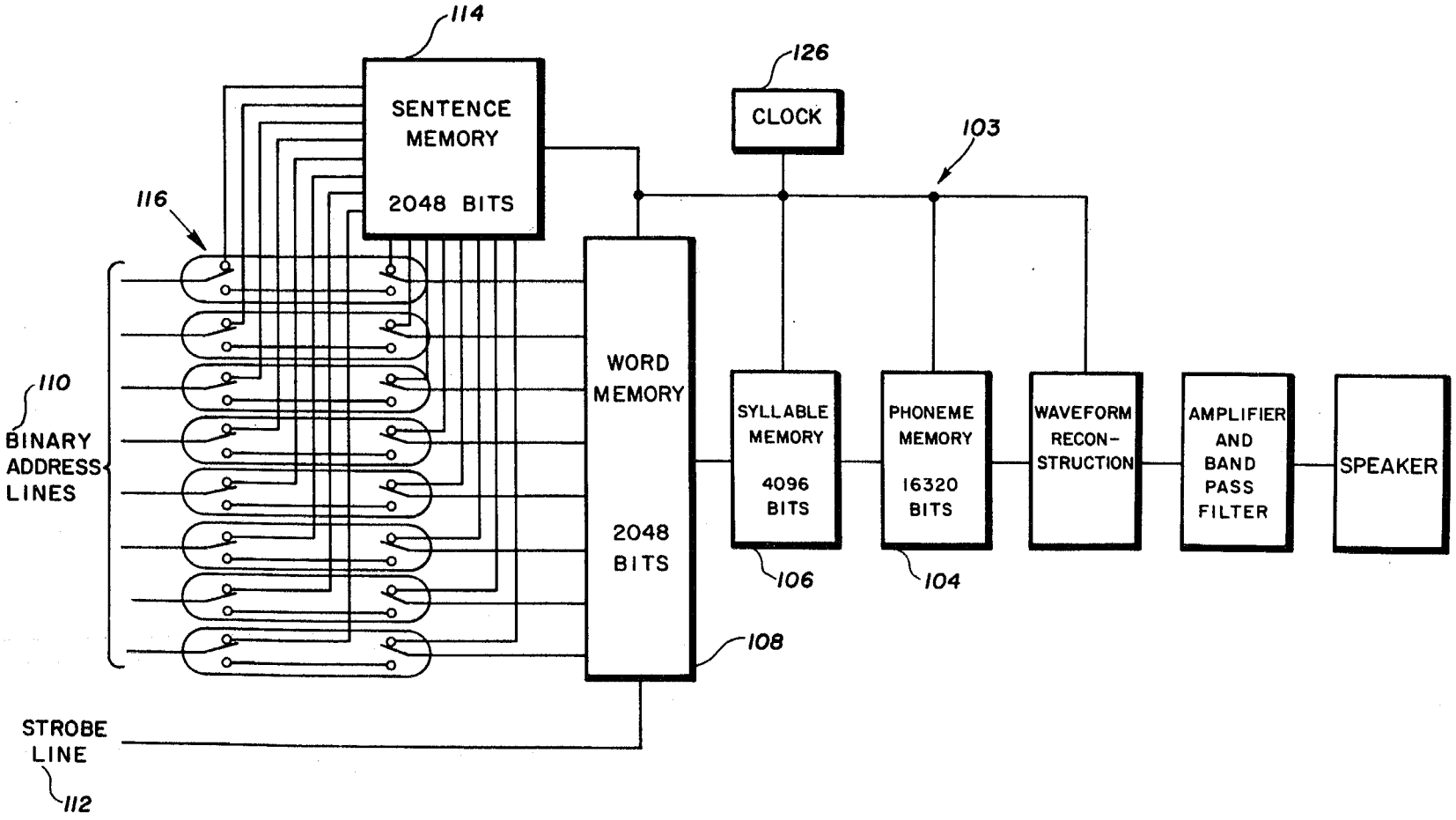
FIG. 5 is a simplified block diagram of a speech synthesizer illustrating the storage and retrieval method of the present invention.

A block diagram of the preferred embodiment of the speech synthesizer 103 according to the invention is given in FIG. 5. It should be understood, however, that the initial programming of the elements of this block diagram by means of a human operator and a digital computer will be discussed in detail in reference to FIG. 9. The synthesizer phoneme memory 104 stores the digital information pertinent to the compressed waveforms and contains 16,320 bits of information. The synthesizer syllable memory 106 contains information signals as to the locations in the phoneme memory 104 of the compressed waveforms of interest to the particular sound being produced and it also provides needed information for the reconstruction of speech from the compressed information in the phoneme memory 104. Its size is 4096 bits. The synthesizer word memory 108, whose size is 2048 bits, contains signals representing the locations in the syllable memory 106 of information signals for the phoneme memory 104 which construct syllables that make up the word of interest.

To recreate the compressed speech information stored in the speech synthesizer a word is selected by impressing a predetermined binary address on the seven address lines 110. This word is then constructed electronically when the strobe line 112 is electrically pulsed by utilizing the information in the word memory 108 to locate the addresses of the syllable information in the syllable memory 106, and in turn, using this information to locate the address of the compressed waveforms in the phoneme memory 104 and to ultimately reconstruct the speech waveform from the compressed data and the reconstruction instructions stored in the syllable memory 106. The digital output from the phoneme memory 104 is passed to a delta-modulation decoder circuit 184 and thence through an amplifier 190 to a speaker 192. The diagram of FIG. 5 is intended only as illustrative of the basic functions of the synthesizer portion of the invention; a more detailed description is given in reference to FIGS. 10 and **11*a*–11*f*** hereinafter.

Groups of words may be combined together to form sentences in the speech synthesizer through addressing a 2048 bit sentence memory 114 from a plurality of external address lines 110 by positioning seven, double-pole double-throw switches 116 electronically into the configuration illustrated in FIG. 5.

The selected contents of the sentence memory 114 then provide addresses of words to the word memory 108. In this way, the synthesizer is capable of counting from 1 to 40 and can also be operated to selectively say such things as:

"3.5+7−6=4.5," "1942 over 0.0001=overflow," "2×4=8," "4.2 volts dc," "93 ohms," "17 amps ac," "11:37 and 40 seconds, 11:37 and 50 seconds," "3 up, 2 left, 4 down," "6 pounds 15 ounces equals 8 dollars and 76 cents," "55 miles per hour," and "2 miles equals 3218 meters, equals 321869 centimeters," for example.

Compression Techniques

As described above, the basic content of the memories 108, 106 and 104 is the end result of certain speech compression techniques subjectively applied by a human operator to digital speech information stored in a computer memory. The theories of these techniques will now be discussed. In actual practice, certain basic speech information necessary to produce the one hundred and twenty-eight word vocabulary is spoken by the human operator into a microphone, in a nearly monotone voice, to produce analog electrical signals representative of the basic speech information. These analog signals are next differentiated with respect to time. This information is then stored in a computer and is selectively retrieved by the human operator as the speech programming of the speech synthesizer circuit takes place by the transfer of the compressed data from the computer to the synthesizer. This process will be explained in greater detail hereinafter in reference to FIG. 9.

Differentiation

Figure 3:
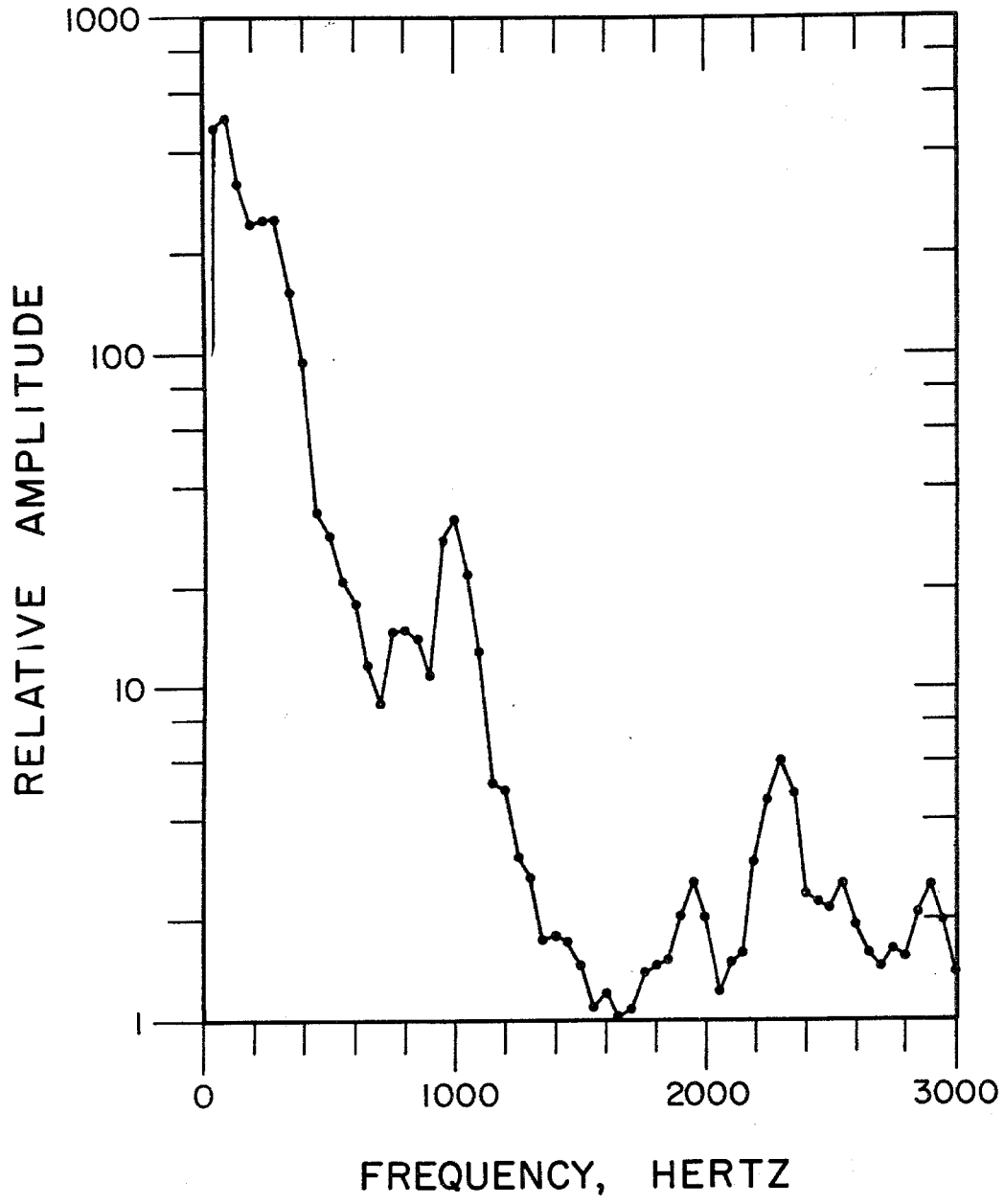
FIG. 3 is the power spectrum of the phoneme /u/ as in "two"

The original spoken waveform is differentiated by passing it through a conventional electronic RC network. The purpose of the differentiation process will now be explained. As illustrated in FIG. 3, the power in a typical speech waveform decreases with increasing frequency. Thus, to retain the needed higher frequency components of the speech waveform (up to say, 5000 Hertz) the amplitude of the waveform must be digitized to a relatively high accuracy by using a relatively large number of bits per digitization. It has been found that digitization of ordinary speech waveforms to a six-bit accuracy produces sound of a quality consistent with that resulting from the other compression techniques.

Figure 6:
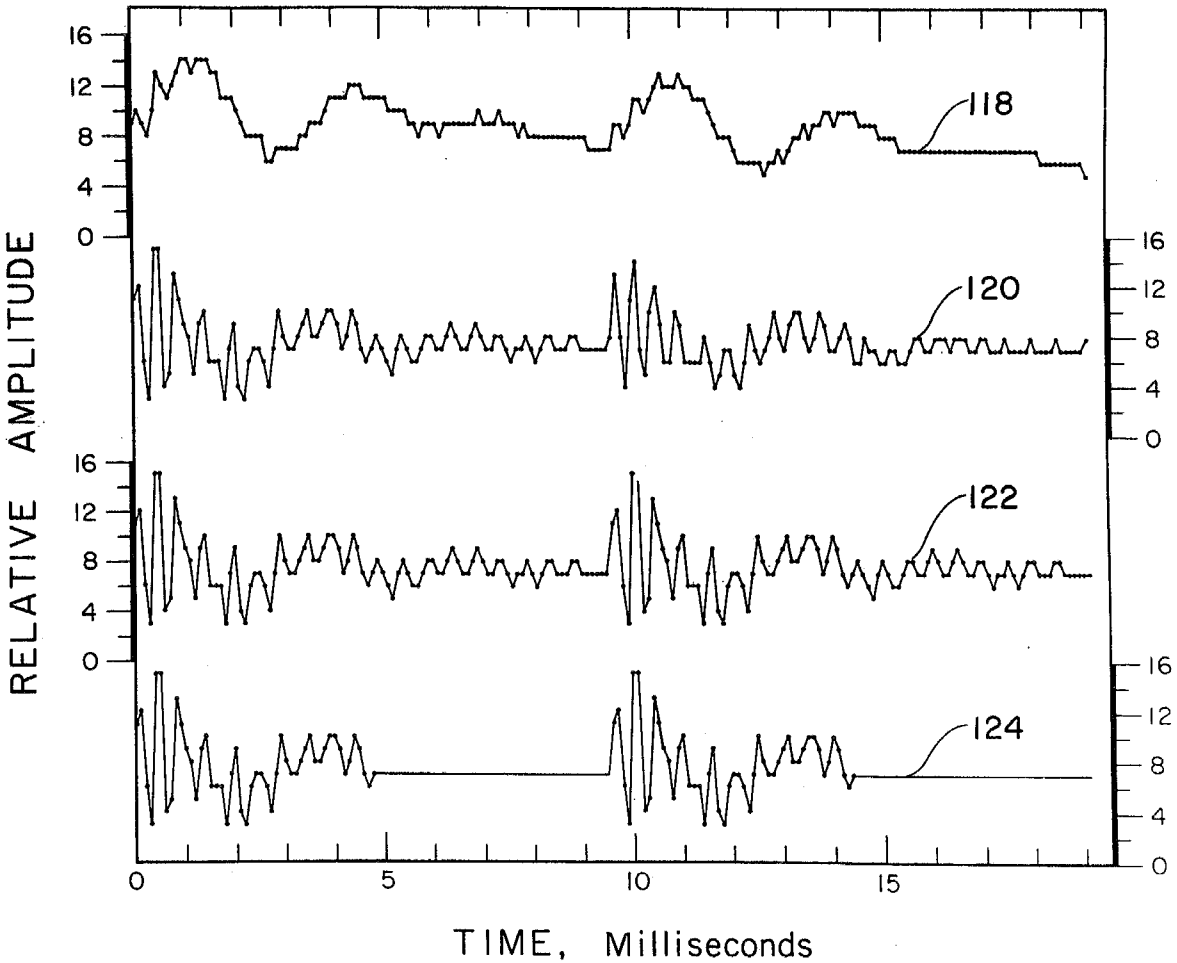
FIG. 6 is an illustrative waveform graph which contains two pitch periods of the phoneme /i/ plotted in order from top to bottom in the figure, as a function of time before differentiation of the waveform, after differentiation of the waveform, after differentiation and replacing the second pitch period by a repetition of the first, and after differentiation, replacing the second pitch period by a repetition of the first, and half-period zeroing.

However, if the sound waveform is differentiated electronically before it is digitized the same high frequency information can be stored by use of fewer bits per digitization. The results of differentiating a speech waveform are shown in FIG. 6, in the upper curve 118 of which two pitch periods, each of about 10 milliseconds duration, of the digitized waveform of the phoneme /u/ as in "to" are plotted as a function of time. In the second curve 120, the digitized representation of the derivative of the waveform 118 is plotted and it can be seen that the process of taking the derivative emphasizes the amplitudes of the higher frequency components. In terms of the power spectrum, such as is illustrated in FIG. 3, the derivative waveform has a flatter power spectrum than does the original waveform. Hence, the higher frequency components can be obtained by use of fewer bits per digitization if the derivative of the waveform rather than the original waveform is digitized. It has been determined that the quality of a six-bit (sixty-four level) digitized speech waveform is similar to that of a four-bit (sixteen level) differentiated waveform. Thus, a compression factor of 1.5 is achieved by storage of the first derivative of the waveform of interest.

Tests have been performed on a computer to determine if derivatives higher than the first produce greater compression for a given level of intelligibility, with a negative result. This is because the power spectrum of ordinary speech decreases roughly as the inverse first power of frequency, so the flattest and, hence, most optimal power spectrum is that of the first derivative.

In principle, the reconstructed waveform from the speech synthesizer should be integrated once before passage into the speaker to compensate for taking the derivative of the initial waveform. This is not done in the speech synthesizer depicted in the block diagram of FIG. 5 because the delta-modulation compression technique described hereinafter effectively performs this integration.

Digitization

As mentioned above, the differentiated waveform must be digitized in order to provide data suitable for storage. This is achieved by sampling the waveform at regular intervals along the waveform'time axis to generate data which expresses amplitude over the time span of the waveform. The data thus generated is then expressed in digital form. This process is performed by use of a conventional commercial analog-to-digital converter.

The digitization frequency reflects the amount of data generated. It is true that the lower the digitization frequency the less information generated for storage, however, there exists a trade off between this goal and the quality and intelligibility of the speech to be synthesized. Specifically, it is known that the digitization frequency must be twice the highest frequency of interest in order to prevent spurious beat frequencies from appearing in the generated data. For best results, the method of the present invention nominally considers a digitization frequency of 10,000 Hertz; however, other frequencies can also be used.

The amount of further information compression required to produce a given vocabulary from a given amount of stored information depends on the vocabulary desired and the storage available. As the size of the required vocabularly increases or the available storage space decreases, the quality and intelligibility of the resultant speech decreases. Thus, the production of a given vocabularly requires compromises and selection among the various compression techniques to achieve the required information compression while maximizing the quality and intelligibility of the sound. This subjective process has been carried out by the applicant on a computer into which the above-described, digitized speech waveforms have been placed. The computer was then utilized to generate the results of various compression techniques and simulate the operation of the speech synthesizer to produce speech whose quality and intelligibility were continuously evaluated while constructing the compressed information within the computer to later be transferred to the read-only memories of the synthesizer.

In this way, certain general rules about degradation of intelligibility for different kinds and amounts of compression have been learned. While these compression guidelines are described below, it must be emphasized that an optimal combination of the compression schemes according to the invention for some other vocabulary or information storage size or to meet the subjective quality criteria of another operator would have to be developed by listening to the results of various levels of compression and making subjective judgments on the quality of the sound and the various approaches to further compression.

Multiple Use of Phonemes or Phoneme Groups in Constructing Words

As discussed earlier, it is not possible to produce intelligible speech by combining the thirty-four phonemes of the General American Dialect in various ways to produce words of interest, because the blending of one phoneme into the next is generally important to the speech intelligibility. However, this is not the case for all phonemes or phoneme groups. For example, tests that applicant has made on the computer have shown that the phoneme /n/ blends into any other phoneme intelligibly with no special precautions required. Thus, a single phoneme /n/ has been stored in the phoneme memory 104 of the speech synthesizer of FIG. 5 and used in the eighty-seven places where this phoneme appears in the vocabulary of Table 2. Similarly, the phoneme /s/ has been found to blend well with any other phoneme, so a single phoneme /s/ in the phoneme memory 104 produces this sound in the eighty-two places where it appears in the vocabulary of Table 2.

As a counter example, the phoneme /r/ and the phoneme /i/ (as in "three") cannot be placed next to each other without some form of blending to produce the last part of the word "three" in an intelligible fashion. This is because /r/ has relatively low frequency formants while /i/ has high frequency formants, so the sound produced during the finite time when the speech production mechanism changes its configuration from that of one phoneme to that of the next is vital to the intelligibility of the word. For this reason the pair of phonemes /r/ and /i/ have been produced from the spoken word "three" and stored in the phoneme memory 104 as a phoneme group that includes the transition between or blending of the former phoneme into the latter.

Other examples of phoneme groups that must be stored together along with their natural blending are the diphthongs, each of which is made from a pair of phonemes. For example, the sound /ai/ in "five" is composed of the two phonemes /a/ (as in "father") and /i/ (as in "three") along with the blending of the one into the other. Thus, this diphthong is stored in the phoneme memory 104 as a phoneme group that was produced from the spoken word "five".

The extent to which phonemes may be connected to each other with or without blending has been found by trial and error using the computer and is illustrated below in Table 3, in which the phonemes or phoneme groups stored in the prototype speech synthesizer are listed along with the words in which they appear:

TABLE 3

| Usage of Phonemes Or Phoneme Groups In Constructing Words | |
|---|---|
| Sound | Places In Which Sound Is Used |
| "ou" from hour | down, hour, dollars, pounds, ounces |
| "one" | 1, 7, 9, 10, 11, 20, teen, plus, minus point, and, seconds, down, cents, pounds, ounces |
| "t" | 2, 8, 10, 12, 20, teen, times, point, volts, seconds, left, cents |
| "oo" from "two" | 2 |
| "th" from "three" | 3, thir |
| "ree" "three" | 3, 20, teen, DC, meters |
| "f" | 4, 5, fif, flow, left |
| "our" from "four" | 4 |
| "ive" from "five" | 5 |
| "s" | 6, 7, plus, minus, times, equals, volts, ohms, amps, C, seconds, miles, meters, dollars, cents, pounds, ounces |
| "i" from "six" | 6, fif, centimeters |
| "k" | 6, equals, seconds |
| "ev" from "seven" | 7, 10, 11, seconds, left, cents |
| "eigh" from "eight" | 8, A |
| "i"from "nine" | 9, minus, times, miles |
| "el"from "eleven" | 11 |
| "we" from "twelve" | 12 |
| "elve" from "twelve" | 12 |
| "ir" from "thirteen" | thir |
| "we" from "twenty" | 20 |
| "p" | plus, point, amps, up, per, pounds |
| "l" from "plus" | plus, equals, flow, left, miles, dollars |
| "m" | minus, times, ohms, amps, miles, meters, ounces |
| "u" from "minus" | minus |
| "im" from "times" | times |
| "ver" from "over" | over, per, meters, dollars |
| "ua" from "equals" | equals |
| "oi" from "point" | point |
| "vol" from "volts" | volts |
| "o" from "ohms" | ohms, o, over, flow |
| "a" from "and" | amps, and |
| "d" | D, and, down, meters, dollars, pounds |
| "u" from "up" | up |
| "il" from "miles" | miles |
| "ou" from "pounds" | pounds |

Since the thirty-five phonemes or phoneme groups of this table are used in about 140 different places in the prototype vocabulary, a compression factor of about 4 is achieved by multiple use of phonemes or phoneme groups in constructing words.

The durations of a given phoneme in different words may be quite different. For example, the "oo" in "two" normally lasts significantly longer than the same sound in "to". To allow for such differences, the duration of a phoneme or phoneme group in a given word is controlled by information contained in the syllable memory 106 of FIG. 5, as will be further described in a later section.

In summary, and depending on the amount of compression required, it has been found from computer simulation that voiced and unvoiced fricatives, voiced and unvoiced stop consonants, and nasal consonants, may be stored as phonemes with minimal degradation of the intelligibility of the generated speech.

Multiple Use of Syllables

The vocabulary of the speech synthesizer of the invention is redundant in the sense that many syllables or words appear in several places. For example, the word "over" appears both in "over" and in "overflow." The syllable "teen" appears in all the numbers from 13 through 19.

To take advantage of such duplications, all words of the prototype vocabulary are defined as containing two syllables, where the term "syllable" in the present context is different from that of ordinary usage. The word "overflow" is made from the two syllables "over" and "flow" while the word "over" is made from the syllables "over" and a period of silence. Similarly the word "thirteen" is made from the syllables "thir" and "teen." In this way, the syllables 0, 1, 2, 3, 4, 5, 6, 7, 8, 9, 10, 11, 12, thir, teen, fif, ai, 20, 30, 40, 50, 60, 70, 80 and 90 may be combined in pairs to produce all the numbers from 0 to 99.

There are fifty-four syllables and one hundred and twenty-eight words in the prototype speech synthesizer. Thus, the average syllable is used 2.4 times and a compression factor of about 2.4 results from the multiple use of syllables. To implement the above described multiple use of syllables, the word memory 108 in the block diagram of FIG. 5 contains two entries for each word which give the locations in the syllable memory 106 of the two syllables that make up that word.

Repetition of Pitch Periods of Sound

The method of the present invention calls for still another compression technique wherein only portions of the data generated using any one, or all, of the described compression techniques are stored. Each such portion of data is selected over a so-called repetition period with the sum of the repetition periods having a duration which is less than the duration of the original waveform. The original duration can eventually be achieved by reusing the information stored in place of the information not stored.

Using this technique, a compression factor of n can be obtained by setting the repetition period equal to the pitch period of the voiced speech to be synthesized, storing every nth pitch period of the waveform, and playing back each stored portion of data n times before going on to the next portion so as to create a signal of the same duration as the original phoneme. This technique has been employed by repeating pitch periods in the computer memory through the use of conventional techniques for writing a new segment of data in place of a previous segment, and by listening to the quality of the speech thereby produced. In this way, n-period repetition of speech waveforms has been found to work without significant degradation of the sound for n less than or equal to 3, and has been shown to produce satisfactory sound for n as large as 10, though it is not intended that the method exclude n larger than 10. Typically n would equal the largest integer possible which would produce an acceptable quality of sound. The fact that period repetition does not significantly degrade the intelligibility of speech was first reported by A. E. Rosenburg (J. Acoust. Soc. Am., 44, 1592, 1968).

An example of the application of this compression technique is given in FIG. 6 in which is plotted the waveform 122 that results from replacing the second pitch period of the waveform 120 by a repetition of its first pitch period. In this example n=2 and a compression factor of two is achieved. In these examples, the repetition period, though nominally defined as equal to the voiced pitch period, need not equal the voiced pitch period. Experiments have shown that the quality and intelligibility of the synthesized speech is nearly independent of the ratio of repetition to pitch period for ratio values not much greater nor much less than one.

The technique of repeating pitch periods of the voiced phonemes introduces spurious signals at the pitch frequency. These signals are generally inaudible because they are masked by the larger amplitude signal at that frequency resulting from the voiced excitation. Since unvoiced phonemes such as fricatives do not possess large amplitudes at the high frequency because they are unvoiced, repetition of segments of their wavetrains having periods the order of the pitch period produces audible distortions near the pitch frequency. However, if the repeated segments have lengths equal to several pitch periods, the audible disturbances will appear at a fraction of the pitch frequency and may be filtered out of the resulting waveform. In the prototype speech synthesizer, the unvoiced fricatives /s/, /f/, and /th/ have been stored with durations of seven pitch periods of the male voice that produced the waveforms. Thus, repetitions of these full wavetrains, to produce phonemes of longer duration, results in a disturbance signal at one-seventh of the pitch frequency, which is barely audible and which may be removed by filtering.

To summarize, the technique of repetition of pitch periods of sound has been used in the speech synthesizer of the invention with a compression factor, n, generally equal to 2 for glides and diphthongs. For other voiced phonemes, n has generally been chosen as 3 or 4. For unvoiced fricatives, segments of length equal to seven pitch periods have been repeated as often as needed but generally twice to produce sounds of the appropriate duration. On the average, a compression factor of about three has been gained by application of these principles.

In the above discussion it has tacitly been assumed that the pitch period of the human voice is a constant. In reality is varies by a few percent from one period to the next and by ten or twenty percent with inflections, stress, etc. To simplify the digital circuitry that produces repeated pitch periods of sound and to perform other compression techniques, it is vital that the pitch period of the stored voiced phonemes be exactly constant. Equivalently, it is required that the number of digitizations in each pitch period of each phoneme be constant. In the speech synthesizer of the invention this number is equal to ninety-six and each pitch period has been made to have this constant length by interpolation between digitizations in the input spoken waveforms using the computer until there were exactly ninety-six digitizations in each pitch period of the sound. Since its clock frequency is 10,000 Hertz, the pitch period of the voice produced by this synthesizer is 9.6 milliseconds.

Information on the number of repetitions of the pitch period of any phoneme in any word is retained as two bits of data in the syllable memory 106 of the synthesizer. Thus, there may be one to four repetitions of each period of sound and, for a given phoneme, this number may vary from one application to the next.

X-Period Zeroing

Another new technique for decreasing the information content in a speech waveform without degrading its intelligibility or quality is referred to herein as "x-period zeroing". To understand this technique, reference must be made to a speech waveform such as 122 in FIG. 6. It is seen that most of the amplitude or energy in the waveform is contained in the first part of each pitch period. Since this observation is typical of most phonemes, it is possible to delete the last portion of the waveform within each pitch period without noticeably degrading the intelligibility or quality of voiced phonemes.

An example of this technique is illustrated as the lowermost waveform of FIG. 6 in which the small amplitude half 124 of each pitch period of the waveform 122 has been set equal to zero. This is easily done in the computer because of the fact that the pitch periods of all of the different phonemes were previously made uniform, see preceeding page 30. This $\frac{1}{2}$ period zeroed waveform 124 sounds indistinguishable from that of 122 even though its information content is smaller by a factor of two. Experiments have been performed in a computer in which fractions from one-fourth to three-fourths of the waveform within each pitch period of the voiced phonemes were replaced by a constant amplitude signal by use of conventional techniques for manipulating data in the computer memory. These experiments, called "x-period zeroing" with x between $\frac{1}{4}$ and $\frac{3}{4}$, produced words that were indistinguishable from the original for x less than about 0.6. For $x=\frac{3}{4}$, the words were mushy sounding although highly intelligible. In the speech synthesizer of the preferred embodiment of the invention, x has been chosen as $\frac{1}{2}$ for the voiced phonemes or phoneme groups, however, in other, less advantageous embodiments of the invention, x can be in the range of $\frac{1}{4}$ to $\frac{3}{4}$.

Because this technique introduces signals at the pitch period, it cannot be used on unvoiced sounds which have insufficient amplitude at such frequencies to mask this distortion. Since about 80% of the phonemes in the prototype speech synthesizer are half-period zeroed, a compression factor of about 1.8 has been achieved in the prototype speech synthesizer by application of the technique of half-period zeroing.

Implementation of half-period zeroing in the speech synthesizer is made relatively simple by the fact that all pitch periods are of equal length. Information initially generated by the human operator on whether a given phoneme or phoneme group is half-period zeroed is carried by a single bit in the syllable memory 106. The output analog waveform of phonemes that are half-period zeroed is replaced by a constant level signal during the last half 124 of each pitch period by switching the output from the analog waveform to a constant level signal. The half-period zeroing bit in the syllable memory 106 is also used to indicate application of the later described compression technique of "phase adjusting." This technique interacts with x-period zeroing to diminish the degradation of intelligibility associated with x-period zeroing, in a manner that is discussed below.

The technique of introducing silence into the waveform is also used in many other places in the speech synthesizer. Many words have soundless spaces of about 50–100 milliseconds between phonemes. For example, the word "eight" contains a space between the two phonemes /e/ and /t/. Similarly, silent intervals often exist between words in sentences. These types of silence are produced in the synthesizer by switching its output from the speech waveform to the constant level when the appropriate bit of information in the syllable memory indicates that the phoneme of interest is silence.

Delta-Modulation

Since the speech waveform is relatively smooth and continuous, the difference in amplitude between two successive digitizations of the waveform is generally much smaller than either of the two amplitudes. Hence, less information need be retained if differences of amplitudes of successive digitizations are stored in the phoneme memory and the next amplitude in the waveform is obtained by adding the appropriate contents of the memory to the previous amplitude.

This process of delta modulation has been used in many speech compression schemes (Flanagan, 1972). Many versions of the technique have been studied by the applicant on a computer while designing the speech synthesizer of the invention in an attempt to reduce the number of bits per digitization from four to two. A scheme has been found that produces little or no detectable degradation of the speech quality or intelligibility and this scheme is called "floating-zero, two-bit delta modulation". In this technique the value $v_i$ of the ith digitization in the waveform is obtained from the (i−1) th value, $v_{i-1}$, by the equation $$v_i = v_{i-1} + f(\Delta_{i-1}, \Delta_i)$$

where f is an arbitrary function and $\Delta_i$ is the ith value of the two-bit function stored in the phoneme memory 104 as the delta-modulation information pertinent to the ith digitization. Since the function f depends on the previous as well as the present digitization, its zero level and amplitude may be made dependent on estimates of the slope of the waveform obtained from $\Delta_{i-1}$ and $\Delta_i$, so that zero level of f may be said to be floating and this delta-modulation scheme may be called predictive. Since there are only sixteen combinations of $\Delta_{i-1}$ and $\Delta_i$ because each is a two-bit binary number, the function f is uniquely defined by sixteen values that are stored in a read-only memory in the speech synthesizer. Approximately thirty different functions, f, were tested in a computer in order to select the function utilized in the prototype speech synthesizer and described in Table 4 below:

TABLE 4

| Values Of The Function f ($\Delta_{i-1}$, $\Delta_i$) | | |
|---|---|---|
| $\Delta_{i-1}$ | $\Delta_i$ | $f(\Delta_{i-1}, \Delta_i)$ |
| 3 | 3 | 3 |
| 3 | 2 | 1 |
| 3 | 1 | 0 |
| 3 | 0 | −1 |
| 2 | 3 | 3 |
| 2 | 2 | 1 |
| 2 | 1 | 0 |
| 2 | 0 | −1 |
| 1 | 3 | 1 |
| 1 | 2 | 0 |
| 1 | 1 | −1 |
| 1 | 0 | −3 |
| 0 | 3 | 1 |
| 0 | 2 | 0 |
| 0 | 1 | −1 |
| 0 | 0 | −3 |

The above defined function has the property that small (<2 level) changes of the waveform from one digitization to the next are reproduced exactly while large changes in either direction are accommodated through the capability of slewing in either direction by three levels per digitization. This form of delta-modulation reduces the information content of the phoneme memory 104 in the prototype speech synthesizer by a factor of two. This compression is achieved by replacing every 4 bit digitization in the original waveform with a 2 bit number that is found by conventional computer techniques to provide the best fit to the desired 4 bit value upon application of the above function. This string of 2 bit delta modulated numbers then replaces the original waveform in the computer and in the phoneme memory 104.

An example of the application of the floating-zero two-bit delta-modulation scheme is given in Table 5, in the second and third columns of which the amplitudes of the first twenty digitizations of a four-bit waveform are given in decimal and binary units. The two bits of delta-modulation information that would go into the phoneme memory 104 are next listed in decimal and binary, and, finally, the waveform that would be reconstructed by the prototype synthesizer from the compressed information in the phoneme memory 104 is given:

TABLE 5

| Example of Delta Modulation | | | | | | |
|---|---|---|---|---|---|---|
| Digitization | Amplitude of the Original Waveform | | Delta-Modulation Information ($\Delta_i$) | | Amplitude of the Reconstructed Waveform | |
| | Decimal | Binary | Decimal | Binary | Decimal | Binary |
| 1 | 10 | 1010 | 3 | 11 | 10 | 1010 |
| 2 | 13 | 1101 | 3 | 11 | 13 | 1101 |
| 3 | 14 | 1110 | 2 | 10 | 14 | 1110 |
| 4 | 15 | 1111 | 2 | 10 | 15 | 1111 |
| 5 | 15 | 1111 | 1 | 01 | 15 | 1111 |
| 6 | 13 | 1101 | 1 | 01 | 14 | 1110 |
| 7 | 9 | 1001 | 0 | 00 | 11 | 1011 |
| 8 | 7 | 0111 | 0 | 00 | 8 | 1000 |
| 9 | 5 | 0101 | 0 | 00 | 5 | 0101 |
| 10 | 4 | 0100 | 1 | 01 | 4 | 0100 |
| 11 | 5 | 0101 | 3 | 11 | 5 | 0101 |
| 12 | 7 | 0111 | 2 | 10 | 6 | 0110 |
| 13 | 10 | 1010 | 3 | 11 | 9 | 1001 |
| 14 | 13 | 1101 | 3 | 11 | 12 | 1100 |
| 15 | 10 | 1010 | 0 | 00 | 11 | 1011 |
| 16 | 8 | 1000 | 0 | 00 | 8 | 1000 |
| 17 | 5 | 0101 | 0 | 00 | 5 | 0101 |
| 18 | 3 | 0011 | 1 | 01 | 4 | 0100 |
| 19 | 2 | 0010 | 1 | 01 | 3 | 0011 |
| 20 | 2 | 0010 | 1 | 01 | 2 | 0010 |

As an illustration of the process of delta modulation consider, for example, the ninth digitization. The desired decimal amplitude of the waveform is five and the previous reconstructed amplitude was eight, so it is desired to subtract three from the previous amplitude. As indicated in the "Delta-Modulation Information" column under the heading "Decimal" of Table 5 for the eighth digitization, the previous decimal value of $\Delta_i$ was zero. Referring to Table 4, it can be seen that where the desired value of $f(\Delta_{i-1}, \Delta_i)$ is equal to −3 and the value of $\Delta_{i-1}$, i.e., the previous $\Delta_i$, is equal to zero, then the new value of $\Delta_i$ is chosen to be 0. Thus, the delta-modulation information stored in the phoneme memory 104 for this digitization is zero decimal or 00 binary and the prototype synthesizer would construct an amplitude of five from this and the previous data. If the change in amplitude required a subtraction of two instead of three, however, then a value for $\Delta_i$ would be chosen which would underestimate the desired change. In the example given, the nearest value of $f(\Delta_{i-1}, \Delta_i)$ would be −1 and from Table 4 a value of $\Delta_i = 1$ would be selected.

To start the delta-modulation process or waveform reconstruction, a set of initial conditions must be assumed at the beginning of each pitch period. In the prototype synthesizer it is assumed that the zeroth digitization has a reconstructed amplitude level of seven and a value of $\Delta_i$ equal to three. Since the desired decimal value of the first digitization of Table 5 is ten and the assumed zeroth level is seven, three should be added to the assumed zeroth level. Referring to the first line of Table 4 and locating $\Delta_{i-1} = 3$ and $f(\Delta_{i-1}, \Delta_i) = 3$, the first value of $\Delta_i$ according to the table should be equal to 3 in decimal or 11 in binary.

As may also be seen from the example of Table 5, the reconstructed waveform does not reproduce the high frequency components or rapid variations of the initial waveform because the delta-modulation scheme has a limited slew rate. This approximately causes the incident waveform to be integrated in the process of delta modulation and this integration compensates for the differentiation of the initial waveform that is described above as the first of the information compression techniques.

The above process of delta-modulation is performed in conjunction with the following compression technique of "phase adjusting" to yield a somewhat greater compression factor than two in a way that minimizes the degradation of intelligibility of the resulting speech byond that obtainable by delta-modulation alone.

Phase Adjusting

The power spectrum of FIG. 3 is obtained by Fourier analysis of a single period of the speech waveform in the following way. It is assumed that the amplitude of the speech waveform as a function of time, F(t), is represented by the equation $$F(t) = \sum_n A_n \cos(2\pi n \frac{t}{T} + \phi_n) \quad (1)$$

where T is the time duration of the speech period of interest and $A_n$ and $\phi_n$ are arbitrary constants that are different for each value of n and that are determined such that the above equation exactly reproduces the speech waveform. When a period of the differentiated speech waveform is digitized, it is represented by N discrete values of F(t) obtained at times T/N, 2T/N, 3T/N, . . . T. As an example, the 8-bit digitized waveform 119 of FIG. 7*a* contains 96 samples acquired in 10 milliseconds, so $N=96$ and $T=10^{-2}$ seconds. This waveform is one period of the vowel sound in the word "swap."

The N values of F(t) that enter into equation (1) above yield N/2 amplitudes $A_1, A_2 \ldots A_{N/2}$ and N/2 phase angles $\phi_1, \phi_2, \ldots \phi_{N/2}$ since the number of calculated A's plus the number of $\phi$'s must be equal to the number of input values of F(t). Thus, the Fourier analysis of waveform 119 of FIG. 7*a* produces 48 amplitudes and 48 phase angles. These 48 amplitudes, plotted as a function of frequency as in the example of FIG. 3, are called the power spectrum of that period of the speech waveform.

It is well known that the intelligibility of human speech is determined by the power spectrum of the speech waveform and not by the phase angles, $\phi_n$, of the Fourier components (Flanagan, 1972). Hence, the intelligibility of the N digitizations in a period of speech is contained in the N/2 amplitudes, $A_n$. For example, a factor of two compression of the information in the speech waveform must therefore be attainable by taking advantage of the fact that the intelligibility is contained in the amplitudes and not the phases of the Fourier components.

One of many possible ways of obtaining this factor of two compression is by phase angle adjustment, i.e., by arbitrarily requiring that $$\phi_n = \frac{n\pi}{N} + \theta_n$$

where $\theta_n$=O or $\pi$.

Figures 8A, 8B, 8C, 8D, 8E, 8F:
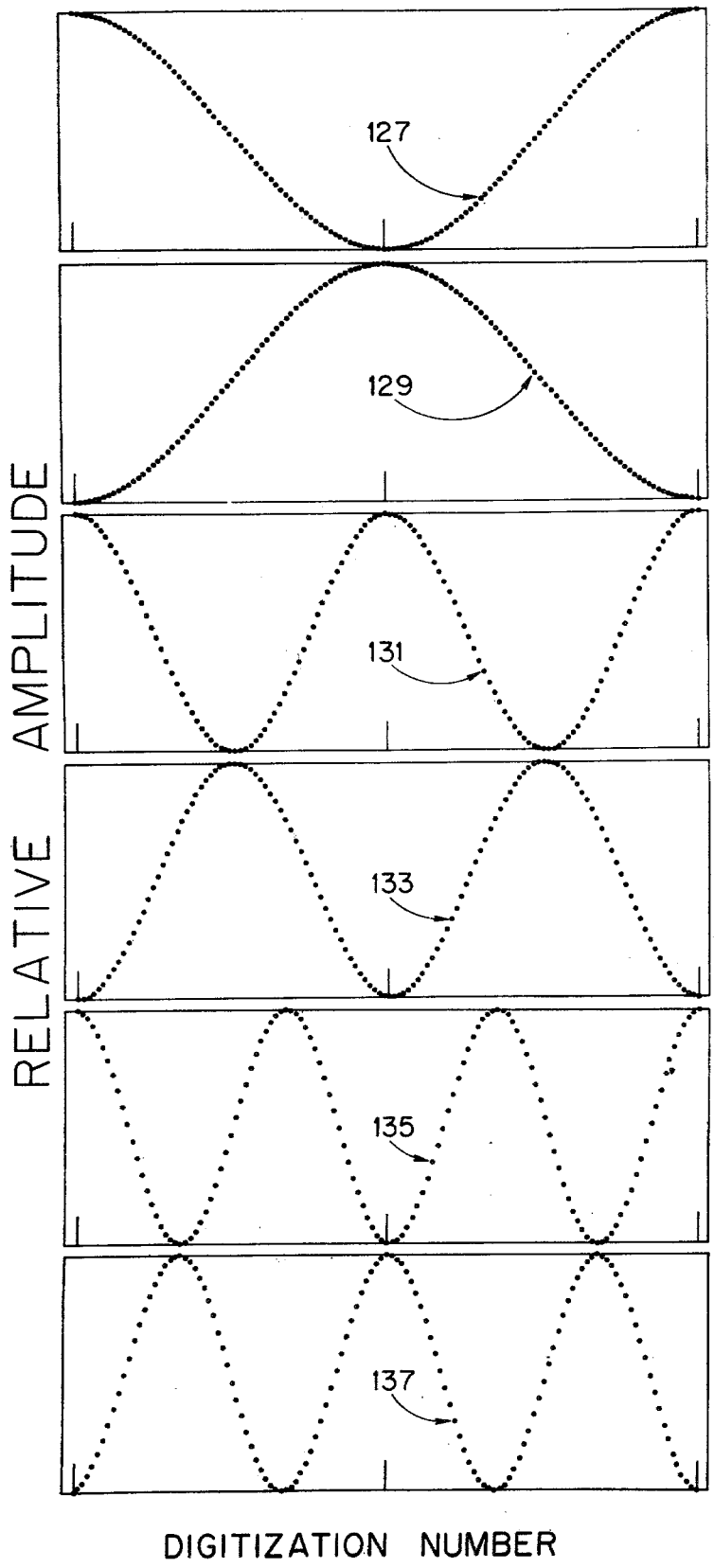

For this case, equation (1) becomes $$F(t) = \sum_n A_n S_n \cos(2\pi n \frac{t}{T} + \frac{n\pi}{N}) \quad (3)$$

where $S_n \equiv \cos\theta_n$ takes on a value of +1 for $\theta_n \equiv 0$ and −1 for $\theta_n = \pi$. As examples of the terms on the right side of equation (3), FIG. 8*a* represents the waveform 127 of $$S_n \cos(2\pi n \frac{t}{T} + \frac{n\pi}{N})$$

for n=1, $S_n=+1$; FIG. 8*b* represents the waveform 129 for n=1, $S_n=-1$; FIG. 8*c* represents the waveform 131 for n=s, $S_n=+1$; FIG. 8*d* represents the waveform 133 for n=2, $S_n=-1$; FIG. 8*e* represents the waveform 135 for n=3, $S_n=+1$; and FIG. 8*f* represents the waveform 137 for n=3, $S_n=-1$. These waveforms and those for any other values of n and $S_n$ possess symmetry about the midpoint, i.e., the amplitude of the (N/2+p+1)th point is equal to that of the (N/2−p)th point. Since each term of equation (3) possesses this mirror symmetry, the function F(t) constructed by equation (3) is also mirror symmetric. Because of this mirror symmetry, the second half of the speech waveform can be obtained from the first half of the waveform and only the first half need be stored in the phoneme memory 104 of FIG. 5. Hence, a factor of two compression is achieved by fixing the phase angles as in equation (2) in the process called "phase adjusting."

Figures 7A, 7B, 7C, 7D:
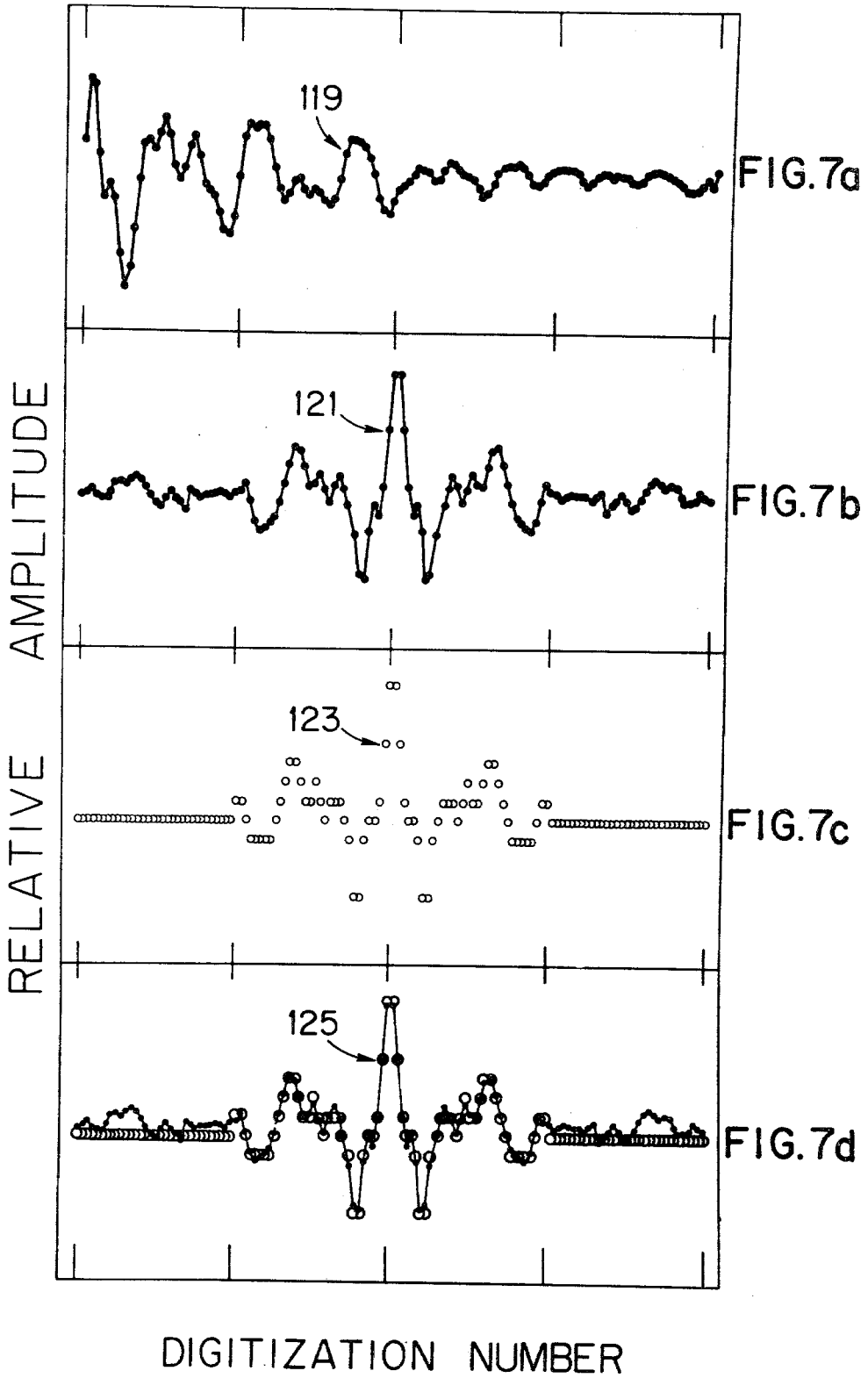

In this process of phase adjusting, the digitized speech waveform containing, for example, 96 digitizations, is Fourier analyzed in a computer by use of conventional and readily available fast Fourier transform subroutines to produce the 48 values of $A_n$ that enter into equation (3). For a description of such a Fourier techniques see "An Algorithm For The Machine Calculation Of Complex Fourier Series", by James W. Cooley and John W. Tukey from the book, *Mathematics of Computation,* Vol. 19, April 1965, page 297 et seq. The 48 values of $\phi_n$ thereby obtained are values of the $\phi_n$'s that are given by equation (2). Since the values of $S_n$ of equation (3) are allowed to be either +1 or −1, the possible combinations of values for the 48 quantities $S_n$ produce $2^{48} \approx 10^{14}$ different waveforms, all of which possess mirror symmetry (hence can be compressed by a factor of two) and sound the same as the original waveform. One of these $10^{14}$ possible waveforms obtained from the period of data illustrated as waveform 119 of FIG. 7*a* is presented as waveform 121 of FIG. 7*b*. It is important for a complete understanding of this technique to comprehend that in spite of their different appearances, waveforms 119 and 121 sound the same.

A criteria must be invoked to select the single speech waveform for use in the speech synthesizer among the $\sim 10^{14}$ candidate waveforms. This criteria should provide the waveform that is most amenable to the previously described compression techniques of half-period zeroing and delta-modulation, in order that these compression schemes can be applied with minimal degradation of the speech intelligibility. Thus, the 48 values of the $S_n$'s should be selected such that the speech waveform has a minimum amount of power in its first and last quarters (so that it can be half-period zeroed with little degradation) and such that the difference between amplitudes of successive digitizations in the second and third quarters of the waveform should be consistent with possible values obtainable from the delta-modulation scheme.

The 48 values of the $S_n$'s used in constructing waveform 121 of FIG. *7b* were selected around these criteria. Thus, only 7 percent of the power in waveform 121 is contained in the first and last quarters of the pitch period. Thus these quarters can be zeroed and replaced with a constant amplitude signal to gain a further factor of two compression with no audible degradation. Also, because of the mirror symmetry of the waveform, the last half can be discarded and recreated from the first half. See preceeding pages 30–32 for a discussion of x-period zeroing.

Furthermore, the 48 values of the $S_n$'s were also selected to minimize the degradation associated with delta-modulation. The resulting delta-modulated, half period zeroed version of waveform 121 is presented as waveform 123 in FIG. *7c*. The two waveforms 121 and 123 are superimposed to produce the composite curve 125 of FIG. *7d*.

Through examination of the composite waveform 125 it is seen that the delta-modulated waveform 123 seldom disagrees with the original waveform 121 by more than one-fourth the distance between successive delta-modulation levels. In fact, the average disagreement between the two curves is one-sixth of this difference. Since there are 16 allowable delta-modulation levels, a one-sixth error corresponds to an average fit of the original waveform 121 to approximately 6 bit accuracy. Thus, the 2 bit delta-modulated waveform is compressed in information content by a factor of 3 over the 6 bit waveform that it fits. This exceeds the factor of two compression achieved by delta-modulation in the above description of delta-modulation. This extra compression results from the ability to adjust the 48 values of the $S_n$'s that appear due to phase adjusting.

To summarize, the process of phase adjusting performed in the computer produces a factor of 3 compression, a factor of 2 of which comes from the necessity for storing only half the waveform and a factor of 1.5 comes from the improved usage of delta-modulation. A further advantage of phase adjusting is that it allows minimization of the power appearing in those parts of the waveform that are half-period zeroed. The compression factor achieved between waveforms 119 and 123 of FIG. *7a* and *7c* and the two waveforms appear identical to the ear. Of this factor of 12, 2 results from half-period zeroing, 2 results from phase adjusting, and 3 results from the combination of phase adjusting and delta modulation.

Aside from the compression techniques discussed above, the speech synthesizer of the invention incorporates other features which aid in the intelligibility and quality of the reproduced speech. These features will now be discussed in detail.

Pitch Frequency Variations

The clock 126 in FIG. 5 controls the rate at which digitizations are played out of the speech synthesizer. If the clock rate is increased the frequencies of all components of the output waveform increase proportionally. The clock rate may be varied to enable accenting of syllables and to create rising or falling pitches in different words. Via tests on a computer it has been shown that the pitch frequency may be varied in this way by about 10 percent without appreciably affecting sound quality or intelligibility. This capability can be controlled by information stored in the syllable memory 106 although this is not done in the prototype speech synthesizer. Instead, the clock frequency is varied in the following two manners.

First, the clock frequency is made to vary continuously by about two percent at a three Hertz rate. This oscillation is not intelligible as such in the output sound bit it results in the disappearance of the annoying monotone quality of the speech that would be present if the clock frequency were constant.

Second, the clock frequency may be changed by plus or minus five percent by manually or automatically closing one or the other of two switches associated with the synthesizer's external control. Such pitch frequency variations allow introduction of accents and inflections into the output speech.

The clock frequency also determines the highest frequency in the original speech waveform that can be reproduced since this highest frequency is half the digitization or clock frequency. In the speech synthesizer of the preferred embodiment, the digitization or clock frequency has been set to 10,000 Hertz, thereby allowing speech information at frequencies to 5000 Hertz to be reproduced. Many phonemes, especially the fricatives, have important information above 5000 Hertz, so their quality is diminished by this loss of information. This problem may be overcome by recording and playing all or some of the phonemes at a higher frequency at the expense of requiring more storage space in the phoneme memory in other embodiments.

Amplitude Variations

The method of the present invention further provides for variations in the amplitude of each phoneme. Amplitude variations may be important in order to stimulate naturally occurring amplitude changes at the beginning and ending of most words and to emphasize certain words in sentences. Such changes may also occur at various places within a word. These amplitude changes may be achieved by storing appropriate information in the syllable memory 106 of FIG. 5 to control the gain of the output amplifier 190 as the phoneme is read out of the phoneme memory. Although this feature has not been shown in the speech synthesizer of FIG. 5 for simplicity of description, it should be understood to be a necessary part of more sophisticated embodiments.

In the generation of the phonemes and phoneme groups of the synthesizer of the preferred embodiment, care was taken to keep the amplitude of the spoken data constant so that phonemes or phoneme groups from different utterances could be combined with no audible discontinuity in the amplitude.

The Synthesizer Phoneme Memory

The structure of the phoneme memory 104 is 96 bits by 256 word. This structure is achieved by placing 12 eight-bit read-only memories in parallel to produce the 96-bit word structure. The memories are read sequentially, i.e., eight bits are read from the first memory, then eight bits are read from the second memory, etc., until eight bits are read from the twelfth memory to complete a single 96-bit word. These 96 bits represent 48 pieces of two-bit delta-modulated amplitude information that are electronically decoded in the manner described in Table 5 and its discussion. The electronic circuit for accomplishing this process will be described in detail, hereinafter, in reference to FIG. 10.

For purposes of simplification in the construction of the prototype speech synthesizer, the delta-modulated information corresponding to the second quarter of each phase adjusted pitch period of data is actually stored in the phoneme memory even though this information can be obtained by inverting the waveform of the first quarter of that pitch period. Thus, the prototype phoneme memory contains 24,576 bits of information instead of 16,320 bits that would be required if electronic means were provided to construct the second quarter of phase adjusted pitch period data from the first. It is emphasized that this approach was utilized to simplify construction of the prototype unit while at the same time providing a complete test of the system concept.

The Synthesizer Syllable Memory

The structure of the syllable memory 106 is 16 bits by 256 words. This structure is achieved by placing two eight-bit read-only memories in parallel. The syllable memory 106 contains the information required to combine sequences of outputs from the phoneme memory 104 into syllables or complete words. Each 16-bit segment of the syllable memory 106 yields the following information:

| Information | Number of Bits Required |
|---|---|
| Initial address in the phoneme memory of the phoneme of interest (0–127). This seven-bit number hereinafter is called p'. | 7 |
| Information whether to play the given phoneme or to play silence of an equal length. If the bit is a one, play silence. This logic variable is hereinafter called Y. | 1 |
| Information whether this is the last phoneme in the syllable. If the bit is a one, this is the last phoneme. This logic variable is hereinafter called G. | 1 |
| Information whether this phoneme is half-period zeroed. If the bit is a one, this phoneme is half-period zeroed. This logic variable is hereinafter called Z. | 1 |
| Number of repetitions of each pitch period. One to four repetitions are denoted by the binary numbers 00 to 11, and the decimal number ranging from one to four is hereinafter called m'. | 2 |
| Number of pitch periods of phoneme memory information to play out. One to sixteen periods are denoted by the binary numbers 0000 to 1111, and the decimal number ranging from one to sixteen is hereinafter called n'. | 4 |

The Synthesizer Word Memory

The syllable memory 106 contains sufficient information to produce 256 phonemes of speech. The syllables thereby produced are combined into words by the word memory 108 which has a structure of eight bits by 256 words. By definition, each word contains two syllables, one of which may be a single pitch period of silence (which is not audible) if the particular word is made from only one syllable. Thus, the first pair of eight bit words in the word memory gives the starting locations in the syllable memory of the pair of syllables that make up the first word, the second pair of entries in the word memory gives similar information for the second word, etc. Thus, the size of the word memory 108 is sufficient to accommodate a 128-word vocabulary.

The Sentence Memory

The word memory 108 can be addressed externally through its seven address lines 110. Alternatively, it may be addressed by a sentence memory 114 whose function is to allow for the generation of sequences of words that make sentences. The sentence memory 114 has a basic structure of 8 bits by 256 words. The first 7 bits of each 8-bit word give the address of the word of interest in the word memory 108 and the last bit provides information on whether the present word is the last word in the sentence. Since the sentence memory 114 contains 256 words, it is capable of generating one or more sentences containing a total of no more than 256 words.

Referring now more particularly to FIG. 9, a block diagram of the method by which the contents of the phoneme memory 104, the syllable memory 106, and the word memory 108 of the speech synthesizer 103 are produced is illustrated. As mentioned previously at pages 18 and 19, the degree of intelligibility of the compressed speech information upon reproduction is somewhat subjective and is dependent on the amount of digital storage available in the synthesizer. Achieving the desired amount of information signal compression while maximizing the quality and intelligibility of the reproduced speech thus requires a certain amount of trial and error use in the computer of the applicant's techniques described above until the user is satisfied with the quality of the reproduced speech information.

To again summarize the process by which the data for the synthesizer memories is generated in the computer, reference is made in particular to FIG. 9. The vocabulary of Table 2 is first spoken into a microphone whose output 128 is differentiated by a conventional electronic RC circuit to produce a signal that is digitized to 4-bit accuracy at a digitization rate of 10,000 samples/second by a commercially available analog to digital converter. This digitized waveform signal 132 is stored in the memory of a computer 133 where the signal 132 is expanded or contracted by linear interpolation between successive data points until each pitch period of voiced speech contains 96 digitizations using straight-forward computer software. The amplitude of each word is then normalized by computer comparison to the amplitude of a reference phoneme to produce a signal having a waveform 134. See preceeding pages 13–16 for a more complete description of these steps.

The phonemes or phoneme groups in this waveform that are to be half-period zeroed and phase adjusted are next selected by listening to the resulting speech, and these selected waveforms 136 are phase adjusted and half-period zeroed using conventional computer memory manipulation techniques and sub-routines to produce waveforms 138. See preceeding pages 30–32 and 38–42 for a more complete description of these steps. The waveforms 140 that are chosen by the operator to not be half-period zeroed are left unchanged for the next compression stage while the information 142 concerning which phonemes or phoneme groups are half-period zeroed and phase adjusted is entered into the syllable memory 106 of the synthesizer 103.

The phonemes or phoneme groups 144 having pitch periods that are to be repeated are next selected by listening to the resulting speech which is reproduced by the computer and their unused pitch periods (that are replaced by the repetitions of the used pitch periods in reconstructing the speech waveform) are removed from the computer memory to produce waveforms 146. Those phonemes or phoneme groups 148 chosen by the operator to not have repeated periods by-pass this operation and the information 150 on the number of pitch-period repetitions required for each phoneme or phoneme group becomes part of the data transferred to the synthesizer syllable memory 106. See preceeding pages 28–30 for a more complete description of these steps.

Syllables are next constructed from selected phonemes or phoneme groups 152 by listening to the resulting speech and by discarding the unused phonemes or phoneme groups 154. The information 156 on the phonemes or phoneme groups comprising each syllable become part of the synthesizer syllable memory 106. Words are next subjectively constructed from the selected syllables 158 by listening to the resulting speech, and the unused syllables 160 are discarded from the computer memory. The information 162 on the syllable pairs comprising each word is stored in the synthesizer word memory 108. See preceeding pages 22–26 for a more complete description of these steps. The information 158 then undergoes delta modulation within the computer to decrease the number of bits per digitation from four to two; see preceeding pages 33–38. The digital data 164, which is the fully compressed version of the initial speech, is transferred from the computer and is stored as the contents of the synthesizer phoneme memory 104.

The content of the synthesizer sentence memory 114, which is shown in FIG. 5 but is not shown in FIG. 9 to simplify the diagram, is next constructed by selecting sentences from combinations of the one hundred and twenty-eight possible words of Table 2. The locations in the word memory 108 of each word in the sequence of words comprising each sentence becomes the information stored in the synthesizer sentence memory 114. See preceeding pages 45–48 for a more complete description of the phoneme, syllable and word memories.

The electronic circuitry necessary to reproduce and thus synthesize the one hundred and twenty-eight word vocabulary will now be described in reference to FIGS. 10, 11*a*, 11*b*, 11*c*, 11*d*, 11*e*, 11*f*, 12, 13, 14, 15 and 16.

An overview of the operation of the synthesizer electronics is illustrated in the block diagram of FIG. 10. Depending on the state of the word/sentence switch 166, it is possible to address either individual words or entire sentences. Consider the former case. With the word/sentence switch 166 in the "word" position, the seven address switches 168 are connected directly through the data selector switch 170 to the address input of the word memory 108. Thus the number set into the switches 168 locates the address in the word memory 108 of the word which is to be spoken.

The output of the word memory 108 addresses the location of the first syllable of the word in the syllable memory 106 through a counter 178. The output of the syllable memory 106 addresses the location of the first phoneme of the syllable in the phoneme memory 104 through a counter 180. The purpose of the counters 178 and 180 will be explained in greater detail below. The output of the syllable memory 106 also gives information to a control logic circuit 172 concerning the compression techniques used on the particular phoneme. (The exact form of this information is detailed in the description of the syllable memory 106 above.)

When a start switch 174 is closed, the control logic 172 is activated to begin shifting out the contents of the phoneme memory 104, with appropriate decompression procedures, through the output of a shift register 176 at a rate controlled by the clock 126. When all of the bits of the first phoneme have been shifted out (the instructions for how many bits to take for a given phoneme are part of the information stored in the syllable memory 106), the counter 178, whose output is the 8-bit binary number s, is advanced by the control logic 172 and the counter 180, whose output is the 7-bit binary number p, is loaded with the beginning address of the second phoneme to be reproduced.

When the last phoneme of the first syllable has been played, a type J-K flip-flop 182 is toggled by the control logic 172, and the address of the word memory 108 is advanced one bit to the second syllable of the word. The output of the word memory 108 now addresses the location of the beginning of the second syllable in the syllable memory 106, and this number is loaded into the counter 178. The phonemes which comprise the second syllable of the word which is being spoken are next shifted through the shift register 176 in the same manner as those of the first syllable. When the last phoneme of the second syllable has been spoken, the machine stops.

The operation of the control logic 172 is sufficiently fast that the stream of bits which is shifted out of the shift register 176 is continuous, with no pauses between the phonemes. This bit stream is a series of 2-bit pieces of delta-modulated amplitude information which are operated on by a delta-modulation decoder circuit 184 to produce a 4-bit binary number $v_i$ which changes 10,000 times each second. A digital to analog converter 186, which is a standard R-2R ladder circuit, converts this changing 4-bit number into an analog representation of the speech waveform. An electronic switch 188, shown connected to the output of the digital to analog converter 186, is toggled by the control logic 172 to switch the system output to a constant level signal which provides periods of silence within and between words, and within certain pitch periods in order to perform $\frac{1}{2}$ period zeroing operation. The control logic 172 receives its silence instructions from the syllable memory 106. This output from the switch 188 is filtered to reduce the signal at the digitizing frequency and the pitch period repetition frequency by the fileter-amplitude 190, and is reproduced by the loudspeaker 192 as the spoken word of the vocabulary which was selected. The entire system is controlled by a 20 kHz clock 126, the frequency of which is modulated by a clock modulator 194 to break up the monotone quality of the sound which would otherwise be present as discussed above.

The operation of the syntheziser 103 with the word/-sentence switch 166 in the "sentence" position is similar to that described above except that the seven address switches 168 specify the location in the sentence memory 114 of the beginning of the sentence which is to be spoken. This number is loaded into a counter 196 whose output is an 8-bit number j which forms the address of the sentence memory 114. The output of the sentence memory 144 is connected through the data selector switch 170 to the address input of the word memory 108. The control logic 172 operates in the manner described above to cause the first word in the sentence to be spoken, then advances the counter 196 by one count and in a similar manner causes the second word in the sentence to be spoken. This continues until a location in the sentence memory 114 is addressed which contains a stop command, at which time th machine stops.

To further understand the operation of the prototype electronics, the actual contents of the various memories involved in the construction of a specific word will be examined. Again, it must be understood that the data making up these memory contents was originally generated in the computer 133 by a human operator using the applicant's speech compression methods and then was permanently transferred to the respective memories of the synthesizer 103 (see FIG. 9). Consider as an example the word "three". It is addressed by the seventh entry in the word memory 108; the contents of this location are, in the binary notation, 00000111. This is the beginning address of the first syllable of the word "three" in the syllable memory 106. The address 00000111 in binary or 7 in decimal refers to the eighth entry in the syllable memory 106, which is the binary number 00100000 00000110. Returning to the description of the syllable memory 106 on page 36, it is found that $p'=0010000$, which are the 7 most significant bits of the address in the phoneme memory 104 where the first phoneme of the first syllable starts. This address is the beginning location of the sound "th" in the phoneme memory 104.

The eighth bit from the syllable memory 106 gives $Y=0$, which means that this phoneme is not silence. The ninth bit gives $G=0$, which means that this is not the last phoneme in the syllable. The tenth bit gives $Z=0$, which means half-period zeroing is not used. The eleventh and twelfth bits give $m'=1$, the number of times each pitch period of sound is to be repeated. The last four bits give $n'-1=0110$ in binary so that $n'=7$ in decimal units, which is the total number of pitch periods of sound to be taken for this phoneme. Since $G=0$ for the first phoneme, we go to the next entry in the syllable memory 106 to get the information for the next phoneme.

The next entry is also 00100000 00000110. This means that the second phoneme that is produced is also "th". Since $G=0$, we go to the next entry in the syllable memory 106 to get information for the third phoneme. The next entry is 00101110 11101001. Thus, $p'=0010111$, $Y=0$, $G=1$, $Z=1$, $m'=$decimal 3, and $n'=$decimal 10. The number 0010111 is the starting address of "ree" in the phoneme memory 104. The equality $G=1$ indicates that this is the last phoneme of the syllable. Since $Z=1$, this indicates that $\frac{1}{2}$ period zeroing was done on this phoneme in the computer 103 and a half pitch period of silence must be generated in the synthesizer 103. Similarly, the equality $m'=3$ means each period of sound is to be repeated 3 times, and $n'=10$ means that a total of ten periods from the phoneme memory 104 are to be played. Since this was the last phoneme in the first syllable of the word which is being spoken, the address of the beginning of the second syllable in the syllable memory 106 will be found at the next entry in the word memory 108.

The next entry in the word memory 108 is 10000011. Since the binary number 10000011=decimal 131, the desired information is obtained from the 131st binary word of the syllable memory 106, which is 00000001 10000000. Thus, $p'=0000000$, $Y=1$, $G=1$, $Z=0$, $m'=1$, and $n'=1$. Since $Y=1$, this phoneme plays only silence; since $m'=n'=1$, it lasts for a total of one pitch period; and since $G=1$, this is the last phoneme in the syllable. Since this was the second syllable of the word, the synthesizer stops.

A circuit diagram of the synthesizer electronics appears in FIGS. 11*a*, 11*b*, 11*c*, 11*d*, 11*e*, and 11*f*. The remainder of this section will be concerned with explaining in detail how this circuit performs the operations described above.

The following notation will be used:

1. Boolean variables are represented by upper case Roman letters. Examples of different variables are:

A, $A_1$, BB. A letter such as one of these adjacent to a line in the circuit diagram indicates the variable name assigned to the value of the logic level on that line.

2. Binary numbers of more than one bit are represented by lower case Roman letters. Examples of different binary numbers are:

m, n, and n'. If m is a 2-bit binary number, then $m_1$ and $m_2$ will be taken to be the most significant and least significant bits of m, respectively. A letter such as one of these adjacent to a bracket of a group of lines on the circuit diagram indicates the variable name assigned to the binary number formed by the values of the logic levels on those lines.

3*a*. D(X) means the Boolean variable which is the data input of the type D flip-flop, the value of whose output is the Boolean variable X.

b. J(X) means the Boolean variable which is the J input of a type J-K flip-flop, the value of whose output is the Boolean variable X.

c. K(X) means the Boolean variable which is the K input of a type J-K flip-flop, the value of whose output is the Boolean variable X.

d. T(X) means the Boolean variable which is the clock input of a flip-flop, the value of whose output is the Boolean variable X.

e. T(m) means the Boolean variable which is the clock input of a counter, the value of whose output is the binary number m.

f. E(m) means the Boolean variable which is the clock enable input of the counter, the value of whose output is the binary number m.

g. L(m) means the Boolean variable which is the synchronous load input of the counter, the value of whose output is the binary number m.

h. R(m) means the Boolean variable which is the synchronous reset input of the counter, the value of whose output is the binary number m.

Tables 6 through 9 below provide a list of the Boolean logic variables referred to on the circuit diagram of FIGS. 11*a*–11*f* and the timing diagrams of FIGS. 12 to 15, as well as showing the relationships between them in algebraic form. These relationships are created by gating functions in the circuit, and by the contents of two control, read-only memories whose operation is described below. A brief description of the use of each variable is also given:

TABLE 6

| | |
|---|---|
| j | is the 8-bit number which is the content of the 8-bit counter 196. It is the current address of the sentence read-only memory 114. |
| s | is the 8-bit number which is the content of the 8-bit counter 178. It is the current address of the syllable read only memory 106. |
| p | is the 7-bit number which is the least significant 7 bits of the counter 180. It is the 7 most significant bits of the 12-bit address of the phoneme read-only |

TABLE 6-continued

Figure 11B:
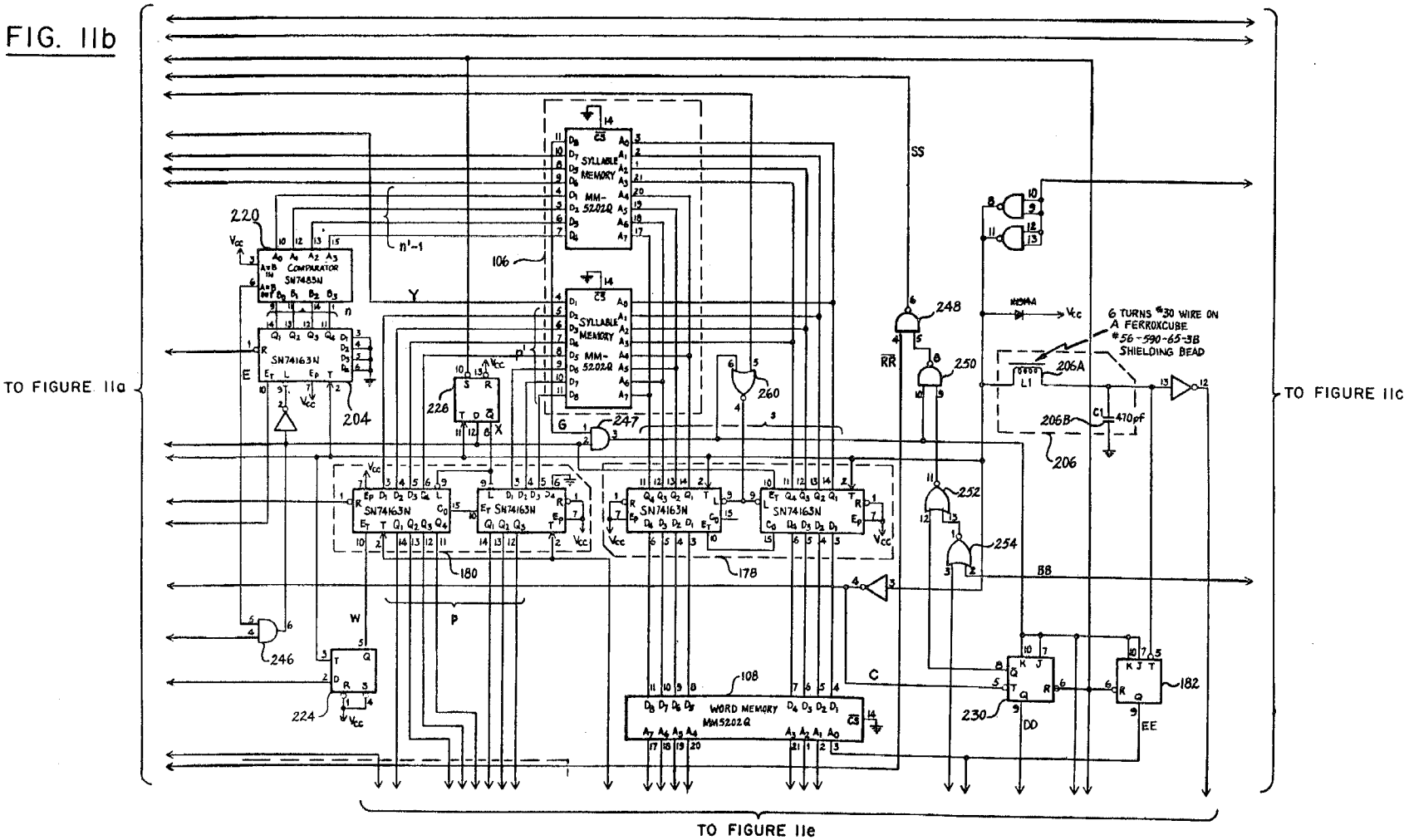
Figure 11C:
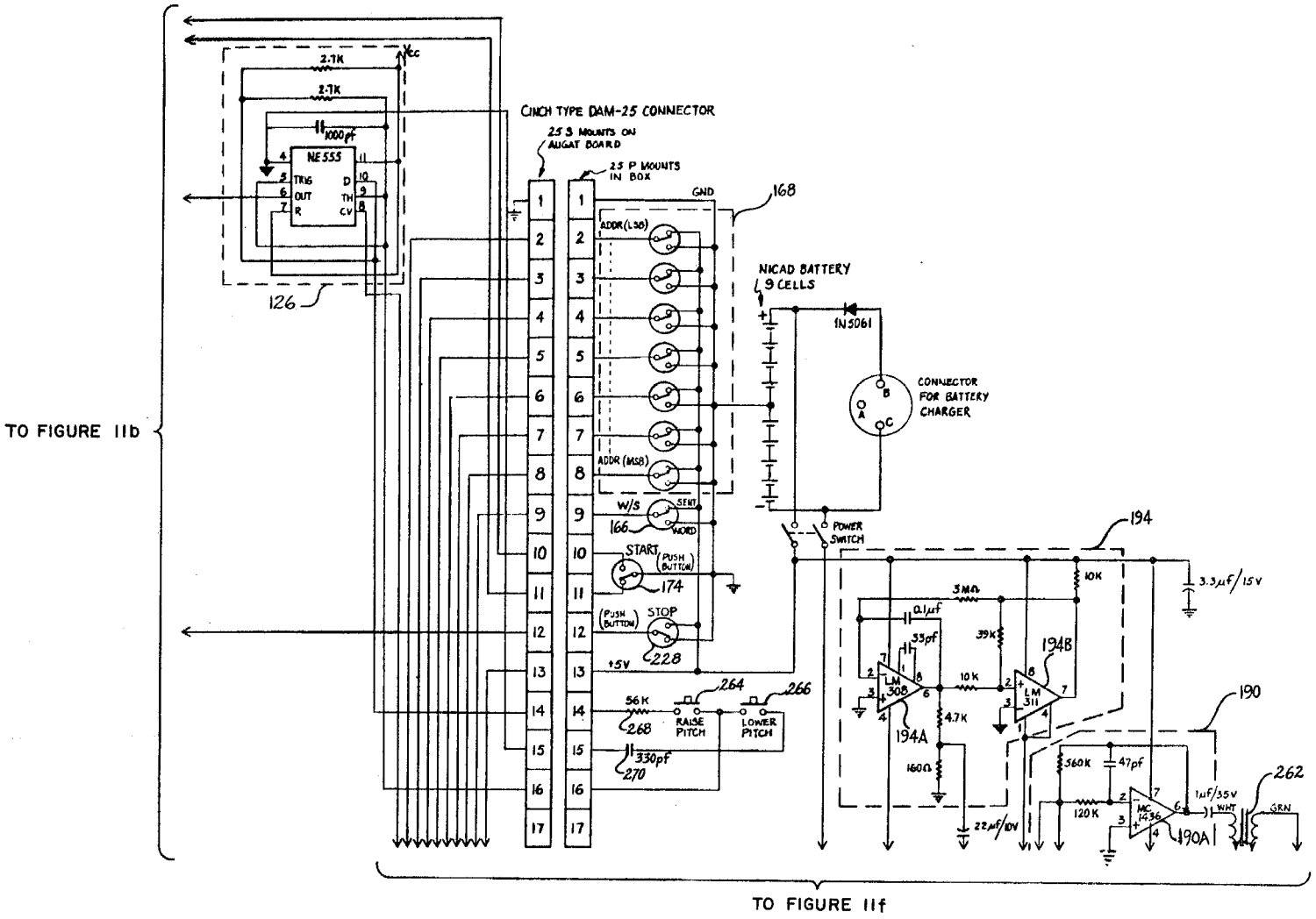

| | |
|---|---|
| | memory 104. |
| AA | is the one-bit number which is the content of the type J-K flip-flop 198. It is the fifth least significant bit of the 12-bit address of the phoneme read-only memory 104. |
| k | is the 4-bit number which is the content of the 4-bit counter 200. It is the 4 least significant bits of the address of the phoneme read-only memory 104. Note in FIG. 11a that the counter 200 is wired such that k can only take the binary values 0100 through 1111. This is done because the phoneme read-only memory 104 is organized to have 3072 words instead of the more usual 4096. k can be viewed as an index which keeps track of the number of 8-bit bytes from the phoneme read-only memory 104 which are used to make half of a pitch period. |
| m | is the 2-bit number which is the 2 least significant bits of a 4-bit counter 202 (FIG. 11a), and is an index which keeps track of the number of times a pitch period is being repeated. |
| n | is the 4-bit number which is the content of a 4-bit counter 204 (FIG. 11b), and is an index which keeps track of how many pitch periods of sound must be taken to complete a given phoneme. |
| p′ | is the 7 most significant bits in the output of the syllable read-only memory 106 which give the 7 most significant bits of the initial address in the phoneme read-only memory 104 of that phoneme which is being addressed by the syllable read-only memory 106. Note that the 5 least significant bits of all initial binary addresses in the phoneme read-only memory 104 are 00100. |
| G | is the ninth bit in the output of the syllable read-only memory 106 which tells whether the phoneme of interest is the last phoneme in the particular syllable being addressed in the syllable read-only memory 106. |
| Z | is the tenth bit in the output of the syllable read-only memory 106 which tells whether ½ period zeroing is to be used for a given phoneme. |
| m′ | is the number of times each pitch period is repeated in a given phoneme. The number stored in bits 11 and 12 of the syllable read-only memory 106, which gives this information, is one less than m′. |
| n′ | is the number of pitch periods of sound which are to be played for a given phoneme. The number stored in bits 13 through 16 of the syllable read-only memory 106, which gives this information, is one less than n′. |
| C | is the output waveform of the 20 kHz clock oscillator 126 (FIGS. 11c and 12). Its frequency is modulated by about 2% at a 3 Hz rate by the clock modulator circuit 194 to reduce the monotone quality of the sound produced. |
| $\overline{C}_d$ | is the delayed inverted clock waveform which is generated from clock waveform C by a 300 nanosecond delay circuit 206 comprised of a inductor 206A and a capacitor 206B (FIG. 11b). |
| H | is a clock waveform, the repetition rate of which is ½ that of C. It is used to latch out the successive levels of the delta-modulation conversion circuit 184. It is generated from the waveform C by a counter 208 and a type D flip-flop 210 (FIG. 11a). |
| U | is the clock waveform generated by the counter 208, which is used as the clock input to a start command synchronizer 212 (FIG. 11a). Its repetition rate is ⅛ that of C (see FIG. 12). |
| A | is the clock waveform generated at the carry output of the counter 208. Its repetition rate is ⅛ that of C (see FIG. 12). |
| UU | is the waveform which is the output of a type D flip-flop 214 (FIG. 11a). It is a version of A which is delayed by one clock pulse. It is used to enable the parallel load input of the output shift register 176, such that a new data byte is loaded at the time shown in FIG. 16. |
| B | $= k_1 . k_2 . k_3 . k_4$, i.e., $B = 1 <=> k = 1111$. Note that this logic function appears only internally to the counter 200, and is not available anywhere on the circuit board. Since the carry output of counter 200 equals $k_1 . k_2 . k_3 . k_4 . E(k)$, and $E(k) = A . WW$ (using a NAND gate 215 shown in FIG. 11a), we find |

TABLE 6-continued

Figure 11E:
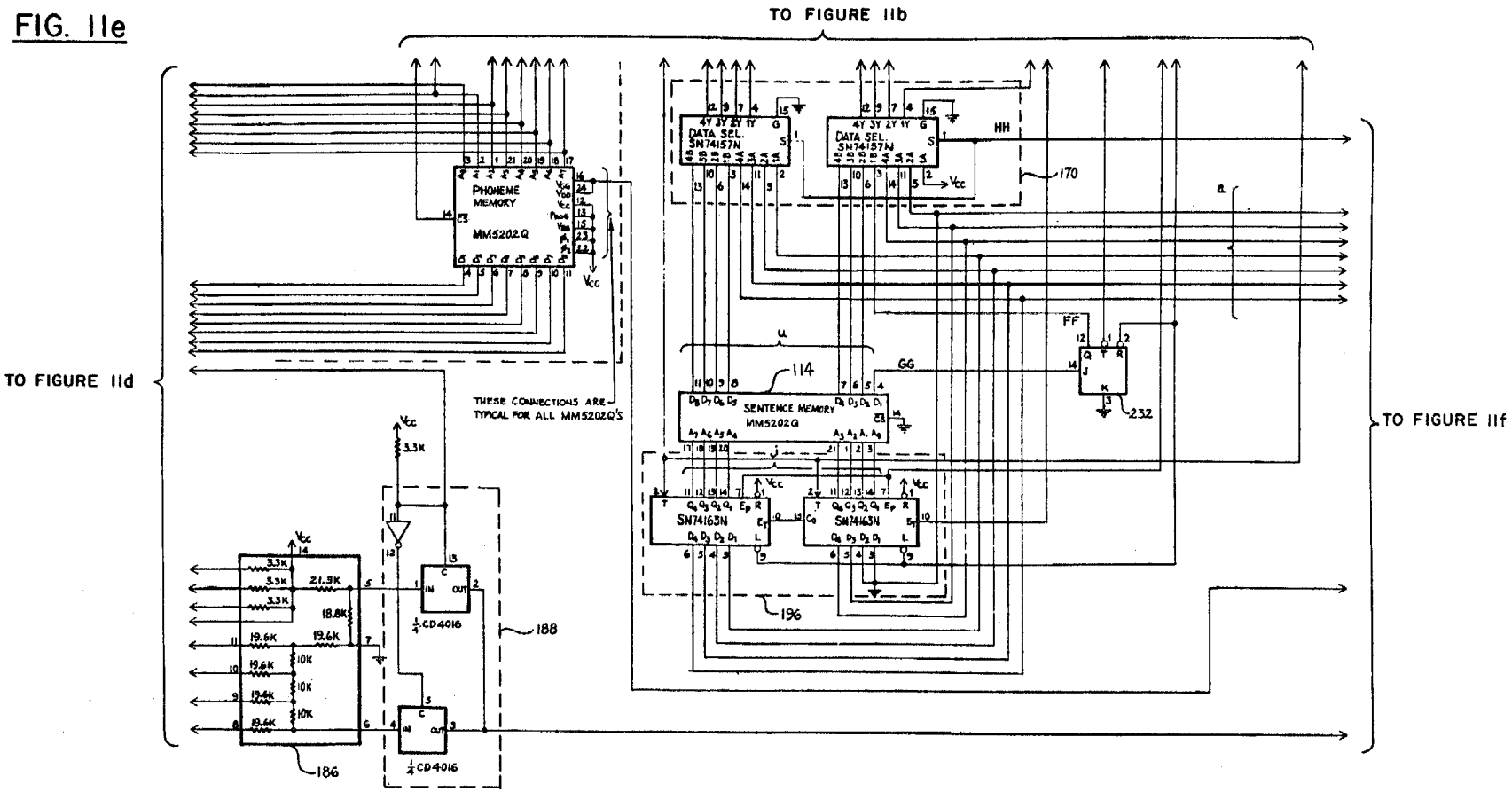
Figure 11F:
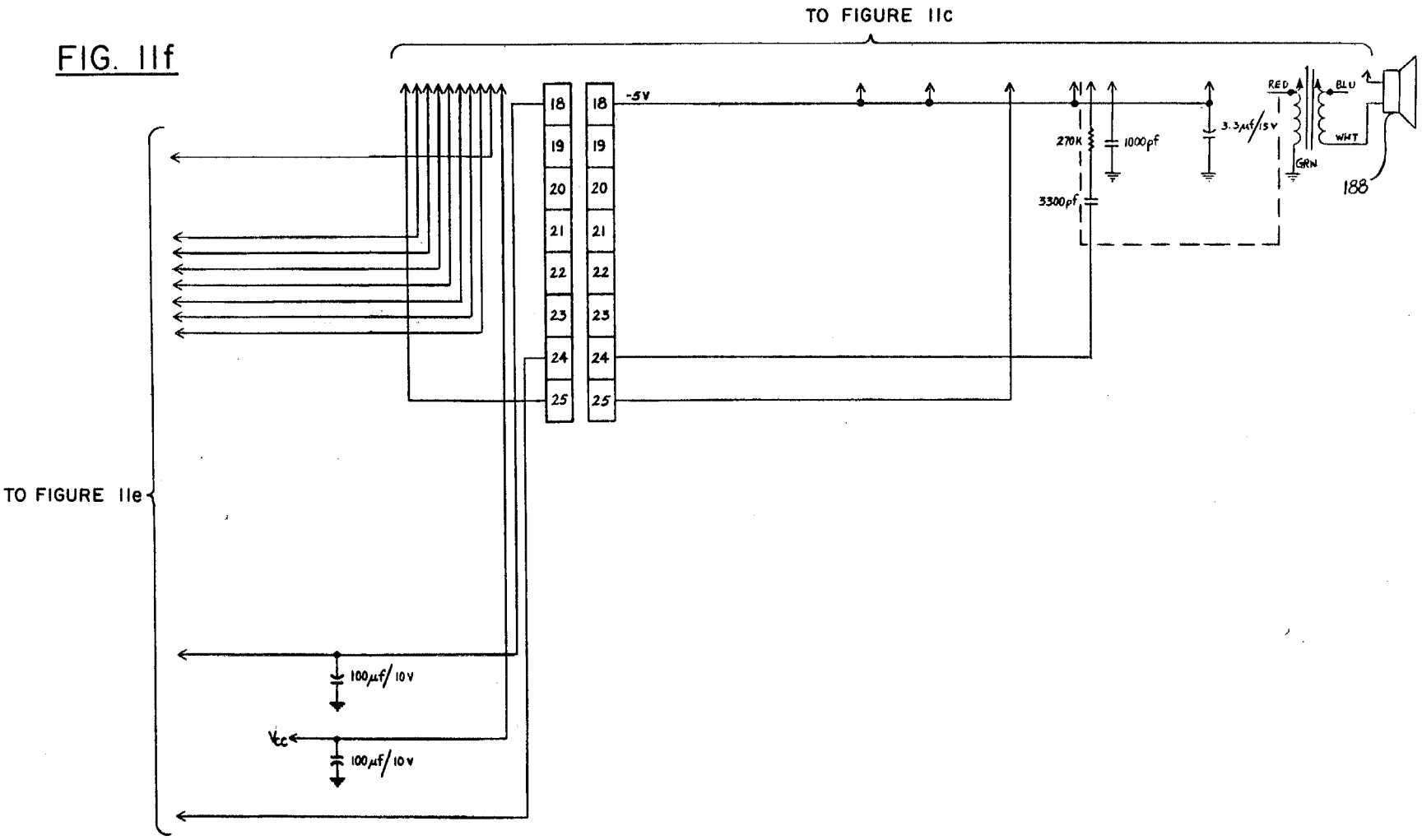

| | |
|---|---|
| | that the carry output of counter 200 equals A . B . WW, which is the only way B occurs in the logic diagram. |
| WW | is the output of a type J-K flip-flop 216 (FIG. 11a). When WW = 1, the machine is talking. When WW = 0, the machine is waiting for the next start command. |
| XX | is the output of a comparator 218 formed from exclusive OR gates 218A and 218B, and NOR gate 218C, which compares m with m′−1 (see FIG. 9a). XX is defined by the relation: XX = 1 <=> m = m′−1. |
| E | is the output of a comparator 220, which compares n with n′−1 (see FIG. 11b). E is defined by the relation: E = 1 <=> n = n′−1. |
| F | is the output of a type J-K flip-flop 221 (see FIG. 11a). When doing phonemes which do not have ½ period zeroing, F = 0 always. When doing a phoneme for which ½ period zeroing is used, F = 0 for the first ½ of the pitch period, F = 1 for the second half. |
| V | is the output of type D flip-flop 222 (see FIG. 11a which is connected to the electronic switch 188 (FIG. 11e). Its operation is such that when V = 1, the input of the filter-amplifier 190 is connected to the output of the digital to analog converter 186, and when V = 0, the input of the filter-amplifier 190 is connected to a reference level which is equal to the average value of the output of the digital to analog converter 186. In this manner the flip-flop 222 is used to introduce silent intervals within and between words. The operation of the flip-flop 222 is defined by: $D(V) = \overline{WW} + F + Y$ with T(V) = H. Note that this means that when the silence bit Y in the syllable read-only memory 106 equals one, V will equal one for that entire phoneme, and hence the output will be silence during that phoneme. |
| W | is the output waveform of a type D flip-flop 224 (FIG. 11a) which is connected to E(p). |
| X | is the output waveform of a type D flip-flop 226 (FIG. 11b) which is connected to L(p). |
| a | is the 7-bit number which is set by the 7 address switches 168. |
| BB | is the output waveform of a stop switch 228 (FIG. 11c). BB = 1 when the stop switch is closed. |
| u | is the 7-bit number which is the 7 most significant bits in the output of the sentence read-only memory 114, and which gives the address in the word read-only memory 108 of the word currently being spoken. |
| GG | is the least significant bit in the output of the sentence read-only memory 114 which is set to one if the word currently addressed is the last word in the sentence. |
| DD | is the output of a type J-K flip-flop 230 (FIG. 11b). The flip-flop 230 is clocked on the rising edge of the system clock 126 and is enabled by the function $B_5$ . E . G which is true during the last clock period of a given syllable. |
| EE | is the output waveform of a type J-K flip-flop 182 (FIG. 11b). The flip-flop 182 is enabled by the same function as the flip-flop 230 above, but is clocked on the delayed inverted system clock. The result is that EE is a delayed version of DD. |
| FF | is the output waveform of a type J-K flip-flop 232 (FIG. 11e). FF is defined by the expressions: $T(FF) = \overline{DD}$, K(FF) = O, J(FF) = GG. The result is that FF is a version of the sentence stop bit waveform GG, which is delayed by exactly one spoken word. |
| SS | is the waveform which is applied to the J input of a type J-K flip-flop 216 (FIG. 11a). The operation of flip-flop 216 is such that WW will become zero on the next clock pulse after SS becomes zero, and the machine will go into its stopped mode. |
| RR | is the output waveform of a delay circuit 234 (FIG. 11d), comprised of a resistor 234A, a capacitor 234B, and an inverter 234C. When power is first applied to the synthesizer, a positive pulse of approximately ½ second duration is output from the delay circuit 234. The purpose of this is to ensure that the device comes on in the stopped mode, and with V = 0. |

TABLE 6-continued

| | |
|---|---|
| $\Delta_i$ | is the 2-bit number which is the 2 most significant bits of the output waveform of the shift register 176, into which the output of the phoneme read-only memory 104 is latched. Since the shift register 176 is clocked on the rising edge of the system clock, every two clock periods a new value of $\Delta_i$ appears. Thus after 8 clock periods, 4 values of $\Delta_i$ will have appeared. It is shown in the following discussion that on the ninth clock pulse, a new 8-bit byte of data is strobed from the phoneme read-only memory 104 into the shift register 176, so that a continuous stream of new values of $\Delta_i$ appear. A total of 96 consecutive values of $\Delta_i$ comprise one pitch period of sound. The number $\Delta_i$ forms 2 bits of the 4-bit address of the delta-modulation decoder read-only memory 184A, the operation of which is described below in the discussion of the delta-modulation decoder circuit 184. |
| $\Delta_{i-1}$ | is the 2-bit number which is the 2 least significant bits of the output waveform of a shift register 236 (FIG. 11d). Since the input of shift register 236 is connected to the output of shift register 176, and they are clocked from the same clock, the result is that at a particular time the value of $\Delta_{i-1}$ is just that which was the value of $\Delta_i$ two clock periods previous to that time. That is, $\Delta_{i-1}$ is the previous $\Delta_i$. The number $\Delta_{i-1}$ forms 2 bits of the 4-bit address of the delta-modulation decoder read-only memory 184A. |
| $f(\Delta_{i-1}, \Delta_i)$ | is the 4-bit number which is the output waveform of the delta-modulation decoder read-only memory 184A (see Table 10). The function f represents the number which is to be added to or substracted from the current value of $v_i$ to obtain the next value of $v_i$. |
| I | is the output waveform of a type D flip-flop 184B (FIG. 11d). I is used to set the initial values of the variables $\Delta_{i-1}$ and $v_{i-1}$ in the delta-modulation decoder circuit 184, at the beginning of a pitch period. (See also FIG. 16 and the description of the operation of the delta modulation decoder circuit 184 below.) |
| $v_i$ | is the 4-bit number which is the output waveform of the delta-modulation decoder circuit 184 and represents the value of the output speech waveform at the time denoted by the subscript i. With each new value of $\Delta_i$, the delta-modulation decoder circuit 184 produces a new value of $v_i$. The digital number, $v_i$, is converted to an analog voltage by the digital to analog converter 186. In this manner, the speech output waveform is produced as a continuous function of time. |
| HH | is the output waveform of the word/sentence switch 166. HH = 1 in the "sentence" position. HH is connected to the control input of the data selector 170 which switches the address input of the word read-only memory 108 between a and u. |
| $A_0$ through $A_4$ | are the waveforms which are input to the address inputs of a logic read-only memory 238 (FIG. 11a). The logic read-only memory 238 is used to generate some of the logic waveforms which control the prototype synthesizer. |

TABLE 7

| | Binary Contents of the Logic Read-Only Memory 238 | | | | | | | | | |
|---|---|---|---|---|---|---|---|---|---|---|
| | $A_0$ | $A_1$ | $A_2$ | $A_3$ | $A_4$ | $B_1$ | $B_2$ | $B_3$ | $B_4$ | $B_5$ |
| 0 | 0 | 0 | 0 | 0 | 0 | 0 | 0 | 0 | 0 | 0 |
| 1 | 0 | 0 | 0 | 0 | 1 | 0 | 0 | 0 | 0 | 0 |
| 2 | 0 | 0 | 0 | 1 | 0 | 0 | 0 | 0 | 0 | 0 |
| 3 | 0 | 0 | 0 | 1 | 1 | 0 | 0 | 0 | 0 | 0 |
| 4 | 0 | 0 | 1 | 0 | 0 | 0 | 0 | 0 | 0 | 0 |
| 5 | 0 | 0 | 1 | 0 | 1 | 0 | 0 | 0 | 0 | 0 |
| 6 | 0 | 0 | 1 | 1 | 0 | 0 | 0 | 0 | 0 | 0 |
| 7 | 0 | 0 | 1 | 1 | 1 | 0 | 0 | 0 | 0 | 0 |
| 8 | 0 | 1 | 0 | 0 | 0 | 0 | 0 | 1 | 0 | 0 |
| 9 | 1 | 0 | 0 | 1 | 0 | 0 | 0 | 0 | 1 | 0 |
| 10 | 0 | 1 | 0 | 1 | 0 | 0 | 0 | 1 | 0 | 0 |
| 11 | 0 | 1 | 0 | 1 | 1 | 0 | 0 | 0 | 1 | 0 |
| 12 | 0 | 1 | 1 | 0 | 0 | 0 | 1 | 1 | 0 | 0 |
| 13 | 0 | 1 | 1 | 0 | 1 | 0 | 0 | 0 | 1 | 0 |

TABLE 7-continued

| | Binary Contents of the Logic Read-Only Memory 238 | | | | | | | | | |
|---|---|---|---|---|---|---|---|---|---|---|
| | $A_0$ | $A_1$ | $A_2$ | $A_3$ | $A_4$ | $B_1$ | $B_2$ | $B_3$ | $B_4$ | $B_5$ |
| 14 | 0 | 1 | 1 | 1 | 0 | 1 | 1 | 1 | 0 | 1 |
| 15 | 0 | 1 | 1 | 1 | 1 | 0 | 0 | 0 | 1 | 0 |
| 16 | 1 | 0 | 0 | 0 | 0 | 0 | 0 | 0 | 0 | 0 |
| 17 | 1 | 0 | 0 | 0 | 1 | 0 | 0 | 0 | 0 | 0 |
| 18 | 1 | 0 | 0 | 1 | 0 | 0 | 0 | 0 | 0 | 0 |
| 19 | 1 | 0 | 0 | 1 | 1 | 0 | 0 | 0 | 0 | 0 |
| 20 | 1 | 0 | 1 | 0 | 0 | 0 | 0 | 0 | 0 | 0 |
| 21 | 1 | 0 | 1 | 0 | 1 | 0 | 0 | 0 | 0 | 0 |
| 22 | 1 | 0 | 1 | 1 | 0 | 0 | 0 | 0 | 0 | 0 |
| 23 | 1 | 0 | 1 | 1 | 1 | 0 | 0 | 0 | 0 | 0 |
| 24 | 1 | 1 | 0 | 0 | 0 | 0 | 0 | 1 | 0 | 0 |
| 25 | 1 | 1 | 0 | 0 | 1 | 0 | 1 | 0 | 1 | 0 |
| 26 | 1 | 1 | 0 | 1 | 0 | 0 | 0 | 1 | 0 | 0 |
| 27 | 1 | 1 | 0 | 1 | 1 | 1 | 1 | 1 | 1 | 0 |

TABLE 7-continued

Binary Contents of the Logic Read-Only Memory 238

| | $A_0$ | $A_1$ | $A_2$ | $A_3$ | $A_4$ | $B_1$ | $B_2$ | $B_3$ | $B_4$ | $B_5$ |
|---|---|---|---|---|---|---|---|---|---|---|
| 28 | 1 | 1 | 1 | 0 | 0 | 0 | 1 | 1 | 0 | 0 |
| 29 | 1 | 1 | 1 | 0 | 1 | 0 | 1 | 0 | 1 | 0 |
| 30 | 1 | 1 | 1 | 1 | 0 | 1 | 1 | 1 | 0 | 1 |
| 31 | 1 | 1 | 1 | 1 | 1 | 1 | 1 | 1 | 1 | 1 |

TABLE 8

Logical expressions developed from the definitions in Table 6, the information in Table 7, and certain gating functions shown on the circuit diagram, FIG. 9.

From Table 7

$B_1 = A_1 \cdot A_3 \cdot (A_2 \cdot \overline{A_4} + A_0 \cdot A_4)$ $B_2 = A_1 \cdot (A_2 \cdot \overline{A_4} + A_0 \cdot A_4)$ $B_3 = A_1 \cdot (\overline{A_4} + A_0 \cdot A_3)$ $B_4 = A_1 \cdot A_4$ $B_5 = A_1 \cdot A_2 \cdot A_3 \cdot (\overline{A_4} + A_0)$ From FIG. 11

$A_0 = F$ $A_1 = A \cdot B \cdot WW$ $A_2 = AA$ $A_3 = XX$ $A_4 = Z$

Hence, $B_1 = A \cdot B \cdot WW \cdot XX \cdot (AA \cdot \overline{Z} + F \cdot Z)$ $B_2 = A \cdot B \cdot WW \cdot (AA \cdot \overline{Z} + F \cdot Z)$ $B_3 = A \cdot B \cdot WW \cdot (\overline{Z} + XX \cdot F)$ $B_4 = A \cdot B \cdot WW \cdot Z$ $B_5 = A \cdot B \cdot WW \cdot AA \cdot XX \cdot (\overline{Z} + F)$ From FIG. 11

$E(k) = A \cdot WW$ $L(k) = A \cdot B \cdot WW + VV$ $E(F) = B_4 = A \cdot B \cdot WW \cdot Z$ $D(V) = \overline{WW} + Y + F$ (using NAND gate 240 and NOR gate 242)

$K(AA) = B_3 = A \cdot B \cdot WW \cdot (\overline{Z} + XX \cdot F)$ $J(AA) = B_3 \oplus R(n) = A \cdot B \cdot WW\,[XX \cdot F \cdot \overline{E} + \overline{Z} \cdot (\overline{XX} + \overline{E} + AA)]$ (using exclusive OR gate 244)

(Note that L(n) is replaced by R(n), since the data inputs of counter 204 are all grounded, and the effect of L(n) is to reset the counter.)

$E(s) = R(n) = B_1 \cdot E = A \cdot B \cdot WW \cdot XX \cdot E \cdot (AA \cdot \overline{Z} + F \cdot Z)$ (using AND gate 246)

$E(n) = R(m) = B_1 = A \cdot B \cdot WW \cdot XX \cdot (AA \cdot \overline{Z} + F \cdot Z)$ $E(m) = B_2 = A \cdot B \cdot WW \cdot (AA \cdot \overline{Z} + F \cdot Z)$ $E(p) = W$ $D(W) = B_5 = A \cdot B \cdot WW \cdot AA \cdot XX \cdot (\overline{Z} + F)$.

Thus the effect of flip-flop 224 is to delay the information to E(p) such that counter 180 toggles exactly one clock period later than it otherwise would (see FIG. 12).

$L(p) = X$ $D(X) = R(n) = B_1 \cdot E = A \cdot B \cdot WW \cdot XX \cdot E \cdot (AA \cdot \overline{Z} + F \cdot Z)$ Thus the effect of flip-flop 226 is to delay the information to L(p) such that counter 180 is loaded exactly one clock pulse later than it otherwise would have been (see FIG. 12).

TABLE 8-continued

Logical expressions developed from the definitions in Table 6, the information in Table 7, and certain gating functions shown on the circuit diagram, FIG. 9.

$L(s) = R(n) \cdot G + VV$ (using AND gate 247)

$= VV + A \cdot B \cdot WW \cdot XX \cdot E \cdot G \cdot (AA \cdot \overline{Z} + F \cdot Z)$ $E(EE) = E(DD) = R(n) \cdot G = A \cdot B \cdot WW \cdot XX \cdot E \cdot G \cdot (AA \cdot \overline{Z} + F \cdot Z)$ $T(FF) = DD$ $K(FF) = O$ $J(FF) = GG$ $SS = RR + R(n) \cdot G \cdot DD \cdot (BB + HH + FF)$ (using NAND gates 248 and 250, and NOR gates 252 and 254, and inverter 256)

$E(j) = R(n) \cdot G \cdot EE$

TABLE 9

Contents of the Delta-Demodulation Read-Only Memory 184A

The information below is identical to that contained in Table 4, but written in binary form. Note also that negative values of $f(\Delta_i, \Delta_{i-1})$ are expressed in two's complement form.

| $\Delta_i$ | | $\Delta_{i-1}$ | | $f(\Delta_i, \Delta i\text{-}1)$ | | | |
|---|---|---|---|---|---|---|---|
| LSB $A_0$ | MSB $A_1$ | LSB $A_2$ | MSB $A_3$ | MSB $B_0$ | $B_1$ | $B_2$ | LSB $B_3$ |
| 0 | 0 | 0 | 0 | 1 | 1 | 0 | 1 |
| 0 | 0 | 0 | 1 | 1 | 1 | 1 | 1 |
| 0 | 0 | 1 | 0 | 1 | 1 | 0 | 1 |
| 0 | 0 | 1 | 1 | 1 | 1 | 1 | 1 |
| 0 | 1 | 0 | 0 | 0 | 0 | 0 | 0 |
| 0 | 1 | 0 | 1 | 0 | 0 | 0 | 1 |
| 0 | 1 | 1 | 0 | 0 | 0 | 0 | 0 |
| 0 | 1 | 1 | 1 | 0 | 0 | 0 | 1 |
| 1 | 0 | 0 | 0 | 1 | 1 | 1 | 1 |
| 1 | 0 | 0 | 1 | 0 | 0 | 0 | 0 |
| 1 | 0 | 1 | 0 | 1 | 1 | 1 | 1 |
| 1 | 0 | 1 | 1 | 0 | 0 | 0 | 0 |
| 1 | 1 | 0 | 0 | 0 | 0 | 0 | 1 |
| 1 | 1 | 0 | 1 | 0 | 0 | 1 | 1 |
| 1 | 1 | 1 | 0 | 0 | 0 | 0 | 1 |
| 1 | 1 | 1 | 1 | 0 | 0 | 1 | 1 |

Referring now more particularly to FIG. 12, a timing diagram of the continuous relationship of the four clock functions C, A, H, and U is shown. They are never gated off. The clock inputs of most of the counters and flip-flops in the circuit connect to one of these lines. FIG. 12 also shows the time, relative to the function A, at which a number of the more important counters and flip-flops are allowed to change state. It will be noticed that the counters 180 and 196, the values of whose outputs are p and j respectively, are clocked on a version of $\overline{C}$ which is delayed by 300 nanoseconds. The reason for this delay is to satisfy a requirement of the type SN 74163 counters that high to low transitions are not made at the enable inputs while the clock input is high.

In principle, the information in Tables 6 through 9, along with knowledge of the contents of the read-only memories 104, 106, 108, and 114, and the circuit diagram of FIGS. 11*a*–11*f* should enable one to follow the state of the machine, given any initial state. The following discussion of timing diagrams for some simplified cases will aid in understanding the operation of the device.

The option of ½ period zeroing creates a considerable complication of the logic equations. Therefore, as a first example, suppose that $Z=0$ always. Then the following relations are true:

| | | |
|---|---|---|
| E(k) | = | A · WW |
| E(F) | = | 0 so that F = 0 always |
| K(AA) | = | A · B · WW |
| J(AA) | = | A · B · WW · ( $\overline{XX}$ + $\overline{E}$ + $\overline{AA}$ ) |
| | | The effect of the above is as though we had: |
| J(AA) = K(AA) = E(AA) | = | A · B · WW |
| E(m) | = | A · B · WW · AA |
| R(m) = E(n) = D(W) | = | A · B · WW · AA · XX |
| | | Note that E(p) is the same as this but delayed by one clock period |
| R(n) = E(s) = D(X) | = | A · B · WW · AA · XX · E |
| | | Note that L(p) is the same as this but delayed by one clock period |
| E(EE) = E(DD) | = | A · B · WW · AA · XX · E · G |
| L(s) | = | A · B · WW · AA · XX · E · G + VV |
| E(j) | = | A · B · WW · AA · XX · E · G · EE |
| SS | = | A · B · WW · AA · XX · E · G · DD + RR |

FIG. 13 illustrates some of the waveforms which would occur if an imaginary word with the following properties were spoken:

| | | | | | |
|---|---|---|---|---|---|
| First Syllable: | | | | | |
| first phoneme: | m' = 2 | n' = 4 | Z = 0 | G = 0 | Y = 0 |
| second phoneme: | m' = 3 | n' = 5 | Z = 0 | G = 0 | Y = 0 |
| third phoneme: | m' = 1 | n' = 8 | Z = 0 | G = 1 | Y = 0 |
| Second Syllable: | | | | | |
| first phoneme: | m' = 2 | n' = 3 | Z = 0 | G = 0 | Y = 0 |
| second phoneme: | m' = 1 | n' = 10 | Z = 0 | G = 1 | Y = O |

For the purpose of this discussion it is assumed that the word/sentence switch 166 is in the "word" position. Note that the time scale in FIG. 11 changes as one moves from top to bottom. Some of the waveforms are plotted for two different time scales to improve clarity.

Using FIGS. 11*a*–11*f* and 13 to illustrate this example, the operation of the start synchronizer 212 is such that when the start button is depressed, exactly one pulse of its clock, U, is output at line VV. Line VV is connected to the reset inputs of the flip-flops 182, 198, 216, 220, 230, and 232, and the counters 202 and 204. The counter 200 is also set to its lowest state, 0100, since VV activates its load input through a NOR gate 258. As time advances, k runs from 0100 to 1111 to produce the twelve possible values of the 4 least significant bits of the twelve-bit address of the phoneme read-only memory 104. These twelve values combine with the 256 possibilities associated with the 8 most significant bits of the twelve-bit address, to produce addresses of the $256\times12=3072$ 8-bit words in the phoneme read-only memory 104.

VV is also applied to the set input of the flip-flop 226, the load input of the counter 196, and activates the load input of the counter 178 through a NOR gate 260. The end of the pulse at VV, which occurs just after the rising edge of clock C, is defined as time $t=0$ in FIG. 13. Subsequent times indicated in the figure are measured in units of the period of the system clock C. At time $t=0$, $k=0100$, $AA=0$, $m=00$, $n=0000$, $F=0$, $WW=1$, $X=1$, $DD=0$, and $EE=0$, and the number at the output of the word read-only memory 108 is loaded into the counter 178. Since for this example the word/sentence switch 166 is supposed to be in the "word" position, the number loaded into the counter 178 will be the address in the syllable read-only memory 106 of the first syllable of the word addressed in the word read-only memory 108 by the seven address switches 168. Within about two microseconds (the access time of the type MM5202Q read-only memory used in the synthesizer), the output of the syllable read-only memory 106 will give the numbers p', Y, G, Z, m'−1, and n'−1, which correspond to the first phoneme of the first syllable of the word which the synthesizer is going to say.

In this example, $m'=2$, $n'=4$, $Z=0$, $Y=0$, and $G=0$. Since $X=L(p)=1$, and $T(p)=\overline{C}_d$, the number p' will be loaded into counter 180 at $t=\frac{1}{2}+300$ nanoseconds. About two microseconds later, the first four values of 2-bit delta-modulated amplitude information for the first phoneme of the first syllable of the word will appear at the output of the phoneme read-only memory 104. These 8 bits are loaded into the output shift register 176 on the next rising edge of the system clock, which occurs at $t=1$. Since $D(X)=A\cdot B\cdot WW\cdot AA\cdot XX\cdot E=0$ at $t=1$, X goes to zero also at this time. Perusal of the logic equations developed above for the case $Z=0$ shows that the next time any of the counters 200, 202, 204, 180, or 178, or the flip-flop 198 is allowed to change state is at $t=8$, when $E(k)=A\cdot WW=1$. At that time k will change from 0100 to 0101 and the next 8 bits will be available at the output of the phoneme read-only memory 104. These are loaded into the output shift register 176 at $t=9$.

Thus, a continuous stream of bits is available at the output of the shift register 176. The process continues in this manner, with k advancing every 8 clock pulses until $t=96$ when $k=1111$. At $t=96$, 96 bits of data have been clocked from the phoneme read-only memory 104 through the output shift register 176, to supply the delta-modulation decoder circuit 184 with forty-eight, two-bit pieces of amplitude information, which is one-half a pitch period of sound. At $t=96$, $E\ (AA)=A\cdot B\cdot WW=1$ and $L(k)=1$, so that at $t=96_+$, $AA=1$ and $k=0100$.

The next 96 clock pulses cause k to cycle again from 0100 to 1111, and thereby to supply 96 more bits of data to the delta-modulation decoder circuit, which completes one pitch period of sound. At $t=192$, $k=1111$ and $AA=1$, so that $E(m)=A\cdot B\cdot WW\cdot AA=1$, as well as $E(AA)=E(k)=1$ as before. Thus at $t=192_+$, $k=0100$, $AA=0$, and $m=01$. The phoneme read-only memory 104 address is the same as it was at $t=0_+$, so that the next 192 clock pulses will produce the same output bit pattern as was delivered to the delta-modulation decoder circuit 184 during the first 192 clock pulses.

At $t=384$, a new situation arises. Since $m'=2$, the number stored in bits 11 and 12 of the syllable read-only memory 106 is 01. This number is compared with m by the comparator 218, and the result of the comparison is output as XX. Since now $m=01$, $XX=1$, and threfore $R(m)=E(n)=D(W)=1$. Thus, with the rising edge of the clock pulse at $t=384$, counter 202 will be reset and the counter 204 will advance so that at $t=384_+$, $k=0100$, $AA=0$, $m=00$, $n=0001$, and $W=1$. Since $W=E(p)=1$, the counter 180 whose output is p, will advance during this clock period on the rising edge of $\overline{C}_d$. This means that a new set of one-hundred and ninety-two bits of data will next be read out of the phoneme read-only memory 104. Thus, one pitch period of data has been generated, it has been repeated once, and the machine is now starting to play a third pitch period which is different from the first two. This routine continues with n and p advancing at $t=768_+$ and $t=1152_+$.

At $t=1536$, $n=0011$, and a new situation again arises, after having thus far played a total of 8 pitch periods of data comprised of 4 pitch periods of data from the phoneme read-only memory 104 which have each been played twice. Since $n'=4$, now $n'-1=0011$, which is equal to n and therefore $E=1$, so that $R(n)=D(X)=E(s)=1$. Thus at $t=1536_+$, $k=0100$, $AA=0$, $m=00$, and $W=1$ as usual. In addition $n=0000$, $X=1$, and the counter 178, whose output is s, advances by one count. The machine is now in the same state as at $t=0_+$ except that the counter 178 is addressing the second phoneme of the first syllable of the word, so that new values of p', Y, G, Z, m', and n' are present. For this phoneme, according to the example, $m'=3$, $n'=5$, $Z=0$, $Y=0$, and $G=0$. Therefore this phoneme will be played in the same manner as the previous one except that 15 pitch periods of sound will be generated from three repetitions of each of five pitch periods of data taken from the phoneme read-only memory 104. This process will be completed at $t=4416$.

At $t=4416_+$, the counter 178 will have advanced, and the parameters for the third phoneme of the first syllable will be output from the syllable read-only memory 106. They are $m'=1$, $n'=8$, $Z=0$, $Y=0$, and $G=1$. This pheneme will be played in the same manner as the first and the second. At $t=5951_+$ a new situation again arises. Since $G=1$, $E(DD)=E(EE)=A\cdot B\cdot WW\cdot AA\cdot XX\cdot G=1$. Since the flip-flop 182 is clocked on the delayed inverted system clock $\overline{C}_d$, EE goes to 1 at $t=5951.5+300$ nanoseconds. This changes the least significant bit of the address of the word read-only memory 108 from 0 to 1. About 2 microseconds later (the access time for the type MM5205Q read-only memory used), the address of the first phoneme of the second syllable of the word originally addressed in the word read-only memory 108 is present at the data input of the counter 178. Note that since flip-flop 230 has as its clock input waveform C, DD goes to 1 at $t=5952_+$. Since $L(s)=1$ at $t=5952$, the address is loaded into the counter 178 at $t=5952_+$.

Thus, at $t=5952_+$ the state of the machine is the same as it was at $t=0_+$, except that the syllable read-only memory 106 now outputs the parameters for the first phoneme of the second syllable of the word being played. Since $G=0$ for this phoneme, it is played in the usual manner, and the machine goes onto the second phoneme. The second phoneme has $G=1$ so that at $t=9024$, after the second phoneme has been played, $DD=1$ and $G=1$, so that $SS=RR+A\cdot B\cdot WW\cdot AA\cdot XX\cdot E\cdot G\cdot DD=1$. But $SS=J(\overline{WW})$, thus at $t=9024_+$, $WW=0$. This puts the synthesizer in its stopped mode. It will remain stopped indefinitely until the start button is again depressed.

The next waveform analysis will consider the case in which the synthesizer produces the sentence comprised of the numbers from "one" to "forty". This analysis will utilize the contents of the read-only memories 104, 106, 108, and 114, the logic relations given in Tables 6 through 9, and the circuit diagram of FIGS. 11a–11f. This example will illustrate ½-period zeroing, as well as the operation of the sentence read-only memory 114. The waveforms appropriate to this discussion are shown in FIG. 14.

The initial address of this sentence in the sentence read-only memory 114 is 00000000. Therefore the seven address switches 168 must be either manually or automatically set to supply the binary address $a=0000000$. Since the least significant bit of the eight-bit data input of counter 196 is connected to logic zero, sentences may only start at even numbered addresses in the sentence read-only memory 114. To produce a sentence, the word/sentence switch 166 must also be set in the "sentence" position.

The word "one" has the following structure:

| | | | | | |
|---|---|---|---|---|---|
| First Syllable: | | | | | |
| first phoneme: | m' = 1 | n' = 10 | Z = 0 | Y = 1 | G = 0 |
| second phoneme: | m' = 3 | n' = 13 | Z = 1 | Y = 0 | G = 1 |
| Second Syllable: | | | | | |
| first phoneme: | m' = 1 | n' = 1 | Z = 0 | Y = 1 | G = 1 |

That is, the first phoneme of the first syllable consists of ten pitch periods of silence, the second phoneme of the first syllable consists of thirteen pitch periods of data, each of which is repeated three times, for a total of thirty-nine pitch periods of sound. Note that ½ period zeroing is used. The second syllable consists of one phoneme which is one pitch period of silence.

We next develop a list of relations from Table 8 which are true for the special case $Z=1$:

$$
\begin{aligned}
E(F) &= A\cdot B\cdot WW\\
E(m) &= A\cdot B\cdot WW\cdot F\\
R(m) = E(n) = K(AA) &= A\cdot B\cdot WW\cdot F\cdot XX\\
J(AA) &= A\cdot B\cdot WW\cdot F\cdot XX\cdot \overline{E}\\
D(W) &= A\cdot B\cdot WW\cdot F\cdot XX\cdot AA\\
E(s) = R(n) = D(X) &= A\cdot B\cdot WW\cdot F\cdot XX\cdot E\\
E(DD) = E(EE) &= A\cdot B\cdot WW\cdot F\cdot XX\cdot E\cdot G\\
L(s) &= A\cdot B\cdot WW\cdot F\cdot XX\cdot E\cdot G + VV\\
E(j) &= A\cdot B\cdot WW\cdot F\cdot XX\cdot E\cdot G\cdot EE
\end{aligned}
$$

The sentence generation process is started as before by the start pulse appearing on VV after the start switch 174 is closed. The resetting operation is the same except that now note that $L(j)=VV$ so that at $t=-3$ the number a set into the address switches 168 is loaded into the seven most significant bits of counter 196. Thus at $t=3_+$, $j=00000000$. The content of word 00000000 in the sentence read-only memory 114 is 00000010. The least significant bit of this number is the sentence stop bit GG which is set equal to 1 for the last word in the sentence; note that $GG=0$. The seven most significant bits are transferred to the seven most significant bits of the address input of the word read-only memory 108 through the data selector 170. The least significant bit of this address, EE, equals zero since VV is connected to the asynchronous reset input of the flip-flop 182. Thus, the word read-only memory 108 has as its address 00000010.

The content of address 00000010 in the word read-only memory 108 is 00000001, which now appears at the data input of counter 178. Since $L(s)=1$ when $VV=1$, at $t=-2_+$ the number 00000001 is loaded into counter 178 so that $s=00000001$. The content of this address in the syllable read-only memory 106 is 00000001 00001001. Thus $p'=0000000$, $y=1$, $G=0$, $Z=0$, $m'=1$, and $n'=10$. Since $Y=1$, $D(V)=\overline{VV}+F+Y=1$, and V will be set equal to 1 after the next rising edge at T(V) which occurs at $t=-\frac{1}{2}$. The situation at $t=0$ is similar to that in the previous example except that now $V=1$. Since neither Y nor V is involved in the gating to the control counters 178, 180, 196, 200, 202, or 204, or flip-flop 198, and since $Z=0$, the phoneme will be played in the same manner as was described before, with a total of $m'\times n'=$ten pitch periods of sound being generated with $V=1$ during that time. But V is the logic waveform on the control line of the analog switch 188, which switches the input of the filter amplifier 190 between the output of the digital to analog converter 186 and a reference level equal to the average value of the output of the digital to analog converter. Thus, even though ten pitch periods of data are played from the phoneme read-only memory 104, ten pitch periods of silence appear as the output of the loudspeaker 192.

The next time of interest is $t=1920$, when $R(n)=E(s)=D(X)=1$. At $t=1920_+$, the counter 178 advances, and the parameters for the second phoneme of the first syllable of the first word of the sentence are available at the output of the syllable read-only memory 106. These are: $p'=0000100$, $Y=0$, $G=1$, $Z=1$, $m'=3$ and $n'=13$. Since Y now equals zero, V will be clocked at zero at the next rising edge of H, which occurs at $t=1921.5$. The playing out of this phoneme with $Z=1$ proceeds in the same way as for a phoneme for which $Z=0$ until $t=2016$, when $k=1111$ and $E(F)=A\cdot B\cdot WW=1$. At $t=2016_+$, $k=0100$, $F=1$, and $D(V)=\overline{WW}+Y+F=1$. Hence, V is set to 1 after 1.5 clock periods. Since AA has not changed while k has been reset to 0100, the next 96 bits of data latched out of the phoneme read-only memory 104 are a repetition of the previous 96 bits, but with the analog switch 188 set to the constant level rather than to the output of the digital to analog converter 186.

Thus we have used half of a pitch period of data from the phoneme read-only memory 104 to produce half a pitch period of sound and half a pitch period of silence. As explained above, this is called $\frac{1}{2}$ period zeroing.

At $t=2112$, $F=1$ and $E(m)=A\cdot B\cdot WW\cdot F\cdot=1$, in addition to $E(f)=A\cdot B\cdot WW=1$. Thus at $t=2112_+$, $F=0$ and $m=01$. During the next 192 clock periods a repetition of the data of the previous 192 clock periods is generated to give a repetition of the same $\frac{1}{2}$ period zeroed waveform. At $t=2496$, This waveform has been repeated three times and $m=11$. Since $m'-1=11$, $D=1$, and $R(m)=E(n)=K(AA)=A\cdot B\cdot WW\cdot F\cdot XX=1$, and $J(AA)=A\cdot B\cdot WW\cdot F\cdot XX\cdot\overline{E}=1$. Thus at $t=2496_+$, $m=00$, $n=0001$, and $AA=1$. The phoneme address in the fifth least significant bit has now advanced to that new data from the phoneme read-only memory 104 are being used. The next three pitch periods will therefore be three repetitions of a new $\frac{1}{2}$ period zeroed waveform.

At $t=3072$, the situation will be the same as at $t=2496$, except now $AA=1$, so that $D(W)=A\cdot B\cdot WW\cdot F\cdot XX\cdot AA=1$ and p will be advanced in the same way described previously. Note that n advances when AA changes, so the number $m'\times n'$ is the number of pitch periods of sound produced, just as for the case $z=0$. At $t=9408$, when a total of $3\times 13=39$ pitch periods of this phoneme have been produced, $n=1100$, so that $n=n'-1$ and $E=1$, causing $E(s)=R(n)=D(X)=1$. Thus at $t=9408_+$n will be set zero, s will advance and XX will be set to 1. The new value of p' will thus be loaded into counter 180 on the next rising edge of $\overline{C}_d$.

Attention should be drawn to a special situation which occurs here: since the number n' is odd for this example, AA will equal 0 at $t=9408$. Normally the flip-flop 198 would be toggled at $t=9408_+$ and so the next phoneme would start with $AA=1$, which is incorrect. To prevent this condition, an exclusive OR gate 244 is used to generate the function $J(AA)=A\cdot B\cdot WW\cdot F\cdot XX\cdot\overline{E}$. This ensures that AA is set to zero whenever n is set to zero.

Since this is the last phoneme of the current syllable, $G=1$, and the counter 178 will be loaded with the starting address of the second syllable. This occurs just as in the case when $Z=0$, with $E(DD)=E(EE)=L(s)=1$ at $t=9407_+$, $EE$ going to 1 at $t=9407.5+300$ nanoseconds, and $DD=1$ at $t=9408_+$. Note that since $E(j)=A\cdot B\cdot WW\cdot F\cdot XX\cdot E\cdot G\cdot EE$, and $T(j)=\overline{C}_d$, j does not advance at this time.

The new value of s is 10000011 or decimal 131. The contents of this entry in the syllable read-only memory 106 are: $p'0000000$, $Y=1$, $G=1$, $Z=0$, $m'=1$, $n'=1$. This phoneme will play one pitch period of silence. Since $G=1$, this will be the last phoneme of the word and at $t=9599_+$, $E(j)=1$ since $EE=1$. Counter 196 is clocked on $\overline{C}_d$, so j will advance at $t=9599.5+300$ nanoseconds, and at $t=9600$ the process begun at $t=0$ will be repeated except that the word read-only memory 108 input address will be that specified by the second word in the sentence read-only memory 114, so that the next word spoken will be "two". In this manner the synthesizer will continue to say the numbers from "one" to "forty".

The following discussion concerns the operation of the stop bit, GG, in the sentence read-only memory 114. Referring now more particularly to FIG. 15, suppose at $t=-\frac{1}{2}$, the counter 196 is advanced, and that the new word addressed by the sentence read-only memory 114 has $GG=1$ so that it is to be the last word in the sentence. For simplicity, we will also assume that both syllables of this word consist of one phoneme which is one pitch period long. At $t=-1$, $EE=DD=1$ because we are in the second syllable of a word. $FF=0$ because $VV$ is input to the asynchronous reset input of the flip-flop 232, and GG has been zero since the start of the sentence. At $t=-\frac{1}{2}+300$ nanoseconds, the counter 196 is advanced and GG becomes 1 about two microseconds later. At $t=0_+$, the falling edge of waveform DD clocks the flip-flop 232 so that $FF=1$, since GG is now 1. At $t=384$, the last phoneme of the second syllable will have been played, and so $L(s)=1$. Thus $SS=RR+R(n)\cdot G\cdot DD\cdot(BB+HH+FF)=1$, so that $WW=0$ at $t=384_+$ and the machine is in its stopped state.

The above discussion has illustrated how the synthesizer produces a continuous stream of data bits at the output of shift register 176. The delta-modulation decoder circuit 184 implements the algorithm described in Table 4 and its discussion to produce a speech waveform. In FIG. 16 are shown some of the waveforms involved in this process. It is assumed that $t=0$ is the start of a new pitch period of sound. At $t=1$, the first eight-bit data byte of this pitch period is loaded from the phoneme read-only memory 104 into the output shift register 176. Thus at $t=1_+$, $\Delta_1$, the first value of $\Delta_i$ for this pitch period, is available to the delta-modulation decoder read-only memory 184A. The value of $\Delta_i$ for the previous digitization would normally be taken from the two bits of the shift register 236, but since this is the first digitization of the pitch period, there is no previous value and the initial value, $\Delta_0=10$, is selected as explained in the previous discussion of delta modulation. This is accomplished by gating a 1 into the input $A_3'$ of the delta-modulation decoder read-only memory 184A by the type D flip-flop 184B and the NOR gate 184C.

The least significant bit is set equal to zero since the waveform I, the output of the flip-flop 184B, is present at the load input of shift register 236. The flip-flop 184B also sets the initial value of the previous output level $v_0=0111$, through the action of NAND gates 184D, 184E, and 184F, and the NOR gate 184G. The sixteen four-bit numbers stored in the delta-modulation decoder read-only memory 184A are the values of the function $f(\Delta_{i-1}, \Delta_i)$, for all the possible input values of $\Delta_{i-1}$ and $\Delta_i$. These numbers are listed in Table 9. The output of the delta-modulation decoder read-only memory 184A is connected to one of the inputs of the four-bit adder 184H. The other input of the adder 184H is connected (through the gates 184D, 184E, 184F, and 184G which provide the initial value of $v_i$) to the output of the latch 184I, which stores the current value of the output waveform $v_i$. Subtractions as well as additions are performed by the adder 184H by representing the negative values of f in two's complement form.

At $t=1$, the first value of I, based on $\Delta_1$ and $\Delta_0$ is presented to adder 184H along with the initial value of $v_i$, $v_0=0111$. Thus the first value of the output waveform, $v_1$, appears at the $\Sigma$ output of the adder 184H. This value is clocked into latch 184I at $t=1.5$ by waveform H. The digital to analog converter 186 converts this data into the first analog level of the pitch period. This is consistent with the fact that the analog switch 188 changes state at $t=1.5$. At $t=3_+$, the output shift register 176 has been shifted by two bits, so the next value of $\Delta_i$, $\Delta_2$, is available, and the previous value has been shifted to $\Delta_{i-1}$. Thus at $t=3.5$, the output of the adder 184H equals $f_2+v_1=v_2$, and this number is transferred to the output of latch 184I at $t=3.5_+$. This process is continued until the start of the next pitch period when the system is again initialized by the flip-flop 184B.

The speech waveform coming from the output of the analog switch 188 is amplified by filter amplifier 190 and is coupled to the loudspeaker 188 by a matching transformer 262. Elements in a feedback loop operational amplifier 190A give a frequency response which rolls off about 4500 Hertz and below 250 Hertz to remove unwanted components at the period repetition, half-period zeroing, and digitization frequencies.

The operational amplifier 194A, the comparator 194B and the associated discrete components of the clock modulator circuit 194 form an oscillator which produces a 3 Hertz triangle wave output. This signal is applied to the modulation input of the 20 kHz system clock, C, which breaks up the monotone quality which would otherwise be present in the output sound. Another feature of the preferred embodiment of the invention is the presence of a "raise pitch" switch 264 and a "lower pitch" switch 266 which, with a resistor 268 and a capacitor 270, change the values of the timing components in the clock oscillator circuit by about 5%, and thus allow one to manually or automatically introduce inflections into the speech produced.

A further feature of the invention is a stop switch 228, the closing of which sets $BB=1$, and thus causes the machine to go into the "stopped" state at the end of the word currently being spoken. This happens because $SS=RR+R(n)\cdot G\cdot DD\cdot(BB+HH+FF)$.

While specific electronic circuitry has been described above for carrying out the method of the preferred embodiment of the invention it should be apparent that in other embodiments, other logic circuitry could be used to carry out the same method. Furthermore, although no specific logic circuitry has been described for automatically programming the memory units of the speech synthesizer, such circuitry is within the skill of the art given the teachings of the basic synthesizer in the description above.

For the sake of simplicity in this description, the automatic circuitry required to close certain of the switches, such as the start switch 174 and the address swigches 168, for example, has been omitted. It will, of course, be understood that in certain embodiments these switches are merely representative of the outputs of peripheral apparatus which adapt the speech synthesizer of the invention to a particular function, e.g., as the spoken output of a calculator.

For simplicity, the previous hardware description of the preferred embodiment has not included handling of the symmetrized waveform produced by the compression scheme of phase adjusting. Instead, it was assumed that complete symmetrized waveforms (instead of only half of each such waveform) are stored in the phoneme memory 104. It is the purpose of the following discussion to incorporate the handling of symmetrized waveforms in the preferred embodiment.

This result may be achieved by storing the output waveform of the delta modulation decoder 184 of FIG. 10 in either a random access memory or left-right shift register for later playback into the digital to analog converter 186 during the second quarter of each period of each phase adjusted phoneme. The same result may also be achieved by running the delta modulation decoder circuit 184 backwards during the second quarter of such periods because the same information used to generate the waveform can be used to produce its symmetrized image. In the operation of the circuitry of the preferred embodiment in this manner, the control logic 172, the output shift register 176, and the delta modulation decoder 184, of FIG. 10 must be modified as is described below, for each half period zeroed phoneme (since half period zeroing and phase adjusting always occur together). Phonemes which are not half period zeroed do not utilize the compression scheme of phase adjusting. For such phonemes the operation of the circuitry of the preferred embodiment remains the same as described above.

When half period zeroing and phase adjusting are used, the 96 four-bit levels which generate one pitch period of sound are divided into three groups. The first 24 levels comprise the first group and are generated from 24 two-bit pieces of delta modulated information. This information is stored in the phoneme memory 104 as six consecutive 8-bit bytes which are presented to the output shift register 176 by the control logic 172 and are decoded by the delta modulation decoder 184 to form 24 four-bit levels. The operation of the circuitry of the preferred embodiment during the playing of these first 24 output levels is unchanged from that described above. The next 24 levels of the output comprise the second group and are the same as the first 24 levels, except that they are output in reverse order, i.e., level 25 is the same as level 24, level 26 is the same as level 23, and so forth to level 48, which is the same as level 1. To perform this operation, the previously described operation of the circuit of FIG. 10 is modified. First, the control logic 172 is changed so that during the second 24 levels of output, instead of taking the next six bytes of data from the phoneme memory, the same six bytes that were used to generate the first 24 levels are used, but they are taken in the reverse order. Second, the direction of shifting, and the point at which the output is taken from the output shift register 176 is changed such that the 24 pieces of two-bit delta modulation information are presented to the delta modulation decoder circuit 184 reversed in time from the way in which they were presented during the generation of the first 24 levels. Thus, the input of the delta modulation decoder 184 at which the previous value of delta modulation information was presented during the generation of the first 24 levels has, instead, input to it, the future value. Third, the delta modulation decoder 184 is changed so that the sign of the function $F(\Delta_{i-1},\Delta_i)$ described in Table 4 is changed. With these modifications, the delta demodulator circuit 184 will operate in reverse, i.e., for an input which is presented reversed in time, it will generate the expected output waveform, but reversed in time. This process can be illustrated by considering the example of Table 10, for the case where the changes to the output shift register 176, and the delta modulation decoder 184 described above have been made. Referring to Table 10, suppose that digitization 24 is the 24th output level for a phoneme in which half period zeroing and phase adjusting are used. Since the amplitude of the reconstructed waveform for this digitization is 9, the 25th output level will again have the value 9. Subsequent values of the output will be generated from the same series of 24 values of $\Delta_i$, but taken in reverse order, and with the modifications to the delta modulation algorithm indicated above. Thus for the 26th output level, Table 10 gives $\Delta_i=3$ and $\Delta_{i-1}=3$. Table 4 gives $f(\Delta_{i-1},\Delta_i)=3$ for this case. Since one of the modifications to the delta modulation decoder 184 is to change the sign of $f(\Delta_{i-1},\Delta_i)$, the 26th output level is $9-3=6$. For the 27th output level, Table 10 gives $\Delta_i=3$ and $\Delta_{i-1}=2$. Applying the appropriate value of $f(\Delta_{i-1},\Delta_i)$ from Table 4 shows the 27th output level to be $6-3=3$. This process can be continued to show that the second 24 output levels will be the same as the first 24 levels, but reversed in time.

TABLE 10

| Example of a Quarter Period of Delta Modulation Information and the Reconstructed Waveform | | |
|---|---|---|
| Digitization | Delta Modulation Information (decimal) | Amplitude of Reconstructed Waveform |
| 1 | 3 | 10 |
| 2 | 3 | 13 |
| 3 | 2 | 14 |
| 4 | 2 | 15 |
| 5 | 1 | 15 |
| 6 | 1 | 14 |
| 7 | 0 | 11 |
| 8 | 0 | 8 |
| 9 | 0 | 5 |
| 10 | 1 | 4 |
| 11 | 3 | 5 |
| 12 | 2 | 6 |
| 13 | 3 | 9 |

TABLE 10-continued

| Example of a Quarter Period of Delta Modulation Information and the Reconstructed Waveform | | |
|---|---|---|
| Digitization | Delta Modulation Information (decimal) | Amplitude of Reconstructed Waveform |
| 14 | 3 | 12 |
| 15 | 0 | 11 |
| 16 | 0 | 8 |
| 17 | 0 | 5 |
| 18 | 1 | 4 |
| 19 | 1 | 3 |
| 20 | 1 | 2 |
| 21 | 2 | 2 |
| 22 | 2 | 3 |
| 23 | 3 | 6 |
| 24 | 3 | 9 |

For the case in which half period zeroing and phase adjusting are used, the last 48 output levels of each pitch period are always set equal to a constant. The operation of the circuitry of the preferred embodiment which accomplishes this is the same as described previously.

The terms and expressions which have been employed here are used as terms of description and not of limitations, and there is no intention, in the use of such terms and expressions, of excluding equivalents of the features shown and described, or portions thereof, it being recognized that various modifications are possible within the scope of the invention claimed.

What is claimed is:

1. A method of analyzing speech information comprising the steps of time quantizing the amplitude of electrical signals representative of selected speech information into digital form, selectively compressing the time quantized signals by discarding selected portions thereof while substantially simultaneously generating instruction signals as to which portions have been discarded, and storing both the compressed signals and instruction signals, wherein said method further includes:

(a) time differentiating the electrical signals prior to the time quantizing step and the signal compressing and storing steps include the steps, (b) selecting signals representative of certain phoneme and phoneme groups from the time quantized signals and replacing portions of these selected signals corresponding to parts of the pitch periods of the certain phonemes and phoneme groups by a constant amplitude signal while generating instruction signals as to which phonemes and phoneme groups have been so selected, (c) selecting signals representative of certain phonemes and phoneme groups from the time quantized signals and storing only portions of these selected time quantized signals corresponding to every nth pitch period of the waveform of the original speech information electrical signal, and storing instruction signals as to which phonemes and phoneme groups have been so selected and storing instruction signals as to the values of n, (d) separating and storing the time quantized signals representative of spoken words into two or more parts, with such parts of later words that are identical to parts of earlier words being deleted from storage while instructions signals as to which parts are deleted are stored, (e) storing portions of the time quantized signals corresponding to selected phonemes and phoneme groups according to their ability to blend naturally with any other phoneme, the selected phonemes and phoneme groups including voiced and unvoiced fricatives, voiced and unvoiced stop consonants, and nasal consonants, (f) delta-modulating the time quantized signals, and (g) Mozer phase-adjusting a selected periodic waveform by Fourier transforming the time quantized signals to generate a set of discrete amplitudes and phase angles, adjusting these phase angles so that the inverse Fourier transformation of the amplitudes and new phases is symmetric, inverse Fourier transforming the phase adjusted amplitudes and phases, storing one-half of a selected waveform as representative of each discrete set of phase adjusted amplitudes and phases and discarding the other half of the selected waveform.

2. A method of analyzing speech as recited in claim 1, wherein the step of delta modulating the digital signals prior to storage comprises setting the value of the ith digitization of the sampled signal equal to the value of the (i−1)th digitization of the sampled signal plus $f(\Delta_{i-1}, \Delta_i)$ where $f(\Delta_{i-1}, \Delta_i)$ is an arbitrary function having the property that changes of waveform of less than two levels from one digitization to the next are reproduced exactly while greater changes in either direction are accommodated by slewing in either direction by three levels per digitization.

3. A method of analyzing speech as recited in claim 1, further comprising the steps of producing and storing speech waveforms having a constant pitch frequency.

4. A method of analyzing speech as recited in claim 1 further comprising the steps of producing and storing speech waveforms having a constant amplitude.

5. A method of analyzing speech as recited in claim 1 wherein the Mozer phase adjusting step comprises adjusting for a representative symmetric waveform to have a minimum amount of power in portions of the waveform totalling half of the period being analyzed and such that the difference between amplitudes of successive digitizations during the other half period of the selected waveform are consistent with possible values obtainable from the delta modulation step.

6. A method of analyzing speech as recited in claim 1, further including the step of separately selected portions of the digital signals representative of at least five of the following phonemes and phoneme groups:

| Sound | |
|---|---|
| "elve" as in "twelve" | "ou" as in "hour" |
| "ir" as in "thirteen" | "one" |
| "we" as in "twenty" | "h" as in "hot" |
| "p" as in "plus" | "t" as in "two" |
| "l" as in "plus" | "sh" as in "she" |
| "m" as in "minus" | "oo" as in "two" |
| "n" as in "one" | "th" as in "three" |
| "u" as in "minus" | "ree" as in "three" |
| "im" as in "times" | "f" as in "four" |
| "ver" as in "over" | "our" as in "four" |
| "ua" as in "equals" | "ive" as in "five" |
| "oi" as in "point" | "s" as in "six" |
| "vol" as in "volts" | "v" as in "volt" |
| "o" as in "ohms" | "i" as in "six" |
| "a" as in "and" | "k" as in "six" |
| "d" as in "and" | "ev" as in "seven" |
| "u" as in "up" | "eigh" as in "eight" |
| "il" as in "miles" | "i" as in "nine" |
| "ou" as in "pounds" | "el" as in "eleven" |
| "th" as in "the" | "we" as in twelve" |

-continued

| Sound |
|---|
| "z" as in "zero" |

7. A method of analyzing speech as recited in claim 1, further comprising the step of storing digital signals representative of dipthongs as individual phoneme groups.

8. A method of analyzing speech comprising the steps of generating electrical signals representative of the spoken vocabulary words and portions of spoken vocabulary words of a predetermined finite vocabulary with the vocabulary words being included into units containing a plurality of phonemes or phoneme groups, time quantizing the amplitude of the electrical signals into digital form, selectively compressing the time quantized signals by discarding selected portions of them while substantially simultaneously generating instruction signals as to which portions have been discarded, and storing selected portions of the digital signals representative of phonemes and phoneme groups in a first, addressable memory, storing the instruction signals in a second, addressable memory including instruction signals as to the sequence of addresses of the stored phonemes and phoneme groups necessary to reproduce words and sentences of the vocabulary, wherein the signal compressing and storing steps include the following steps:

(a) selecting signals representative of certain phonemes and phoneme groups from the time quantized signals and replacing portions of these selected signals corresponding to parts of the pitch periods of the certain phonemes and phoneme groups by a constant amplitude signal while generating instruction signals as to which phonemes and phoneme groups have been so selected, and (b) Fourier transforming the time quantized signals to generate a set of discrete amplitudes and phase angles, adjusting the phase angles so that the inverse Fourier transformation of the amplitudes and new phases is symmetric, inverse Fourier transforming the phase adjusted amplitudes and phases, storing one-half of a selected waveform as representative of each discrete set of phase adjusted amplitudes and phases and discarding the other half of the selected waveform.

9. A method of analyzing speech as recited in claim 8 wherein in the method further comprises differentiating the electrical signals with respect to time prior to the time quantization step.

10. A method of analyzing speech as recited in claim 8, wherein the signal compressing and storing steps further comprise the steps of selecting and storing in the first memory portions of the digital signals over a repetition period with the sum of the repetition periods having a duration which is less than the duration of the original speech waveform, setting the repetition period equal to the pitch period of the voiced speech to be synthesized and storing every nth pitch period of the waveform.

11. A method of analyzing speech as recited in claim 1, further comprising the steps of selectively retrieving certain of both the stored, compressed signals and the instruction signals, and utilizing the retrieved compressed signals and the instruction signals to reproduce selected speech information.

12. A method of analyzing speech as recited in claim 8, further comprising the steps of selectively reproducing certain words of the vocabulary by retrieving selected instruction signals from the second memory and using the instruction signals to sequentially extract selected portions of the stored digital signals from the first memory, and electromechanically reproducing the selected portions of the digital signals extracted from the first memory as selected audible, spoken words of the vocabulary.

13. A method of analyzing speech as recited in claim 11, further comprising the step of retrieving the digital signals from storage at a variable clock rate such that the pitch frequency of the reproduced speech sound is set at different levels and is made to rise or fall over the duration of speech sound whereby accenting of syllables, elimination of the monotone quality, inflection, and other pitch period variations of the speech synthesized can be reproduced.

14. An improved speech synthesizer of the type having first addressable memory means for storing digital signal representations of analog electrical signals which represent portions of spoken words of a predetermined vocabulary, second addressable memory means for storing first instruction signals as to the addresses in the first memory means of signals representing portions of the vocabulary words, third addressable memory means for storing second instruction signals as to the addresses in the second memory means of the sequences of the first instruction signals necessary to form selected words of the vocabulary, reproduction means responsive to a digital signal output from the first memory means for reproducing these digital signals in audible form, and control logic means wherein the improvement comprises: the first addressable memory means stores digital signal representations of the spoken vocabulary words after having been reduced by predetermined compression techniques and the second addressable memory means further stores compression instruction signals for controlling the operation of the control logic means, the compression instruction signals corresponding to the predetermined compression techniques used to reduce the digital signal representations stored in the first addressable memory means, the control logic means being responsive to the compression instruction signals and modifying the output of first memory means in accordance with the compression instruction signals, and wherein the digital signal representations stored in the first addressable memory means and the corresponding compression instruction signals stored in the second addressable memory means are derived from the following predetermined compression techniques:

(a) the digital signals stored in the first addressable memory means are the time quantization of the derivative with respect to time of analog electrical signals representing the phonemes and phoneme groups which are the constituents of the predetermined vocabulary, (b) the digital signals stored in the first addressable memory means are only selected portions of the digital signals representative of the spoken vocabulary words, with the portions being selected over a repetition period equal to the pitch period of the voiced speech to be synthesized and only those digital signals corresponding to every nth pitch being stored, and the compression instruction signals stored in the second memory means include instruction signals to the control logic means as to the number of times, n, that each such selected portion of data is to be repeatedly extracted from the first addressable memory means before a different signal portion is to be extracted, (c) the compression instruction signals stored by the second addressable memory means include instructions as to the addresses in the first adddressable memory means of digital signals corresponding to phonemes and phoneme groups which naturally blend with any other phoneme and phoneme group, including voiced and unvoiced fricatives, voiced and unvoiced stop consonants, and nasal consonants, (d) selected ones of the digital signals are representative of a predetermined fraction x of the latter part of the analog electrical signal within each pitch period of the spoken word, the compression instruction signals stored in the second memory means including x-period zeroing instruction signals as to the addresses of the selected ones of the digital signals in the first memory means and the control logic means includes means responsive to the x-period zeroing instruction signals for supplying to the reproduction means constant amplitude signals having durations equal to the remaining portions of the waveforms of the voiced phonemes and phoneme groups which are constituents of the predetermined vocabulary, (e) the digital signals are representative of the amplitude of the analog electrical signal over a regular, sampling time interval, the digital signals further being delta modulated by setting the value of the ith digitization of the sampled analog signal equal to the value of the (i−1) the digitization of the sampled analog signal plus $f(\Delta_{i-1}, \Delta_i)$ where $f(\Delta_{i-1}, \Delta_i)$ is an arbitrary function having the property that changes of waveform of than two levels from one digitization to the next are reproduced exactly while greater changes in either direction are accommodated by slewing in either direction by three levels per digitization, (f) the stored digital signals representative of spoken words are separated into two or more parts, and (g) the stored digital signals represent only one symmetric half of one selected waveform obtained by mozer phase adjusting the waveform by Fourier transforming the digital signals to generate a set of discrete amplitudes and phase angles, adjusting the phase angles so that the inverse Fourier transform waveforms are symmetric, and selecting the one waveform as representative of the set of symmetric waveforms, said control logic means including means responsive to receipt of instruction signals specifying digital signals stored in said first addressable memory means as Mozer phase adjusted signals for causing said reproduction means to expand said Mozer phase adjusted signals in audible form.

15. An improved speech synthesizer as recited in claim 14 fabricated on a large scale integrated circuit (L.S.I.) chip.

16. A speech synthesizer as recited in claim 14 wherein the control logic means further comprises means for retrieving the digital signals from the first memory at a variable clock rate such that the pitch frequency of the reproduced speech sound is set at different levels and is made to rise or fall over the duration of speech sound whereby accenting of syllables, elimination of the monotone quality, inflection, and other pitch period variations of the speech synthesized can be reproduced.

17. An improved speech synthesizer of the type having first addressable memory means for storing digital signal representations of analog electrical signals which represent portions of spoken words of a predetermined vocabulary, second addressable memory means for storing first instruction signals as to the addresses in the first memory means of signals representing portions of the vocabulary words, third addressable memory means for storing second instruction signals as to the addresses in the second memory means of the sequences of the first instruction signals necessary to form selected words of the vocabulary, reproduction means responsive to a digital signal output from the first memory means for reproducing these digital signals in audible form, and control logic means for selectively, sequentially extracting the second instruction signals from the third memory means and using these extracted second instruction signals for sequentially extracting selected first instruction signals from the second memory means, and using these extracted first instruction signals to sequentially extract selected digital signals from the first memory means to audibly reproduce selected words of the vocabulary through the reproduction means, wherein the improvement comprises:

the first addressable memory means stores digital signal representations of the spoken vocabulary words after having been reduced by predetermined compression techniques and the second addressable memory means further stores compression instruction signals for controlling the operation of the control logic means, the compression instruction signals corresponding to the predetermined compression techniques used to reduce the digital signal representations stored in the first addressable memory means, the control logic means being responsive to the compression instruction signals and modifying the output of first memory means in accordance with the compression instruction signals, and wherein the digital signal representations stored in the first addressable memory means and the corresponding compression instruction signals stored in the second addressable memory means are derived from the following predetermined compression techniques:

(a) selected ones of the digital signals are representative of a predetermined fraction x of the latter part of the analog electrical signal within each pitch period of the spoken word, the compression instruction signals stored in the second memory means including x-period zeroing instruction signals as to the addresses of the selected ones of the digital signals in the first memory means and the control logic means includes means responsive to the x-period zeroing instruction signals for supplying to the reproduction means constant amplitude signals having durations equal to the remaining portions of the waveforms of the voiced phonemes and phoneme groups which are constituents of the predetermined vocabulary, and (b) the stored digital signals represent only one symmetric half of one selected waveform obtained by Fourier transforming the digital signals to generate a set of discrete amplitudes and phase angles, adjusting the phase angles so that on the inverse Fourier transform waveforms are symmetric, and selecting the one waveform as representative of the set of symmetric waveforms.

18. A speech synthesizer as recited in claim 17 wherein the compression instruction signals stored by the second addressable memory means include instructions as to the addresses in the first addressable memory means of digital signals corresponding to phonemes and phoneme groups which naturally blend with any other phoneme and phoneme group, including voiced and unvoiced fricatives, voiced and unvoiced stop consonants, and nasal consonants.

19. A speech synthesizer as recited in claim 17 wherein the digital signals stored in the first addressable memory means have been delta modulated by setting the value of the ith digitization of the sampled analog electrical signals equal to the value of the (i−1)th digitization of the sampled analog electric signals plus $f(\Delta_{i-1}, \Delta_i)$ where $f(\Delta_{i-1}, \Delta_i)$ is an arbitrary function having the property that changes of waveform of less than two levels from one digitization to the next are reproduced exactly while greater changes in either direction are accommodated by slewing in either direction by three levels per digitization.

20. A speech synthesizer comprising first addressable memory means for storing digital signal representations of electrical signals which represent portions of spoken words of a predetermined vocabulary, all of the digital signals stored in the first memory means being the delta modulated, time quantization of the derivative with respect to time of analog electrical signals representing the phonemes and phoneme groups which are the constituents of the predetermined vocabulary, and the stored digital signals further representing only one symmetric half of one selected waveform obtained by Fourier transforming the delta modulated, time quantized derivative of the analog signals to generate a set of discrete amplitudes and phase angles, adjusting the phase angles so that on inverse Fourier transformation the waveforms are symmetric, and selecting the one waveform as representative of the set of symmetric waveforms, second addressable memory means for storing first instruction signals as to the addresses in the first addressable memory means of signals representing portions of the vocabulary words, third addressable memory means for storing second instruction signals as to the addresses in the second memory means of the sequences of the first instruction signals necessary to form selected words of the vocabulary, reproduction means responsive to the digital signal output of the first memory means for reproducing these digital signals in audible form, and control logic means for selectively, sequentially extracting the second instruction signals from the third memory means and using these extracted second instruction signals for sequentially extracting selected first instruction signals from the second memory means, and using these extracted first instruction signals to sequentially extract selected digital signals from the first memory means to audibly reproduce selected words of the vocabulary through the reproduction means.

21. A speech synthesizer as recited in claim 20 wherein selected ones of the digital signals stored in the first memory means represent only a portion corresponding to part of the pitch period of the waveforms of certain of the voiced phonemes and phoneme groups which are constituents of the predetermined vocabulary; the compression signals stored in the second addressable memory means include x-period zeroing instruction signals as to the addresses of the selected ones of such digital signals in the first addressble memory means and wherein the control logic means includes means responsive to the x-period zeroing instruction signals for supplying to the reproduction means constant amplitude signals having durations equal to the remaining portions of the waveforms of the voiced phonemes and phoneme groups which are constituents of the predetermined vocabulary.

22. A method of compressing information bearing signals such as speech to reduce the information content thereof without destroying the intelligibility thereof, said method comprising the steps of mozer phase adjusting said signals to produce equivalent signals having symmetric portions, and deleting selected redundant portions of said equivalent signals.

23. The method of claim 22 wherein said step of phase adjusting includes the step of transforming said signals to the frequency domain to produce a set of discrete amplitudes and phase angles, adjusting said phase angles so that the inverse transformation of the amplitudes and adjusted phases is at least partially symmetric, and inversely transforming said amplitudes and adjusted phases to the time domain, and wherein said step of deleting includes the step of deleting redundant portions of those partially symmetric portions of said signals resulting from said step of inversely transforming.

24. The method of claim 23 wherein said waveform resulting from said step of adjusting is substantially symmetric; and wherein said step of deleting includes the step of deleting a symmetric half of said symmetric waveform.

25. The method of claim 22 further including the step of time quantizing said signals prior to said step of phase adjusting.

26. The method of claim 22 further including the step of time quantizing said signals after said step of phase adjusting.

27. The method of claim 22 further including the step of time differentiating said signals prior to said step of phase adjusting.

28. The method of claim 22 further including the step of time differentiating said signals after said step of phase adjusting.

29. The method of claim 22 wherein said information bearing signals are speech signals containing portions corresponding to phonemes and phoneme groups, and wherein said method further includes the step of selecting signals representative of particular phonemes and phoneme groups, deleting preselected parts of the phonemes and phoneme groups so selected, and generating first instruction signals identifying the phonemes and phoneme groups so selected.

30. The method of claim 22 further including the steps of separating said signals into at least two parts, deleting parts occurring later in time which are substantially identical to parts occurring earlier in time, and generating instruction signals specifying those parts so deleted.

31. The method of claim 22 further including the step of delta-modulating said equivalent signals.

32. The method of claim 22 further including the step of storing in a memory device the signals resulting from said step of deleting.

33. The method of claim 32 wherein said step of storing is preceded by the step of converting to digital signals said signals resulting from said step of deleting.

34. The method of claim 32 wherein said information bearing signals are speech signals and wherein said step of storing includes the step of storing portions of said signals corresponding to selected phonemes and phoneme groups according to their ability to blend naturally with any other phoneme.

35. A method of synthesizing signals from information signals previously compressed by the technique of phase adjusting original signals to produce equivalent signals having symmetric portions, deleting selected fractional portions of said symmetric portions of said equivalent signals and generating instruction signals identifying the selected fractional portions so deleted, and from said instruction signals, said method comprising the steps of:

(a) reproducing said compressed information signals;
(b) expanding the reproduced signals to supply said fractional portions in accordance with said instruction signals; and
(c) converting the expanded reproduced signals to audible form.

36. The method of claim 35 wherein said compressed information signals are stored in a memory device and wherein said step (a) of reproducing includes the step of reading said compressed information signals from said memory device.

37. The method of claim 36 wherein said compressed information signals are stored in said memory device in digital form and wherein said step (a) of reproducing includes the further step of converting said digital signals to analog signals prior to said step (c) of converting.

38. The method of claim 35 wherein said compressed information signals are delta-modulated signals and wherein said step (a) of reproducing includes the step of delta-modulation decoding said compressed information signals.

39. The method of claim 35 wherein said original signals are audio signals having phonemes and phoneme groups and wherein said information signals are of a type previously compressed by the additional technique of deleting preselected signals representative of portions of particular phonemes and phoneme groups from said audio signals, said preselected signals corresponding to the portions lying between every nth pitch period of said particular phonemes and phoneme groups, and generating additional instruction signals specifying said particular phonemes and phoneme groups and identifying the corresponding values of n, and wherein said step (a) of reproducing includes the step of sequentially repeating each non-deleted signal representative of said particular phonemes and phoneme groups a number of times equal to the corresponding value of n specified by the identifying instruction signal.

40. The method of claim 35 wherein said information signals are of a type previously compressed by the additional technique of separating said original signals into at least two parts and deleting parts occurring later in time which are substantially identical to parts occurring earlier in time, said instruction signals specifying those parts so deleted, and wherein said step (a) of reproducing includes the step of repeating the non-deleted parts specified by said instruction signals.

41. A system for compressing information bearing input signals such as speech to reduce the information content thereof without destroying the intelligibility thereof, said system comprising:

input means adapted to receive said input signals;

means for Mozer phase adjusting said signals to produce equivalent signals having symmetric portions; and means for deleting selected redundant portions of said equivalent signals.

42. The combination of claim 41 wherein said input signals are time domain signals and wherein said phase adjusting means includes means for transforming said input signals to said frequency domain to produce a set of discrete amplitudes and phase angles, means for adjusting said phase angles to produce a modified set of discrete amplitudes and phase angles capable of being inversely transformed to modified time domain signals having at least partially symmetric portions, and means for inverse transforming said phase adjusted set of discrete amplitudes and phase angles to the time domain to generate said modified time domain signals; and wherein said deleting means includes means for deleting redundant portions of those partially symmetric portions of said modified time domain signals output from said inverse transforming means.

43. The combination of claim 42 wherein said signals output from said inverse transforming means are substantially symmetric, and wherein said means for deleting includes means for deleting a symmetric half of said symmetric signals.

44. The combination of claim 41 further including means coupled to said input means for time quantizing the amplitude of said input signals.

45. The combination of claim 41 further including means coupled to said phase adjusting means for time quantizing the amplitude of signals output therefrom.

46. The combination of claim 41 further including means coupled to said input means for time differentiating said input signals.

47. The combination of claim 41 further including means coupled to said phase adjusting means for time differentiating said equivalent signals.

48. The combination of claim 41 further including means coupled to said input means for deleting parts of said input signals occurring later in time which are substantially identical to parts occurring earlier in time, and means for generating instruction signals specifying those parts so deleted.

49. The combination of claim 41 wherein said input signals are speech signals containing portions corresponding to phonemes and phoneme groups, and further including means coupled to said input means for selecting signals representative of particular phonemes and phoneme groups, means for deleting preselected parts of the phonemes and phoneme groups so selected, and means for generating first instruction signals identifying the phonemes and phoneme groups so selected.

50. The combination of claim 41 wherein said input signals are audio signals having phonemes and phoneme groups and further including means for deleting preselected signals representative of portions of particular phonemes and phoneme groups from said audio signals, said preselected signals corresponding to those portions lying between every nth pitch period, and wherein said generating means includes means for generating second instruction signals specifying said particular phonemes and phoneme groups so selected and identifying the corresponding values of n.

51. A system for synthesizing signals from compressed information signals having the form of an inverse transformation of a partially symmetric phase adjusted transform of the original signals, said compressed information signals being devoid of selected portions corresponding to a fraction of the partially symmetric portions of said phase adjusted transform, and instruction signals identifying the selected portions, said system comprising:

means for reproducing said compressed information signals;

means coupled to said reproducing means for expanding the reproduced signals to supply said fractional portions in accordance with said instruction signals; and means for converting the expanded reproduced signals to audible form.

52. The combination of claim 51 further including memory means for storing said compressed signals and wherein said reproducing means includes means for reading said compressed signals from said memory means.

53. The combination of claim 52 wherein said memory means comprises a digital storage device for storing said compressed signals in digital form, and wherein said reproducing means includes means for converting the digital signals stored therein to analog signals.

54. The combination of claim 51 wherein said compressed information signals are delta-modulated signals, and wherein said reproducing means includes means for delta-modulation decoding said compressed information signals.

55. The combination of claim 51 wherein said information signals are of a type previously compressed by the additional technique of deleting predetermined portions of said original signals corresponding to particular phonemes and phoneme groups, said predetermined portions lying between every nth pitch period of the corresponding phonemes and phoneme groups, said instruction signals further identifying the particular phonemes and phoneme groups and the corresponding values of n, and wherein said reproducing means includes means for sequentially repeating each of said predetermined portions of said compressed information signals corresponding to said particular phonemes and phoneme groups a number of times equal to the corresponding value of n specified by the identifying instruction signal.

56. The combination of claim 51 wherein said information signals are of a type previously compressed by the additional technique of separating said original signals into at least two parts and deleting parts occurring later in time which are substantially identical to parts occurring earlier in time, said instruction signals specifying those parts so deleted, and wherein said reproducing means includes means for repeating the non-deleted parts specified by said instruction signals.

57. A method of processing information bearing signals to initially reduce the information content thereof without destroying the intelligibility of the information contained therein and to synthesize signals from the processed signals, said method comprising the steps of:

(a) Mozer phase adjusting said information bearing signals to produce equivalent signals having substantially symmetric portions;

(b) deleting selected redundant portions of said equivalent signals;

(c) X period zeroing said information bearing signals by deleting preselected relatively low power portions of the signals resulting from steps (a) and (b);

(d) generating instruction signals specifying those portions of said signals deleted in steps (b) and (c);

(e) reproducing the signals resulting from said steps of (a) Mozer phase adjusting, (b) deleting and (c) X period zeroing;

(f) expanding said reproduced signals to supply said deleted redundant portions in accordance with said instruction signals;

(g) inserting substantially constant amplitude signals between the non-deleted portions of the signals resulting from step (f) in accordance with said instruction signals so that said deleted relatively low power signal portions are replaced by said signals of substantially constant amplitude; and (h) converting the signals resulting from step (g) to perceivable form.

58. The method of claim 57 wherein said information bearing signals are essentially periodic and wherein said preselected relatively low power portions lie in the range from $\frac{1}{4}$ to $\frac{3}{4}$ of the period.

59. The method of claim 58 wherein said information bearing signals are speech signals and wherein said period comprises the pitch period of said speech signals.

60. The method of claim 58 wherein said preselected portion is substantially $\frac{1}{2}$.

61. The method of claim 57 wherein said step of Mozer phase adjusting includes the step of transforming said information bearing signals to the frequency domain to produce a set of discrete amplitudes and phase angles, adjusting said phase angles so that the inverse transformation of the amplitudes and adjusted phases is at least partially symmetric, and inversely transforming said amplitudes and adjusting phases to the time domain; and wherein said step (b) of deleting includes the step of deleting fractional portions of those partially symmetric portions of said signals resulting from said step of inversely transforming.

62. The method of claim 61 wherein the signals resulting from said step of inversely transforming are substantially symmetric; and wherein said step (b) of deleting includes the step of deleting a symmetric half of said symmetric signals.

63. The method of claim 57 further including the step of storing in a memory device signals resulting from said steps of (b) deleting, (c) X period zeroing, and (d) generating.

64. The method of claim 63 wherein said step of storing is preceded by the step of converting said signals resulting from said steps of (b) deleting, (c) X period zeroing, and (d) generating to digital signals.

65. The method of claim 57 wherein said information bearing signals comprise audio electrical signals.

66. The method of claim 57 wherein said signals resulting from said steps of (b) deleting, (c) X period zeroing, and (d) generating are stored in a memory device, and wherein said step (e) of reproducing includes the step of reading the stored signals from said memory device.

67. The method of claim 66 wherein said stored signals are stored in said memory device in digital form, and wherein said step (e) of reproducing includes the step of converting said digital signals to analog signals.

68. The method of claim 57 wherein said signals resulting from said step (b) deleting, (c) X period zeroing, and (d) generating are delta-modulated signals, and wherein said step (e) of reproducing includes the step of delta-modulation decoding said resulting signals.

69. The method of claim 61 wherein said step of (f) expanding the reproduced signals includes the step of supplying said fractional portions in accordance with said instruction signals.

70. A system for processing information bearing input signals to initially compress said input signals by reducing the information content thereof without destroying the intelligibility thereof and subsequently synthesizing signals from said compressed signals, said system comprising:

input means adapted to receive said input signals;

means coupled to said input means for Mozer phase adjusting said input signals to produce equivalent signals having substantially symmetric portions;

means for deleting selected redundant portions of said equivalent signals;

means for X period zeroing the signals processed by said Mozer phase adjusting means and said deleting means by deleting preselected relatively low power portions of the processed signals;

means for generating instruction signals specifying those portions of said input signals deleted by said deleting means and said X period zeroing means;

means for reproducing the signals processed by said X period zeroing means;

means for expanding the reproduced signals to supply said deleted redundant portions in accordance with said instruction signals;

means for inserting substantially constant amplitude signals between the non-deleted portions of the signals generated by said expanding means in accordance with said instruction signals so that said deleted relatively low power signal portions are replaced by said signals of substantially constant amplitude; and means for converting the signals output from said inserting means to perceivable form.

71. The combination of claim 70 wherein said input signals are essentially periodic and wherein said preselected portions lie in the range from $\frac{1}{4}$ to $\frac{3}{4}$ of the period.

72. The combination of claim 71 wherein said predetermined portion is substantially $\frac{1}{2}$.

73. The combination of claim 71 wherein said input signals are speech signals and wherein said period comprises the pitch period of said speech signals.

74. The combination of claim 70 further including means coupled to said deleting means for delta modulating the signals output therefrom.

75. The combination of claim 78 further including means coupled to said deleting means and said generating means for storing the signals output therefrom.

76. The combination of claim 75 further including means coupled to said deleting means and said generating means for converting the signals output therefrom to digital form.

77. The combination of claim 70 wherein said input signals are time domain signals and wherein said Mozer phase adjusting means includes means for transforming said input signals to the frequency domain to produce a set of discrete amplitudes and phase angles, means for adjusting said phase angles to produce a modified set of discrete amplitudes and phase angles capable of being inversely transformed to modified time domain signals having at least partially symmetric portions, and means for inverse transforming said phase adjusted set of discrete amplitudes and phase angles to the time domain to generate said modified time domain signals; and wherein said deleting means includes means for deleting fractional portions of those partially symmetric portions of said modified time domain signals output from said inverse transforming means.

78. The combination of claim 77 wherein said signals output from said inverse transforming means are substantially symmetric, and wherein said deleting means includes means for deleting a symmetric half of said symmetric signals.

79. The combination of claim 74 wherein said reproducing means includes means for delta-modulation decoding said compressed information signals.

80. The combination of claim 77 wherein said means for expanding includes means for supplying said deleted fractional portions in accordance with said instruction signals.

81. In a synthesizer of original information bearing time domain signals from compressed information time domain signals produced by predetermined different signal compression techniques, said compressed information time domain signals comprising an inverse transformation of a Mozer phase adjusted transform of said original time domain signals, a memory device comprising:

means for storing said compressed information time domain signals and instruction signals specifying the particular compression technique applied to said original information bearing time domain signals to produce corresponding portions of said compressed information time domain signals, said compressed information time domain signals comprising a plurality of samples resulting from said predetermined signal compression techniques, the number of said different signal compression techniques applied to said original signal being greater than 2, the ratio of said plurality of samples to the minimum number of samples required to uniquely and intelligibly identify said original information bearing signals being no greater than about 0.2, and means for expanding said compressed signals comprising said inverse transform.

82. The combination of claim 81 wherein said ratio is no greater than about 0.05.

83. The combination of claim 81 wherein said ratio is no greater than about 0.0125.

84. The combination of claim 81 wherein said storing means comprises a digital storage device and wherein said compressed information time domain signal samples are digital characters.

85. The combination of claim 81 wherein said compressed information time domain signals and said instruction signals comprise X period zeroed representations of said original time domain signals, wherein X is a fraction in the range from $\frac{1}{4}$ to $\frac{3}{4}$.

86. The combination of claim 85 wherein X is $\frac{1}{2}$.

87. The combination of claim 81 wherein said compressed information time domain signals and said instruction signals comprise an inverse transformation of a partially symmetric Mozer phase adjusted transform of said original time domain signals.

88. The combination of claim 81 wherein said compressed information time domain signals comprise delta modulated representations of said original time domain signals.

89. The combination of claim 88 wherein said compressed information time domain signals comprise floating-zero, two-bit delta modulated representations of said original time domain signals.

90. A method of compressing information bearing signals comprising the steps of:

(a) phase adjusting said information bearing signals to produce equivalent signals having substantially symmetric portions;

(b) deleting selected redundant portions of said equivalent signals; and (c) processing said equivalent signals by the additional signal compression technique of X period zeroing said information bearing signals.

91. The method of claim 90 further including the step of delta modulating the signals resulting from said step (b) of deleting.

92. The method of claim 90 wherein said step (a) of phase adjusting includes the step of transforming said information bearing signals to the frequency domain to produce a set of discrete amplitudes and phase angles, adjusting said phase angles, and inversely transforming said amplitudes and adjusted phases to the time domain.

93. The method of claim 92 wherein said step of adjusting includes the step of adjusting said phase angles so that the inverse transformation of the amplitudes and adjusted phases contains a minimum amount of power in said preselected portions.

94. The combination of claim 93 wherein said step (c) of processing includes the step of delta modulating said equivalent signals and wherein said step of adjusting includes the step of adjusting said phase angles so that the inverse transformation of the amplitudes and adjusted phases is such that the difference between amplitudes of successive digitizations thereof are consistent with possible values obtainable from said step of delta modulating.

95. The method of claim 91 wherein said step of delta modulating includes the steps of time quantizing successive amplitude points of said equivalent signals, forming a first difference by subtracting the $(n-1)$st time quantized amplitude point from the nth time quantized amplitude point and a second difference by subtracting the nth time quantized amplitude point from the $(n+1)$st time quantized amplitude point, and generating a signal representative of said second difference and restricted to one of a predetermined confined number of values when said first difference is within the most positive $\frac{1}{2}$ of said confined number of values and generating a signal representative of said second difference and restricted to the negative of said one of a predetermined confined number of values when said first difference is within the most negative half of said confined number of values.

96. The method of claim 22 wherein said information bearing signals are speech signals containing portions corresponding to phonemes and phoneme groups, and wherein said method further includes the step of selecting signals representative of portions of particular phonemes and phoneme groups lying between every nth pitch period, deleting the signals so selected, and generating second instruction signals specifying the particular portions of said phonemes and phoneme groups so selected for deletion and identifying the values of n.

97. For use with a memory element containing compressed information time domain signals produced by predetermined signal compression techniques and instruction signals specifying the particular compression techniques applied to original information bearing time domain signals to produce corresponding portions of said compressed information time domain signals, said predetermined signal compression techniques including Mozer phase adjusting of said original information bearing time domain signals, a controller device for synthesizing said original information bearing time domain signals, said controller device comprising:

controller storage means having an input adapted to be coupled to said memory element for sequentially receiving ordered ones of said compressed information time domain signals;

means adapted to be coupled to said controller storage means for generating control signals enabling said ordered ones of said compressed information time domain signals to be coupled to said controller storage means, said control signal generator means including means for receiving corresponding ones of said instruction signals identifying the type of compression technique applied to said ordered ones of said compressed information time domain signals associated with said control signals;

converter means coupled to said controller storage means for converting said ordered ones of said compressed information time domain signals to synthetic analog signals corresponding to said original information bearing time domain signals; and means responsive to receipt of a Mozer phase adjust instruction signal from said memory element for causing compressed information time domain signals stored in said controller storage means to be sequentially coupled to said converter means in a first ordered manner and subsequently causing the same signals stored in said controller storage means to be sequentially coupled to said converter means in a reverse manner from said first ordered manner.

98. The combination of claim 97 wherein said compressed signals and said instruction signals are digital characters, said controller storage means comprises a digital storage device, and said converter means includes digital-to-analog converter means for converting ordered ones of said compressed information time domain digital characters of said synthetic analog signals.

99. The combination of claim 97 wherein said predetermined signal compression techniques include X period zeroing of said original information bearing time domain signals, and wherein said controller device further includes means responsive to receipt of an X period zero instruction signal from said memory element for causing said converter means to output a signal of substantially constant amplitude as a portion of the synthetic analog signal generated thereby.

100. The combination of claim 97 wherein said predetermined signal compression techniques include delta modulation of said original information bearing time domain signals, and wherein said controller device further includes means coupled to said controller storage means for delta demodulating signals appearing at the output thereof, when enabled, and means coupled to said delta demodulating means and responsive to the receipt by said control means of a delta modulation instruction signal from said memory element for enabling said delta demodulating means to delta demodulate the ordered ones of said compressed information signals corresponding to said delta demodulation instruction signal.

* * * * *

UNITED STATES PATENT AND TRADEMARK OFFICE

CERTIFICATE OF CORRECTION

PATENT NO. : 4,214,125

DATED : July 22, 1980

INVENTOR(S) : Forrest S. Mozer and Richard P. Stauduhar

It is certified that error appears in the above-identified patent and that said Letters Patent are hereby corrected as shown below:

Col. 2, line 55, "format" should be --formant--.

Col. 4, line 2, "wveform" should be --waveform--.

Col.22, line 57, "word" should be --words--.

Col.26, line 44, "fileter" should be --filter--.

Col.26, line 66, "th" should be --the--.

Col.33, before Table 7, add the following:

--$B_1$ through $B_5$ are the output waveforms of the logic read-only memory 238.--

Table 7, line 9, col. 1, "1" should be --0--;

line 9, col. 2, "0" should be --1--.

Col.39, line 2, "threfore" should be --therefore--.

Col.40, line 57, "$t = 3_+$" should be --$t = -3_+$--.

Claim 6, line 2, after "separately", insert --storing--.

Signed and Sealed this

Twenty-fifth Day of November 1980

[SEAL]

Attest:

SIDNEY A. DIAMOND

Attesting Officer

Commissioner of Patents and Trademarks